US009995469B2

(12) United States Patent
Verfuerth et al.

(10) Patent No.: US 9,995,469 B2
(45) Date of Patent: Jun. 12, 2018

(54) LIGHTING FIXTURE

(71) Applicant: Energy Bank, Inc., Manitowoc, WI (US)

(72) Inventors: Neal R. Verfuerth, Manitowoc, WI (US); Brandon J. King, Manitowoc, WI (US)

(73) Assignee: Energy Bank Incorporated, Manitowoc, WI (US)

( * ) Notice: Subject to any disclaimer, the term of this patent is extended or adjusted under 35 U.S.C. 154(b) by 0 days. days.

(21) Appl. No.: 15/837,638

(22) Filed: Dec. 11, 2017

(65) Prior Publication Data

US 2018/0100641 A1 Apr. 12, 2018

Related U.S. Application Data

(63) Continuation-in-part of application No. 29/564,608, filed on May 13, 2016, now Pat. No. Des. 805,233, which is a continuation-in-part of application No. 15/074,421, filed on Mar. 18, 2016, now Pat. No. 9,874,338.

(60) Provisional application No. 62/135,980, filed on Mar. 20, 2015.

(51) Int. Cl.

| | |
|---|---|
| ***F21V 21/116*** | (2006.01) |
| ***F21V 23/00*** | (2015.01) |
| ***F21V 29/70*** | (2015.01) |
| ***F21V 17/12*** | (2006.01) |
| ***F21V 29/508*** | (2015.01) |
| ***F21V 3/00*** | (2015.01) |
| ***F21S 8/08*** | (2006.01) |
| *F21Y 115/10* | (2016.01) |
| *F21W 131/10* | (2006.01) |

(52) U.S. Cl.

CPC ..... *F21V 21/116* (2013.01); *F21S 8/08* (2013.01); *F21V 3/00* (2013.01); *F21V 17/12* (2013.01); *F21V 23/009* (2013.01); *F21V 29/508* (2015.01); *F21V 29/70* (2015.01); *F21W 2131/10* (2013.01); *F21Y 2115/10* (2016.08)

(58) Field of Classification Search

CPC ..... F21K 9/20; F21V 17/107; F21V 17/18; F21V 21/008; F21V 21/02; F21V 21/116; F21V 21/14; F21V 3/00; F21V 5/007; F21V 23/005; F21V 23/007; F21V 29/74; F21V 29/508; F21V 29/713; F21V 29/717; F21V 29/76; F21V 29/89

See application file for complete search history.

(56) References Cited

U.S. PATENT DOCUMENTS

| | | | | |
|---|---|---|---|---|
| 8,690,391 | B2 * | 4/2014 | Drake | F21V 11/183 362/247 |
| 2011/0235330 | A1 * | 9/2011 | Pedersen | F21V 21/30 362/249.03 |
| 2011/0249427 | A1 * | 10/2011 | Rooms | F21S 8/026 362/147 |

(Continued)

*Primary Examiner* — Hargobind S Sawhney
(74) *Attorney, Agent, or Firm* — Smith Keane LLP

(57) ABSTRACT

A lighting fixture with a driver housing assembly indirectly coupled to a heat sink through an offset mounting bracket. The heat sink having at least one light source attached thereto and the driver housing assembly housing a driver for powering the at least one lighting source. The lighting fixture may include a number of heat sinks with lighting sources to provide various levels of lighting.

19 Claims, 56 Drawing Sheets

(56) References Cited

U.S. PATENT DOCUMENTS

2013/0155702 A1* 6/2013 Rea ..... A01G 7/045
362/391

* cited by examiner 22a
22b
22c
22d
22e
22f
22g
22h
22i
22j
22k
22l
22m
22n
22o
22p
22q
22r
22s
22t
22u
22v
22w
22x
22y
22z
23a
23b
23c
23d
23e
23f
23g
23h
23i
23j
23k
23l
23m
23n
23o
23p
23q
23r
23s
23t
23u
23v
23w
23x
23y
23z
24a
24b
24c
24d
24e
24f
24g
24h
24i
24j
24k
24l
24m
24n
24o
24p
24q
24r
24s
24t
24u
24v
24w
24x
24y
24z
25a 24
22
24
22
24
22

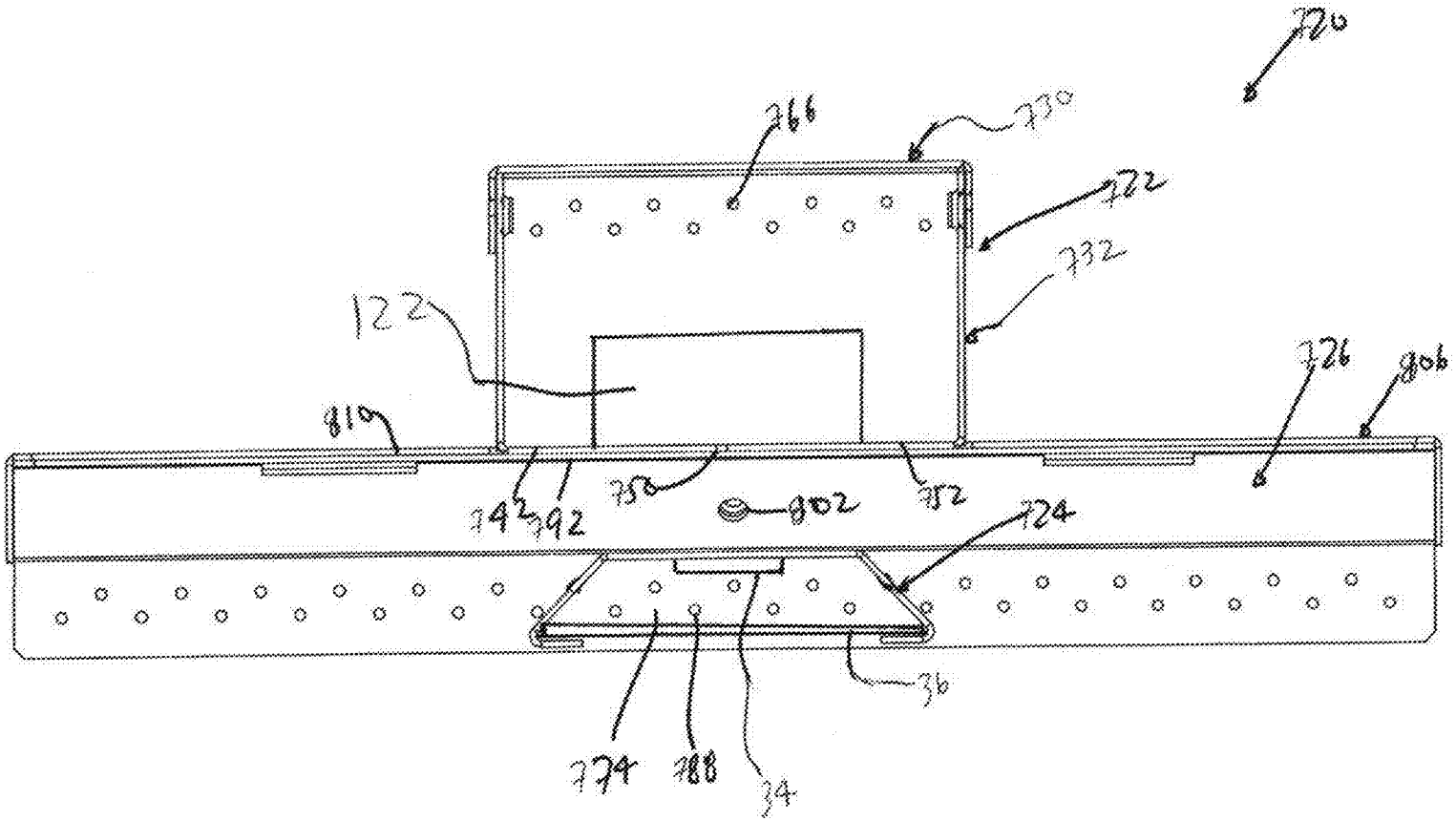
720
722
722
720
724
726
726
726

LIGHTING FIXTURE

Related Applications

This application is a continuation-in-part of U.S. application Ser. No. 15/074,421, filed 18 Mar. 2016, titled "Universal Mounting System for Mounting a Lighting Fixture to a Pole" and a continuation-in-part of U.S. application Ser. No. 29/564,608, filed 13 May 2016, titled "Lighting Fixture," which are incorporated herein by reference in their entirety.

BACKGROUND OF THE INVENTION

In some instances, lighting fixtures are mounted to poles by a bracket. Each lighting fixture has its own particular bracket that must be used to mount the lighting fixture to the pole. This results in a large inventory in brackets which is expensive to maintain.

In addition to light, lighting sources and the electrical components used to drive the lighting sources generate heat during operation. This heat must be managed to allow for proper operation of the lighting fixture and maximum life of the lighting source and the electrical components.

SUMMARY OF THE INVENTION

A lighting fixture with a driver housing assembly indirectly coupled to a heat sink through an offset mounting bracket. The heat sink having at least one light source attached thereto and the driver housing assembly housing a driver for powering the at least one lighting source. The lighting fixture may include a number of heat sinks with lighting sources to provide various levels of lighting.

One aspect of the proposed invention is to provide a lighting fixture comprising a driver housing assembly housing a driver; a heat sink having a first end and a second end and a lighting source attached thereto; a first mounting bracket; and a second mounting bracket; whereby the first end of the heat sink is coupled to the driver housing assembly through the first mounting bracket and the second end of the heat sink is coupled to the driver housing through the second mounting bracket.

The lighting source in the lighting fixture may be a light emitting diode. Further, the driver housing assembly may comprise a pan and a driver housing cover. The driver housing cover may include an access panel, and the cover may have a first end wall and a second end wall, and a plurality of vias provided in each of the first and second end walls.

Additionally, or alternatively, the first and second mounting brackets may each comprise a second wall offset from a mounting flange by a first wall, whereby the mounting flange and second wall are parallel; and whereby the driver housing assembly is attached to the mounting flanges of the first and second mounting brackets, the first end of the heat sink is attached to the second wall of the first mounting bracket, and the second end of the heat sink is attached to the second wall of the second mounting bracket.

The lighting fixture may further comprise a first mounting bracket cover to cover the first mounting bracket and a second mounting bracket cover to cover the second mounting bracket. The first mounting bracket cover may cover the first end of the heat sink and the second mounting bracket cover may cover the second end of the heat sink. The first and second mounting bracket covers may have a plurality of vias. The first and second mounting bracket covers may comprise mounting holes configured to receive a fixture mounting device.

Additionally, or alternatively, the heat sink may comprise a base wall, a first depending side wall extending from a first side edge of the base wall having a first flange, and a second depending side wall extending from a second side edge of the base wall having a second flange. A lens may be positioned on the first and second flanges.

Additionally, or alternatively, the lighting fixture may comprise two heat sinks, each comprising at least one lighting source.

Additionally, or alternatively, the lighting fixture may comprise three heat sinks, each comprising at least one lighting source. The three heat sinks may be equally spaced along the first and second mounting brackets.

Additionally, or alternatively, the lighting fixture may comprise four heat sinks, each comprising at least one lighting source. The four heat sinks may be equally spaced along the first and second mounting brackets.

Additionally, or alternatively, the lighting fixture may comprise five heat sinks, each comprising at least one lighting source. The five heat sinks may be equally spaced along the first and second mounting brackets.

This Summary is provided merely for purposes of summarizing some example embodiments so as to provide a basic understanding of some aspects of the disclosure.

Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements.

FIG. 28 is a perspective view of a light assembly which may be incorporated into the lighting fixture.

FIG. 36 is an end elevation view of the high bay/low bay lighting fixture of FIG. 33.

FIG. 37 is a cross-sectional view of the high bay/low bay lighting fixture of FIG. 33.

FIG. 38 is another cross-sectional view of the high bay/low bay lighting fixture of FIG. 33.

FIG. 43 is a bottom plan view of the lighting fixture of FIG. 42.

DESCRIPTION OF THE PREFERRED EMBODIMENT

Figure 1:
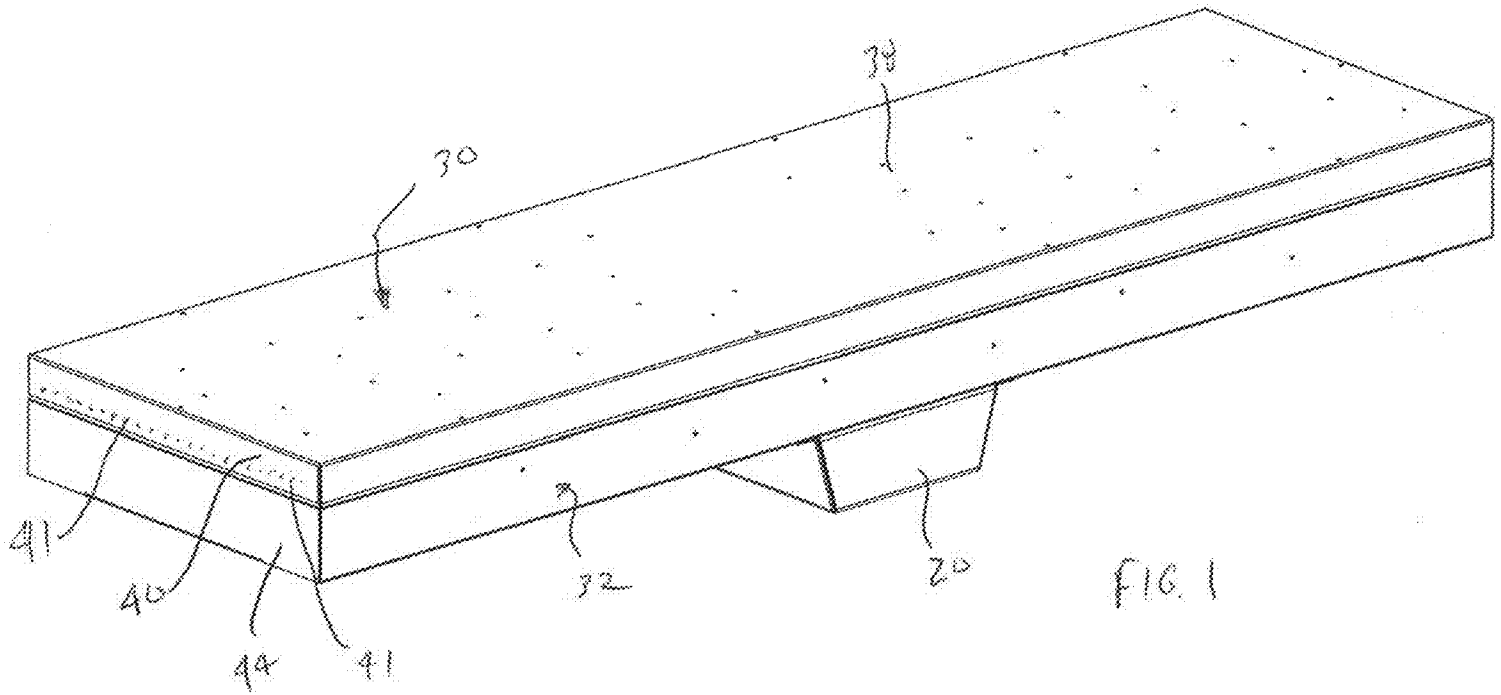
FIG. 1 is a top perspective view of a lighting fixture which incorporates the features of the present disclosure.

While the disclosure may be susceptible to embodiment in different forms, there is shown in the drawings, and herein will be described in detail, specific embodiments with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative embodiments within the scope of the disclosure.

A universal mounting system 20, 20*a*, 20*b*, 20*c* is provided for mounting a lighting fixture 22, particularly an outdoor lighting fixture, to an any pole 24 that extends from the ground. The pole 24 has a lower end which is attached to the ground, an open upper end 26 and a passageway 25 that runs through the pole from its lower end to its upper end. The pole 24 is usually square but may be cylindrical, but may take other forms, such as having a square or rectangular cross-section. The universal mounting system 20, 20*a*, 20*b*, 20*c* is configured for applications such as a parking lot lighting, auto dealerships, display (e.g. building-elevation, billboard, etc.) application, etc. When the universal mounting system 20, 20*a*, 20*b*, 20*c* is mounted to an existing pole 24, no modification to the existing infrastructure is necessary other than to occasionally drill a pair of aligned holes 28*a*, 28*b* proximate to the top end of the pole 24, and attaching the universal mounting system 20, 20*a*, 20*b*, 20*c* and lighting fixture 22 to the pole 24 as described herein. Therefore, the universal mounting system 20, 20*a*, 20*b*, 20*c* is easily used to retrofit any existing pole 24.

The lighting fixture 22 includes a cover 30 and a pan 32 that mates together to form an internal cavity therewithin. The cover and pan 30, 32 form a housing which surrounds one or more lighting sources 34, such as LEDs, and includes a lens 36 (e.g., a plastic sheet, a glass sheet, etc.) that allows light from the one or more lighting sources 34 to shine downwardly from the lighting fixture 22. Other electronics may be mounted within the internal cavity formed by the cover and pan 30, 32 as discussed herein.

As shown in FIGS. 1-7, the cover 30 has an upper wall 38 and a side wall 40 which depends downwardly therefrom to form an open-ended box-like structure. As shown, the upper wall 38 is rectangular and the side wall 40 is formed of four portions which are joined together at their ends. The cover 30 may take other shapes. The side wall 40 includes a plurality of spaced apart, small diameter vias 41 to allow air to pass out of the lighting fixture 22. The vias 41 are small enough to allow air to pass therethrough, but not allow contaminants into the lighting fixture 22. The vias 41 may have a diameter which ranges in size from 0.040" to 0.187".

The pan 32 includes a lower wall 42 and a side wall 44 which extends upwardly therefrom to form an open ended box-like structure. As shown, the lower wall 42 is rectangular and the side wall 44 is formed of four portions which are joined together at their ends. The pan 32 may take other shapes. The lower wall 42 has a plurality of spaced apart apertures 46, 48, 50 therethrough. As shown, three apertures 46, 48, 50 are provided, however, more or fewer than three may be provided. As shown, aperture 48 is centrally located and surround by a wall section 52 of the lower wall 42. As shown, the aperture 48 is rectangular, but other shapes may be provided. Lighting sources 34 are mounted in the first and third apertures 46, 50 in a manner to allow the light to shine downwardly. The shape and orientation of the cover 30 and pan 32 relative to the lighting sources 34 is configured to provide a full cut off such that light does not project above the plane of the cover 30. The lighting fixture 22 is preferably "dark-sky" compliant or friendly. The aperture 48 is open such that the internal cavity formed by the cover 30 and pan 32 can be accessed.

Figure 7:
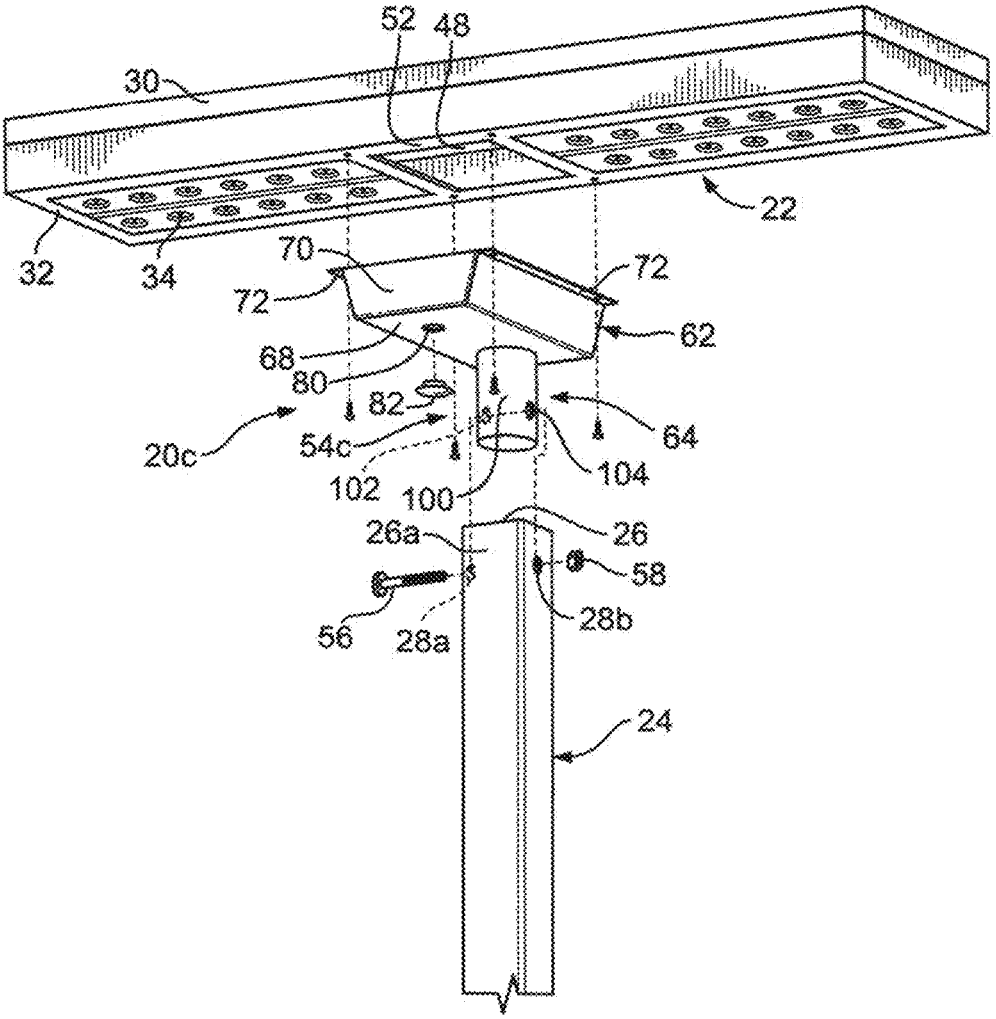
FIG. 7 is an exploded perspective view of a pole, a lighting fixture and a bracket which incorporates the features of an even further embodiment of the disclosure.
Figure 7A:
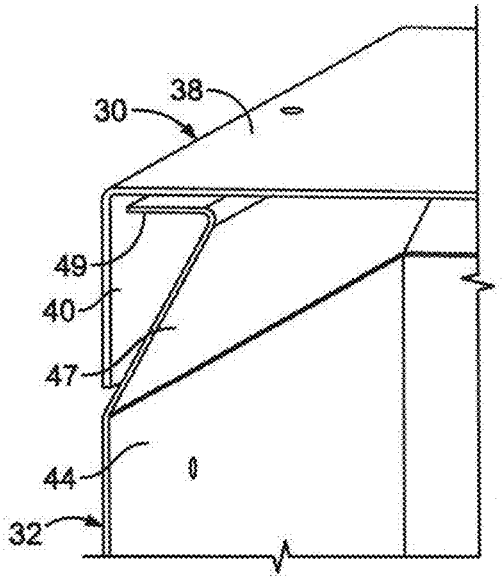
FIG. 7A is a cross-sectional view shown in perspective of a "no-drip edge" which may be incorporated into the lighting fixture.
Figure 7B:
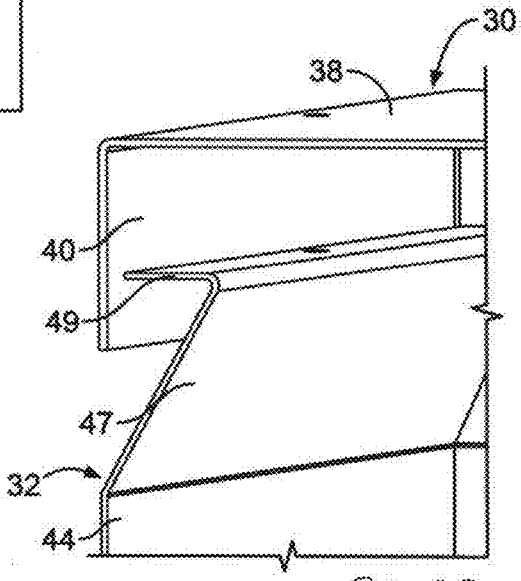
FIG. 7B is a cross-sectional view shown in perspective of the "no-drip edge" in an exploded condition.
Figure 7C:
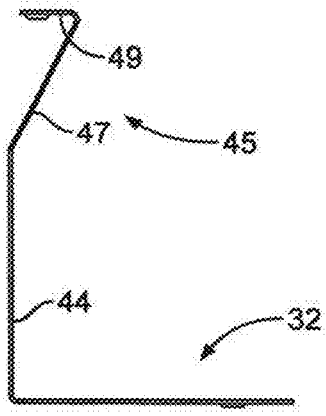
FIG. 7C is a cross-sectional view of a portion of the pan used with the "no-drip edge" of FIGS. 7A and 7B.

As shown in FIGS. 7A-7C, the cover 30 and pan 32 may include a "no-drip" edge to prevent water intrusion therein. Each side wall 44 of the pan 32 has a bend 45 formed at the upper edge thereof which seats under the upper wall 38 and the side wall 40 of the cover 30. The bend 45 include a first leg 47 which angles inwardly into the cavity formed by the cover 30 and the pan 32 and a second leg 49 which is horizontal and is perpendicular to the side wall 44 if the side wall 44 is vertical. As such, the first leg 47 and the second leg 49 are angled relative to each other. The side wall 40 of the cover 30 extends along an outer surface of the legs 47, 49 such that the bend 45 is seated under the cover 30. The upper wall 38 abuts against the second leg 49 of the bend 45. If water falls onto the cover 30, the bend 45 prevents the intrusion of water into the pan 30. The universal mounting system 20, 20*a*, 20*b*, 20*c* includes a bracket 54, 54*a*, 54*b*, 54*c* which is attached to the upper end 26 of the pole 24 as described herein, a mounting fastener 56 which extends through the bracket 54, 54*a*, 54*b*, 54*c* and an upper end portion 26*a* of the pole 24, a nut 58 which attaches to the mounting fastener 56, and a plurality of fasteners 60 for attaching the bracket 54, 54*a*, 54*b*, 54*c* to the wall section 52 of the lower wall 42 of the lighting fixture 22. The component pieces of the universal mounting system 20, 20*a*, 20*b*, 20*c* may be formed of galvanized steel but may be any other metal (e.g., steel, aluminum), plastic, and/or composite material, or a combination thereof.

The bracket 54, 54*a*, 54*b*, 54*c* has an housing 62, 62*a*, 62*b*, 62*c* and a fastener mount 64, 64*a*, 64*b*, 64*c* as described herein. The fastener mount 64, 64*a*, 64*b*, 64*c* extends from the housing 62, 62*a*, 62*b*, 62*c* at an angle relative thereto. The fastener mount 64, 64*a*, 64*b*, 64*c* has at least one opening 66, 66*a*, 66*b*, 66*c* therethrough as described herein. The housing 62, 62*a*, 62*b*, 62*c* may be formed separately from the fastener mount 64, 64*a*, 64*b*, 64*c* such that the fastener mount 64, 64*a*, 64*b*, 64*c* is moveable relative to the housing 62, 62*a*, 62*b*, 62*c*. The housing 62, 62*a*, 62*b*, 62*c* and the fastener mount 64, 64*a*, 64*b*, 64*c* may be integrally formed, or may be formed of different components and fixedly secured together.

To mount the bracket 54, 54*a*, 54*b*, 54*c* to the pole 24, the housing 62, 62*a*, 62*b*, 62*c* seats on the upper end 26 of the pole 24 and overhangs the upper end of the pole 24, and the fastener mount 64, 64*a*, 64*b*, 64*c* mates with the upper end portion 26*a* of the pole 24 and is attached to the upper end portion 26*a* of the pole 26. The mounting fastener 56 is passed through the holes 28*a*, 28*b* in the pole 24 and through the at least one opening 66, 66*a*, 66*b*, 66*c* in the fastener mount 64, 64*a*, 64*b*, 64*c*. The nut 58 is attached to the end of the mounting fastener 56 that extends outwardly from the pole 24 to secure the bracket 54, 54*a*, 54*b*, 54*c* to the pole 24. The bracket 54, 54*a*, 54*b*, 54*c* is then attached to the wall section 52 of the lower wall 42 by the fasteners 60 to secure the bracket 54, 54*a*, 54*b*, 54*c* to the lighting fixture 22.

Figure 2:
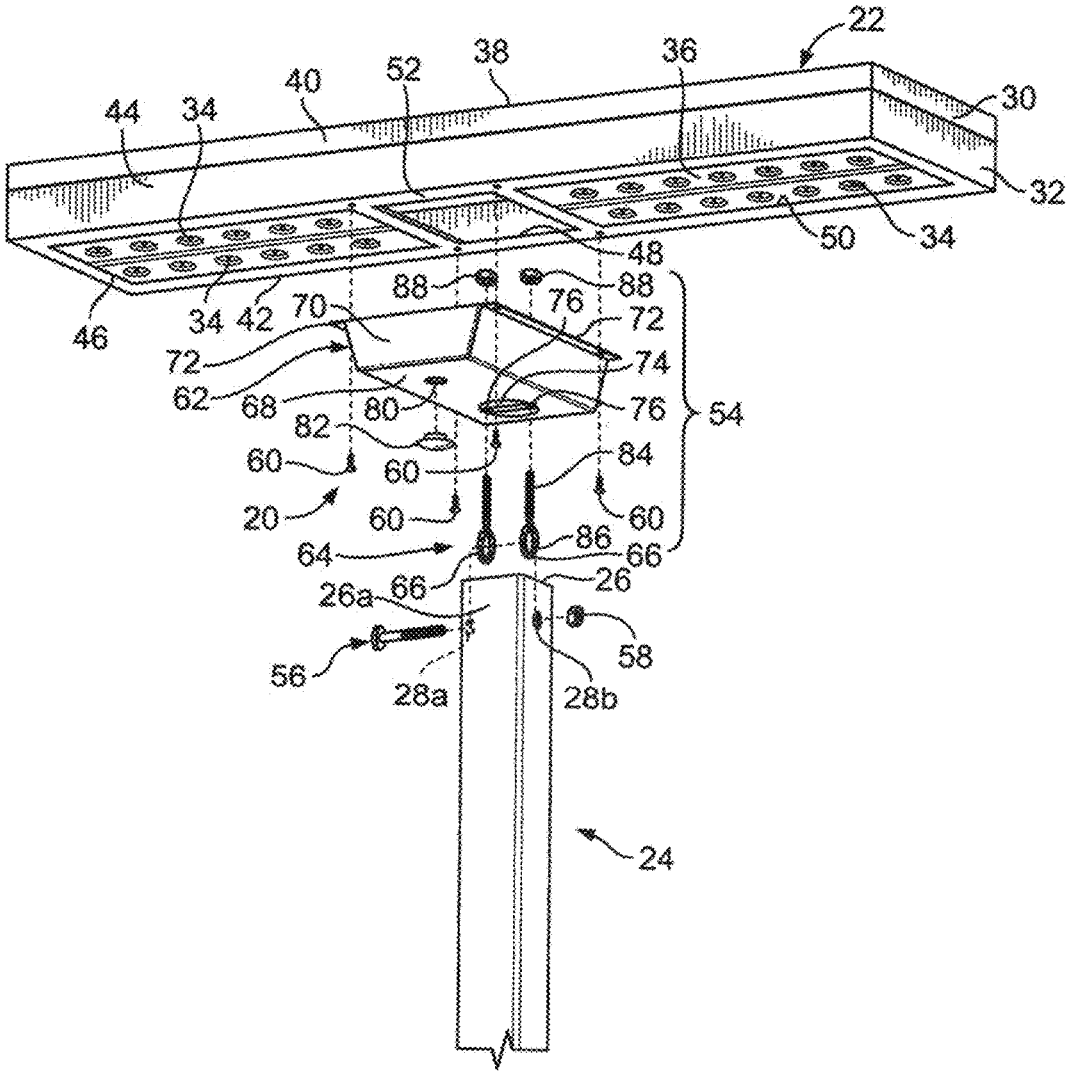
FIG. 2 is an exploded perspective view of a pole, a lighting fixture and a bracket which incorporates the features of an embodiment of the disclosure.
Figure 3:
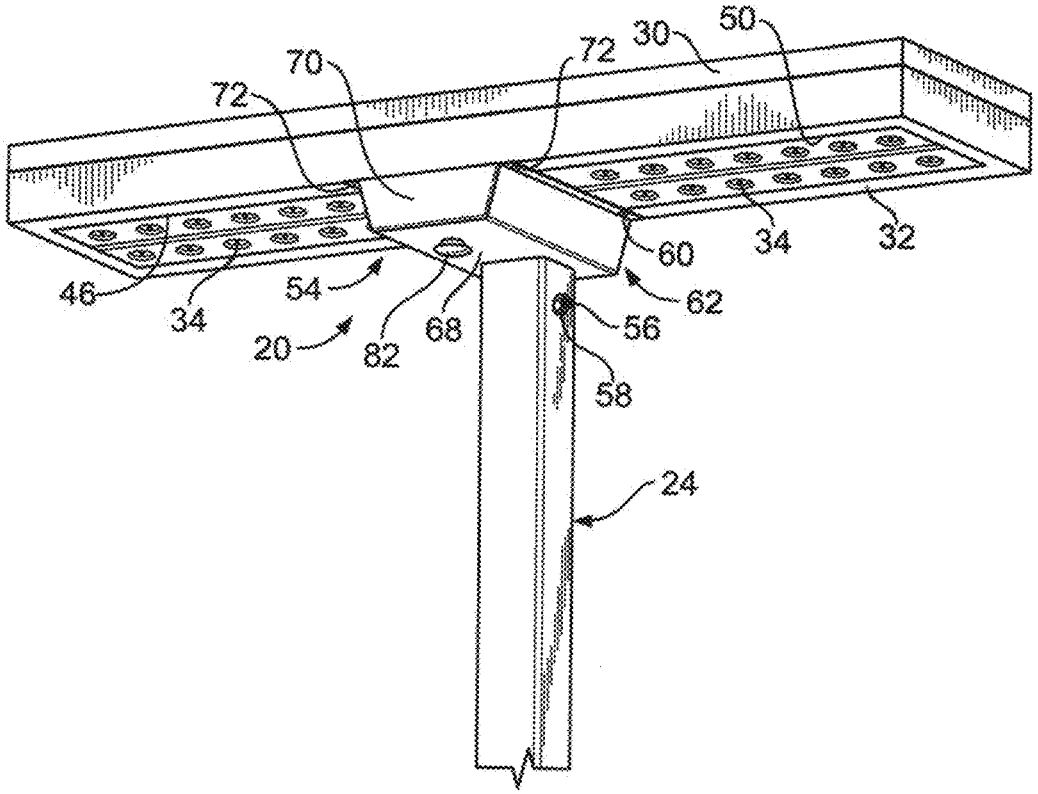
FIG. 3 is an assembled perspective view of the pole, the lighting fixture and the bracket.
Figure 4:
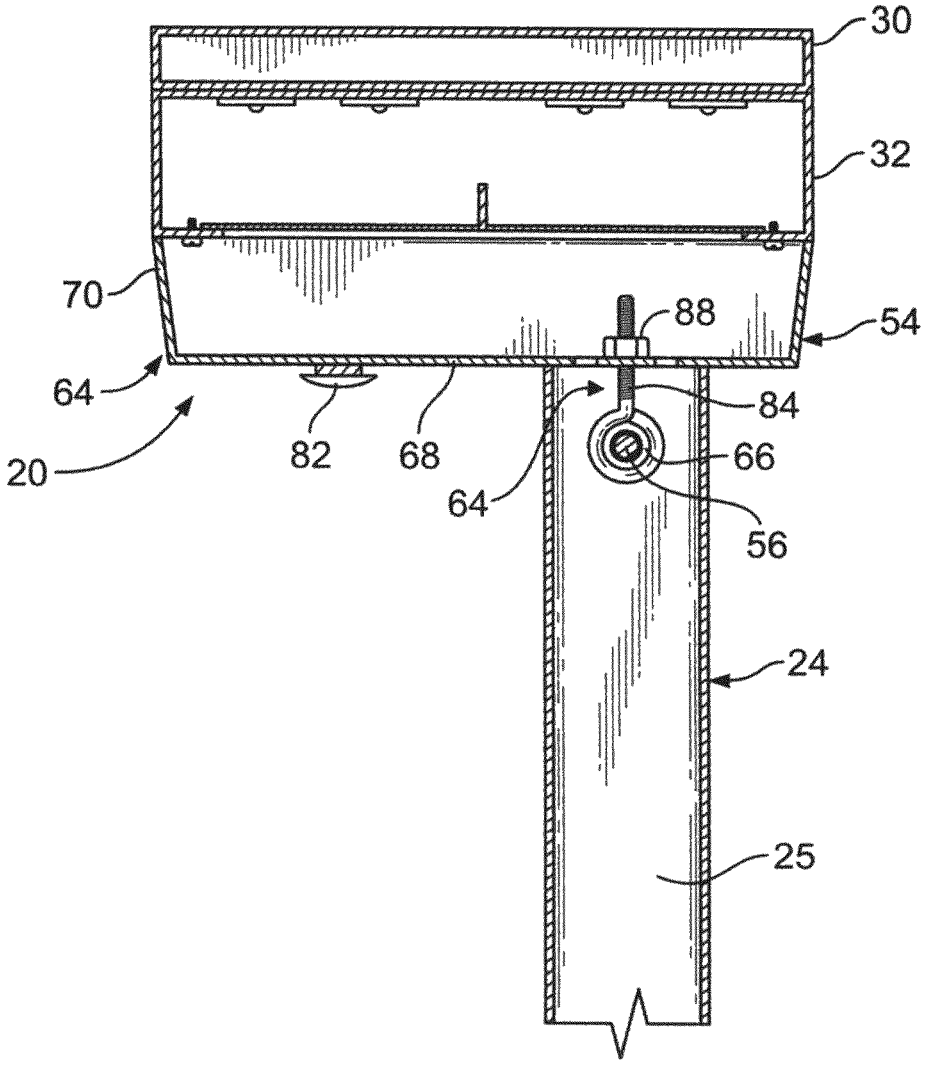
FIG. 4 is a cross-sectional view of pole, the lighting fixture and the bracket in an assembled condition.

FIGS. 2-4 show a first embodiment of the bracket 54. In this embodiment, the housing 62 is formed as an open-ended member having a base wall 68, a side wall 70 extending upwardly therefrom, and a pair of opposed flanges 72 extending outwardly from the upper end of the side wall 70. A continuous flange may extend from the side wall 70. The walls 68, 70 define a cavity therein. As shown, the base wall 68 is rectangular and the side wall 70 has four portions which extend upwardly from the edges of the base wall 68. The portions are joined together at their ends to form the continuous side wall 70. The flange(s) 72 extends generally from the side wall 70 such that the flange(s) 72 is/are parallel to wall section 52. It is to be understood that the base wall 68 can take other shapes, such as square, triangular, etc.

The base wall 68 has at least one passageway 74 therethrough through which wires can be fed from the pole through the bracket 54 to connect to the lighting sources 34 and other electronics in the lighting fixture 22. As shown, a pair of spaced apart passageways 74 are provided. In this embodiment, the base wall 68 further has a pair of spaced apart, linearly aligned apertures 76 therethrough. If a pair of passageways 74 are provided, the apertures 76 may be positioned between the passageways 74. A hole 80 for mounting a camera or sensor 82 may also be provided through the base wall 68 at position which is spaced from the passageway(s) 74 and apertures 76. The hole 80 may be provided in a door 81 which can be opened or closed to allow access to components within the bracket 54. A pair of holes 80 may be provided for mounting both an occupancy sensor and a camera, to allow for additional energy savings and security. The sensor 82 may be used to sense when to turn the lighting sources 34 on or off, for example, the sensor 82 can sense when dusk and dawn occurs. The lighting fixture 22 may also be configured to provide wired or wireless communications capabilities, one or more control algorithms based on sensor feedback, built-in redundancy, as is known in the prior art.

In this embodiment, the fastener mount 64 is formed separately from the housing 62 and is formed of a pair of fasteners. Each fastener has an elongated threaded shank 84 with a loop 86 at an end through which the opening 66 is formed. The fasteners may be formed from eye bolts. The threaded shanks 84 extend through the apertures 76 in the base wall 68 such that the openings 66 are below the base wall 68 and spaced therefrom. Nuts 88 are secured to the upper ends of the threaded shanks 66 and seat against the upper surface of the base wall 68 to secure the fasteners to the housing 62.

In use, the lower surface of the base wall 68 seats on the upper end 26 of the pole 24, and the lower ends of the threaded shanks 84 extend into the passageway 25 of the pole 24. The passageway(s) 74 align with the passageway 25 through the pole 24. The openings 66 in the threaded shanks 84 align with the holes 28*a*, 28*b* in the pole 24. The base wall 68 is larger than the upper end 26 of the pole 24 such that the base wall 68 overhangs the upper end 26 of the pole 24. The mounting fastener 56 is inserted through one hole 28*a* in the pole 24, through the openings 66 in the threaded shanks 84, and through the other hole 28*b* in the pole 24. The nut 58 is attached to the end of the mounting fastener 56 that extends outwardly from the pole 24. This secures the bracket 54 to the pole 24. The bracket 54 is then attached to the wall section 52 of the lower wall 42 of the lighting fixture 22 by the fasteners 60 that extend through the flange(s) 72 and into the wall section 52.

As an alternative, the lower ends of the threaded shanks 84 may seat against the exterior of the pole 24. The holes 28*a*, 28*b* in the pole 24 can be predrilled such that the openings 66 align with the predrilled holes 28*a*, 28*b*, or the holes 28*a*, 28*b* can be drilled after the bracket 54 is seated on the upper end 26 of the pole 24. In this alternative embodiment, the mounting fastener 54 is inserted through the opening 66 in one threaded shank 84, through the hole 28*a* in the pole 24, through the other hole 28*b* in the pole 24, and then through the opening 66 of the other threaded shank 84. The nut 58 is attached to the end of the mounting fastener 56 that extends outwardly from the pole 24. This secures the bracket 54 to the pole 24. The bracket 54 is then attached to the wall section 52 of the lower wall 42 of the lighting fixture 22 by the fasteners 60 that extend through the flange(s) 72 and into the wall section 52.

The universal mounting system 20 can be easily removed from the pole 24 by reversing the order of assembly. The universal mounting system 20 can be easily removed from the lighting fixture 22 by removal of the fasteners 60 from the wall section 52 of the pan 32. The universal mounting system 20 can then be used on another pole by reusing existing holes or drilling new holes through the pole.

Figure 5:
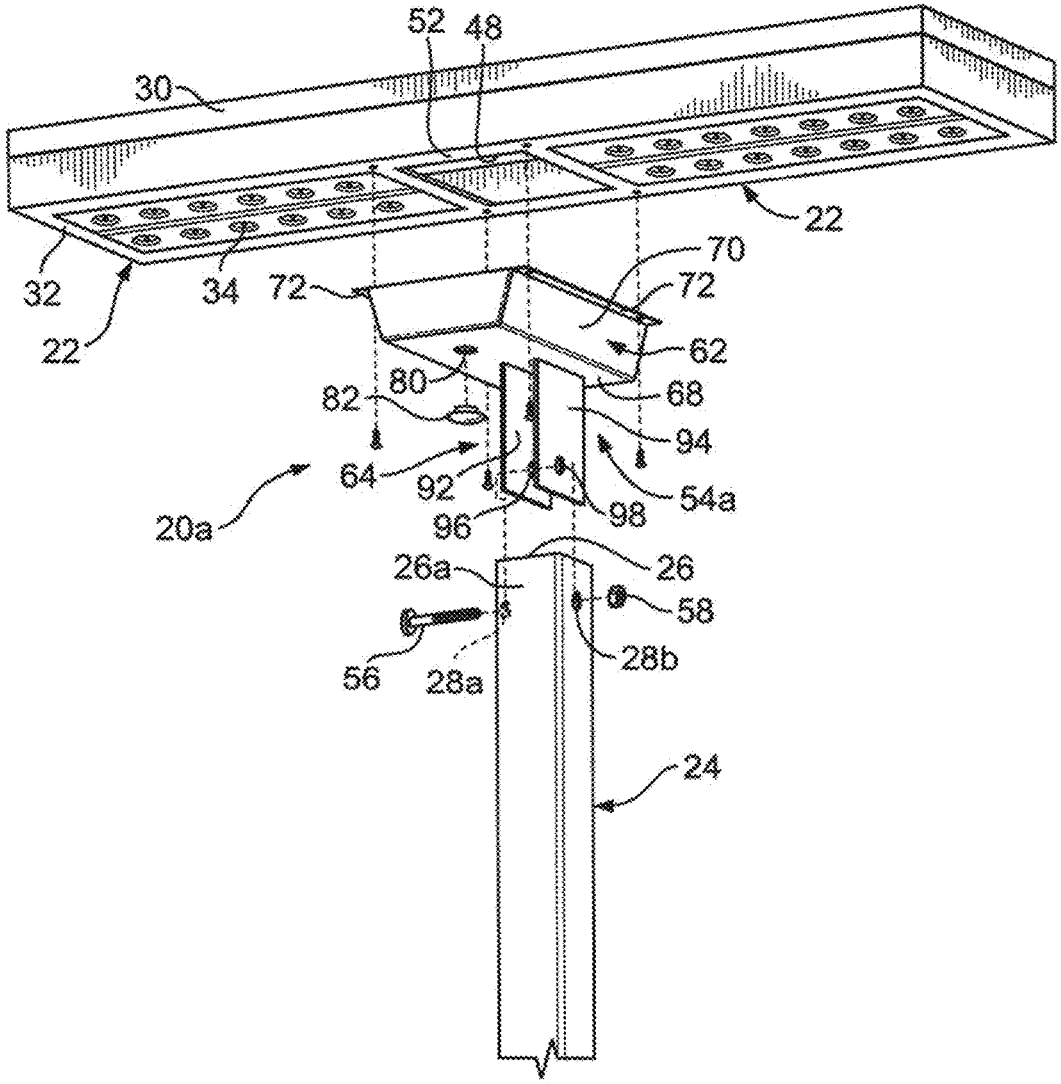
FIG. 5 is an exploded perspective view of a pole, a lighting fixture and a bracket which incorporates the features of an alternate embodiment of the disclosure.

FIG. 5 shows a second embodiment of the bracket 54*a*. In this embodiment, the housing 62 is identically formed to the housing 62 of the first embodiment and the specifics are not repeated.

In this embodiment, the fastener mount 64 may be formed integrally with the u housing 62, or formed separately and then fixedly attached to the housing 62. In this embodiment, the fastener mount 64 is formed of a pair of spaced apart walls 92, 94 which extend downwardly from the base wall 68. Each wall 92, 94 has an opening 96, 98 proximate to an end thereof, such that the openings 96, 98 are spaced from the lower surface of the base wall 68 by a predetermined distance. The passageway(s) 74 are provided between the walls 92, 94.

In use, the lower surface of the base wall 68 seats on the upper end of the pole 24 as previously described and the walls 92, 94 extend into the passageway 25 of the pole 24. The passageway(s) 74 align with the passageway 25 through the pole 24. The openings 96, 98 in the walls 92, 94 align with the holes 28*a*, 28*b* in the pole 24. The mounting fastener 56 is inserted through one hole 28*a* in the pole 24, through the openings 96, 98 in the walls 92, 94, and through the other hole 28*a* in the pole 24. The nut 58 is attached to the end of the mounting fastener 56 that extends outwardly from the pole 24. This secures the bracket 54*a* to the pole 24. The bracket 54*a* is then attached to the wall section 52 of the lower wall 42 of the lighting fixture 22 by the fasteners 60 that extend through the flange(s) 72 and into the wall section 52.

The universal mounting system 20*a* can be easily removed from the pole 24 by reversing the order of assembly. The universal mounting system 20*a* can be easily removed from the lighting fixture 22 by removal of the fasteners 60 from the wall section 52 of the pan 32. The universal mounting system 20*a* can then be used on another pole by reusing existing holes or drilling new holes through the pole.

Figure 6:
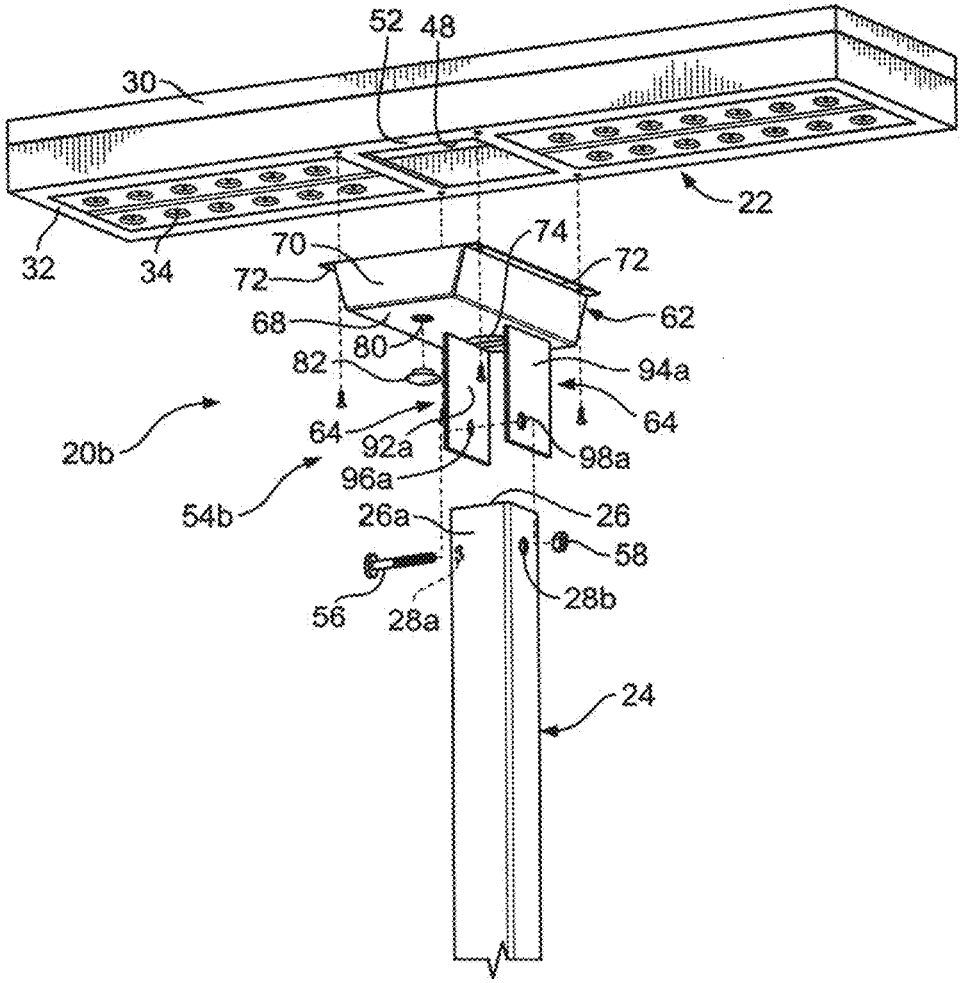
FIG. 6 is an exploded perspective view of a pole, a lighting fixture and a bracket which incorporates the features of a yet another embodiment of the disclosure.

FIG. 6 shows a third embodiment of the bracket 54*b*. In this embodiment, the u housing 62 is identically formed to the housing 62 of the first embodiment and the specifics are not repeated.

In this embodiment, the fastener mount 64 may be formed integrally with the housing 62, or formed separately and then fixedly attached to the housing 62. In this embodiment, like that of the second embodiment, the fastener mount 64 is formed of a pair of spaced apart walls 92*a*, 94*a* which extend downwardly from the base wall 68. Each wall 92*a*, 94*a* has an opening 96*a*, 98*a* proximate to an end thereof, such that the openings 96*a*, 98*a* are spaced from the lower surface of the base wall 68 by a predetermined distance. The passageway(s) 74 are provided between the walls 92*a*, 94*a*. In this embodiment, the walls 92*a*, 94*a* are spaced further apart from each other than in the second embodiment.

In use, the lower surface of the base wall 68 seats on the upper end 26 of the pole 24 as previously described and the walls 92*a*, 94*a* abut against the exterior surfaces of the pole 24. The passageway(s) 74 align with the passageway 25 through the pole 24. The openings 96*a*, 98*a* in the walls 92*a*, 94*a* align with the holes 28*a*, 28*b* in the pole 24. The mounting fastener 54 is inserted through the opening 96*a* in wall 92*a*, through both holes 28*a*, 28*b* in the pole 24, and through the opening 98*a* in the other wall 94*a*. The nut 58 is attached to the end of the mounting fastener 54 that extends outwardly from the wall 94*a*. This secures the bracket 54*b* to the pole 24. The bracket 54*b* is then attached to the wall section 52 of the lower wall 42 of the lighting fixture 22 by the fasteners 60 that extend through the flange(s) 72 and into the wall section 52. In this embodiment, the holes 28*a*, 28*b* in the pole 24 can be predrilled such that the openings 96*a*, 98*a* align with the predrilled holes 28*a*, 28*b*, or the holes 28*a*, 28*b* can be drilled after the bracket 54*b* is seated on the upper end 26 of the pole 24.

The universal mounting system 20*b* can be easily removed from the pole 24 by reversing the order of assembly. The universal mounting system 20*b* can be easily removed from the lighting fixture 22 by removal of the fasteners 60 from the wall section 52 of the pan 32. The universal mounting system 20*b* can then be used on another pole by reusing existing holes or drilling new holes through the pole.

FIG. 7 shows a fourth embodiment of the bracket 54*c*. In this embodiment, the housing 62 is identically formed to the housing 62 of the first embodiment and the specifics are not repeated.

In this embodiment, the fastener mount 64 may be formed integrally with the housing 62, or formed separately and then fixedly attached to the housing 62.

In this embodiment, the fastener mount 64 is formed of a wall 100 which extends downwardly from the base wall 68 and surrounds the passageway(s) 74. The wall 68 may be circular as shown, or may be rectangular, square, etc. The wall 100 has a pair of openings 102, 104 proximate to an end thereof, such that the openings 102, 104 are spaced from the lower surface of the base wall 68 by a predetermined distance.

In use, the lower surface of the base wall 68 seats on the upper end 26 of the pole 24 as previously described and the wall 100 extends into the passageway 25 of the pole 24 such that the passageway(s) 74 align with the passageway 25 through the pole 24. The openings 102, 104 in the wall 100 align with the holes 28*a*, 28*b* in the pole 24. The mounting fastener 54 is inserted through one hole 28*a* in the pole 24, through the openings 102, 104 in the wall 100, and through the other hole 28*b* in the pole 24. The nut 58 is attached to the end of the mounting fastener 56 that extends outwardly from the pole 24. This secures the bracket 54*c* to the pole 24. The bracket 54*c* is then attached to the wall section 52 of the lower wall 42 of the lighting fixture 22 by the fasteners 60 that extend through the flange(s) 72 and into the wall section 52.

The universal mounting system 20*c* can be easily removed from the pole 24 by reversing the order of assembly. The universal mounting system 20*c* can be easily removed from the lighting fixture 22 by removal of the fasteners 60 from the wall section 52 of the pan 32. The universal mounting system 20*c* can then be used on another pole by reusing existing holes or drilling new holes through the pole.

As show, the fastener mount 64 can take a variety of shapes and forms and is not limited to the specific shapes shown herein. In addition, the fastener mount 64 may be formed of a single wall with a single aperture.

The universal mounting system 20, 20*a*, 20*b*, 20*c* can be used to mount a lighting fixture 22 to any pole 24 (which may be a pre-existing pole and the universal mounting system 20, 20*a*, 20*b*, 20*c* is used in a retrofit, or may be a new pole) by reusing existing holes or drilling new holes 28*a*, 28*b* into the upper end 26 of the pole 24. The universal mounting system 20, 20*a*, 20*b*, 20*c* supports any type of lighting fixture 22 that has a surface to which the housing 62 can be attached. This eliminates the need for a variety of brackets as was done in the prior art.

A reinforcing channel (not shown) may be provided in the interior or exterior of the base wall 68. The reinforcing channel is an elongated piece of metal having holes that match those of the base wall 68. The reinforcing channel may be formed from steel, aluminum, plastic, or any other material that adds structural strength and rigidity to the universal mounting system 20, 20*a*, 20*b*, 20*c*. Alternatively, the base wall 68 may have a thickened area to provide strength and rigidity to the universal mounting system 20, 20*a*, 20*b*, 20.

The universal mounting system 20, 20*a*, 20*b*, 20*c* and/or the other metal structures of lighting fixture 22 may be powder coated or otherwise treated for durability of the metal. The universal mounting system 20, 20*a*, 20*b*, 20*c* is extremely robust and able to withstand environmental abuses of outdoor lighting fixtures 22. The shape of the components of the universal mounting system 20, 20*a*, 20*b*, 20*c* are preferably such that the effective projected area (EPA) relative to strong wind loading is minimized, which correspondingly provides for universal application in all geographic regions, minimized wind loading parameters of the lighting fixture 22.

While the mounting of the pole 26 on the universal mounting system 20, 20*a*, 20*b*, 20*c* is shown as offset to one side of the bracket 54, 54*a*, 54*b*, 54*c*, the mounting of the pole 26 on the universal mounting system 20, 20*a*, 20*b*, 20*c* can be centered on the bracket 54, 54*a*, 54*b*, 54*c*. This centering of the bracket 54, 54*a*, 54*b*, 54*c* on the pole 26 aids in weight distribution due to snow loading, and may aid in wind loading on the lighting fixture 22.

Figure 8:
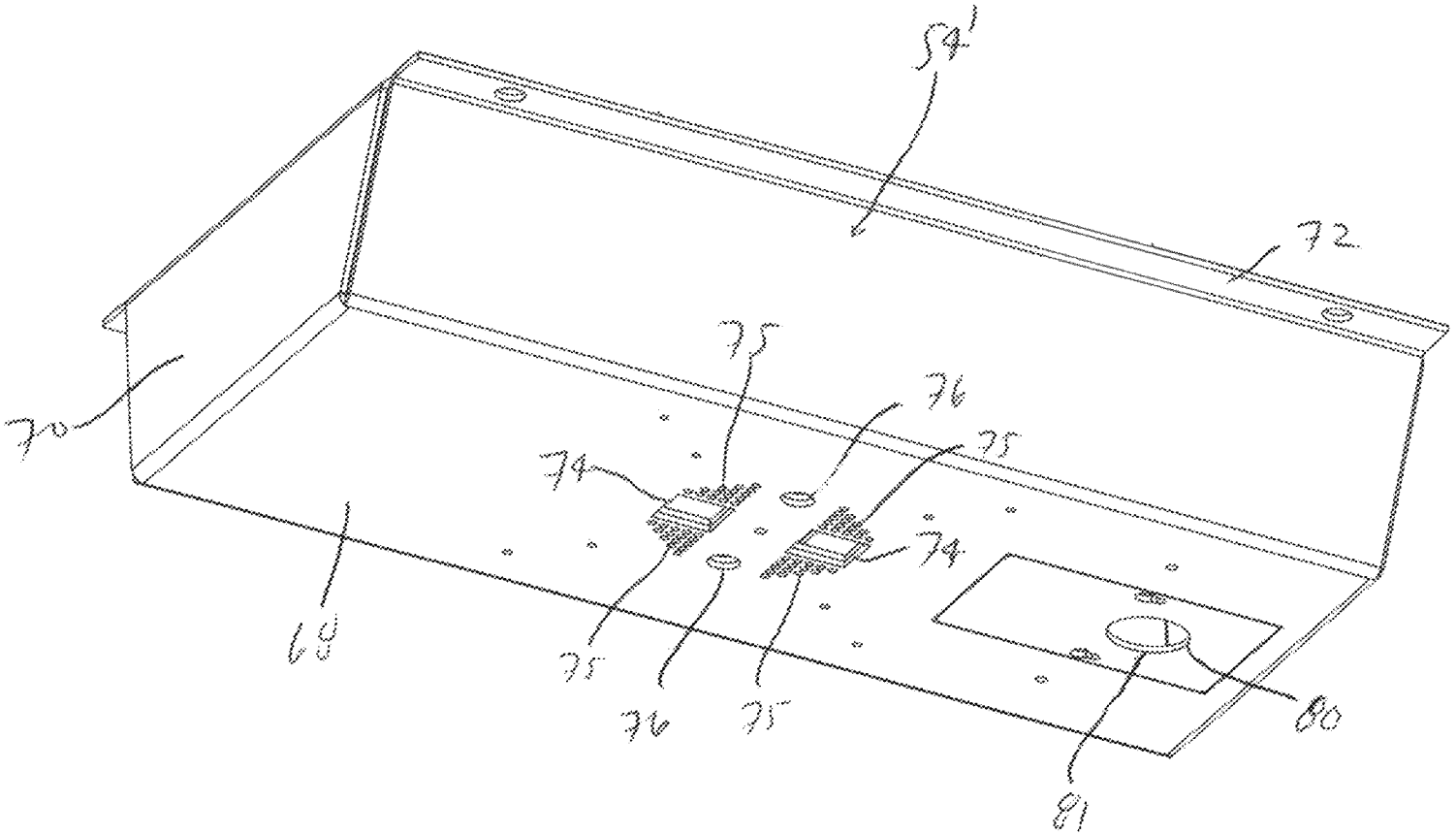
FIG. 8 is a bottom perspective view of the bracket according to an embodiment.
Figure 9:
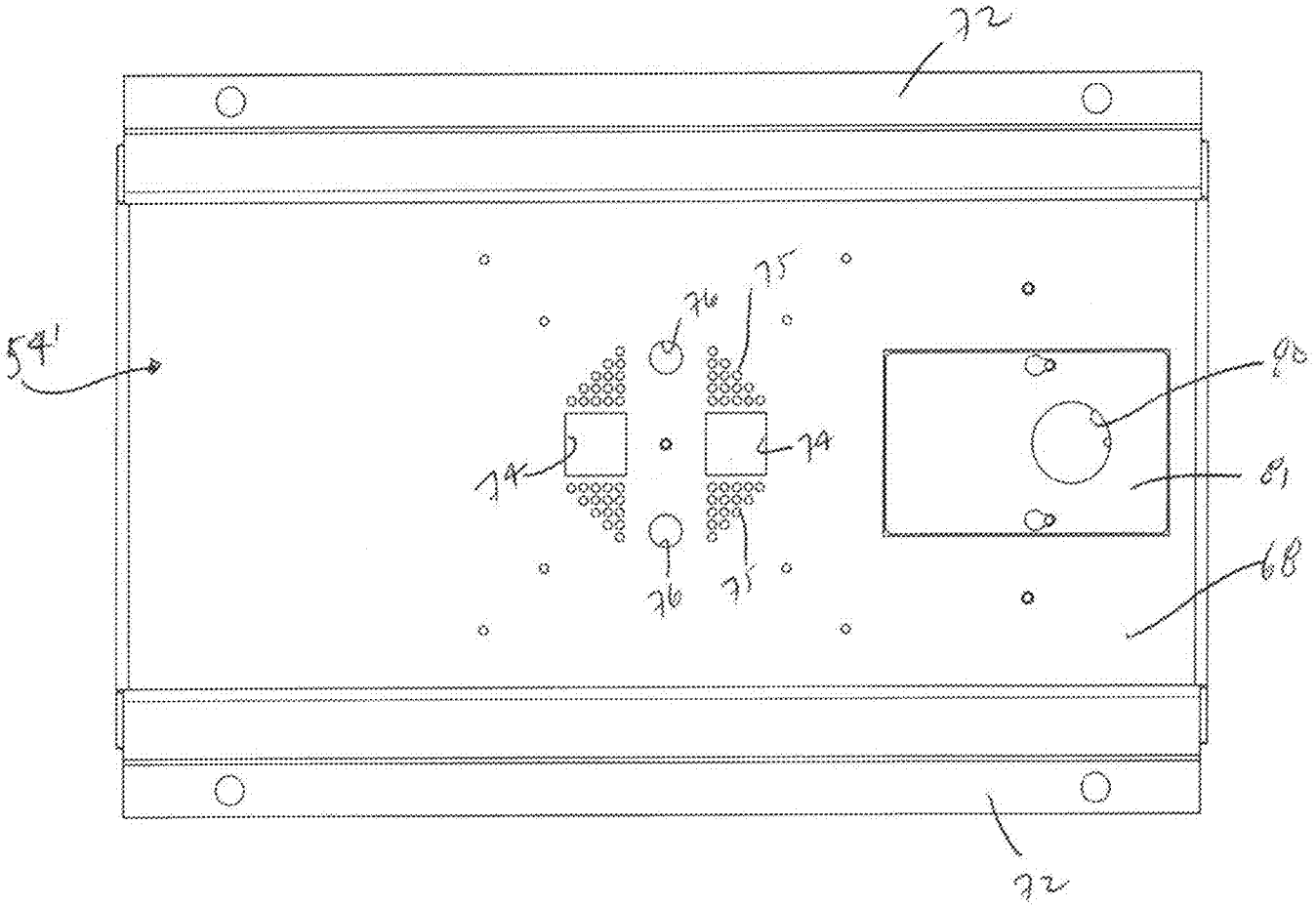
FIG. 9 is a bottom plan view of the bracket shown in FIG. 8.
Figure 10:
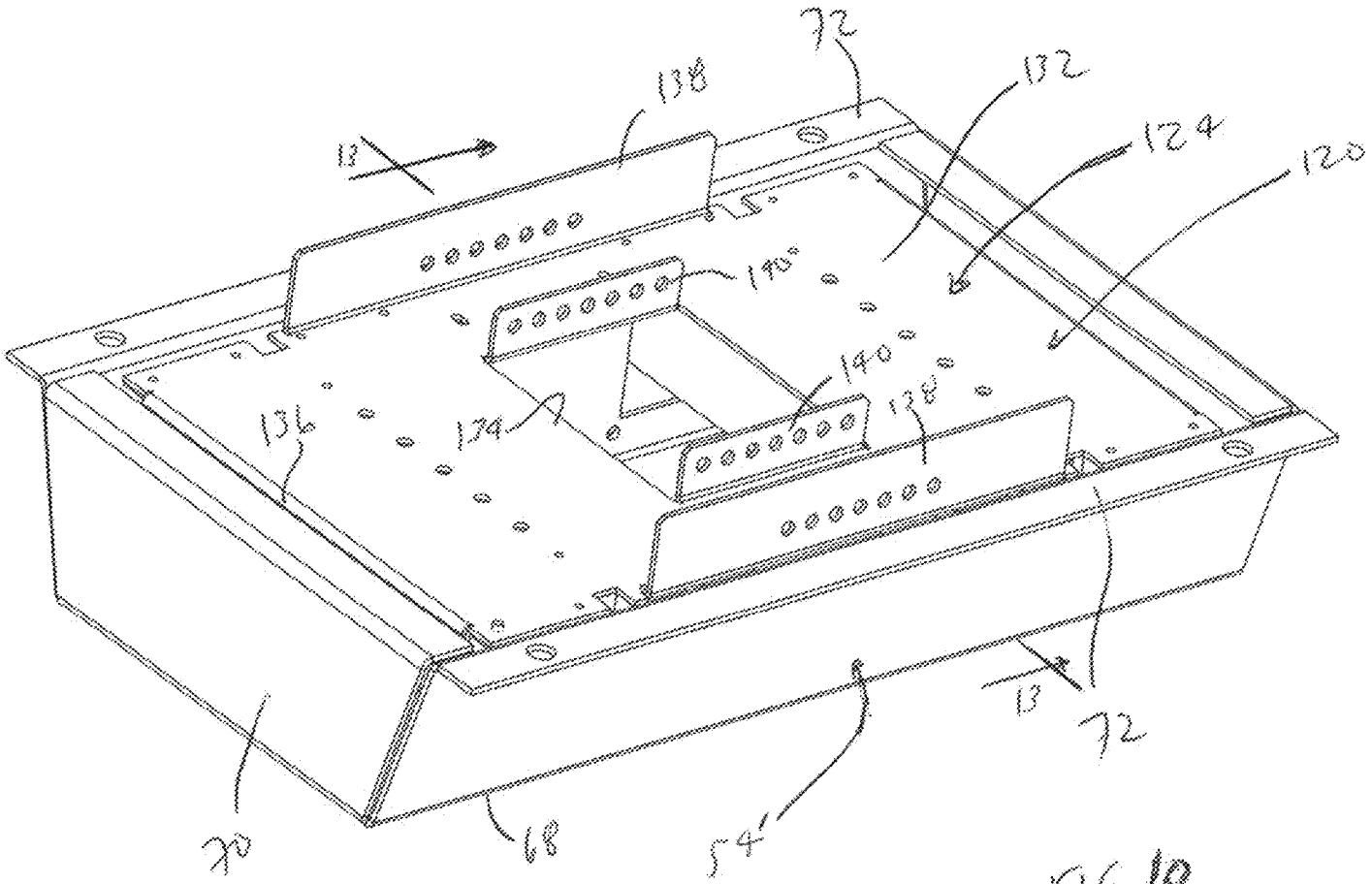
FIG. 10 is a top perspective view of the lighting fixture showing a driver housing assembly, drivers and a pan of the lighting fixture, which incorporates features of the disclosure.
Figure 11:
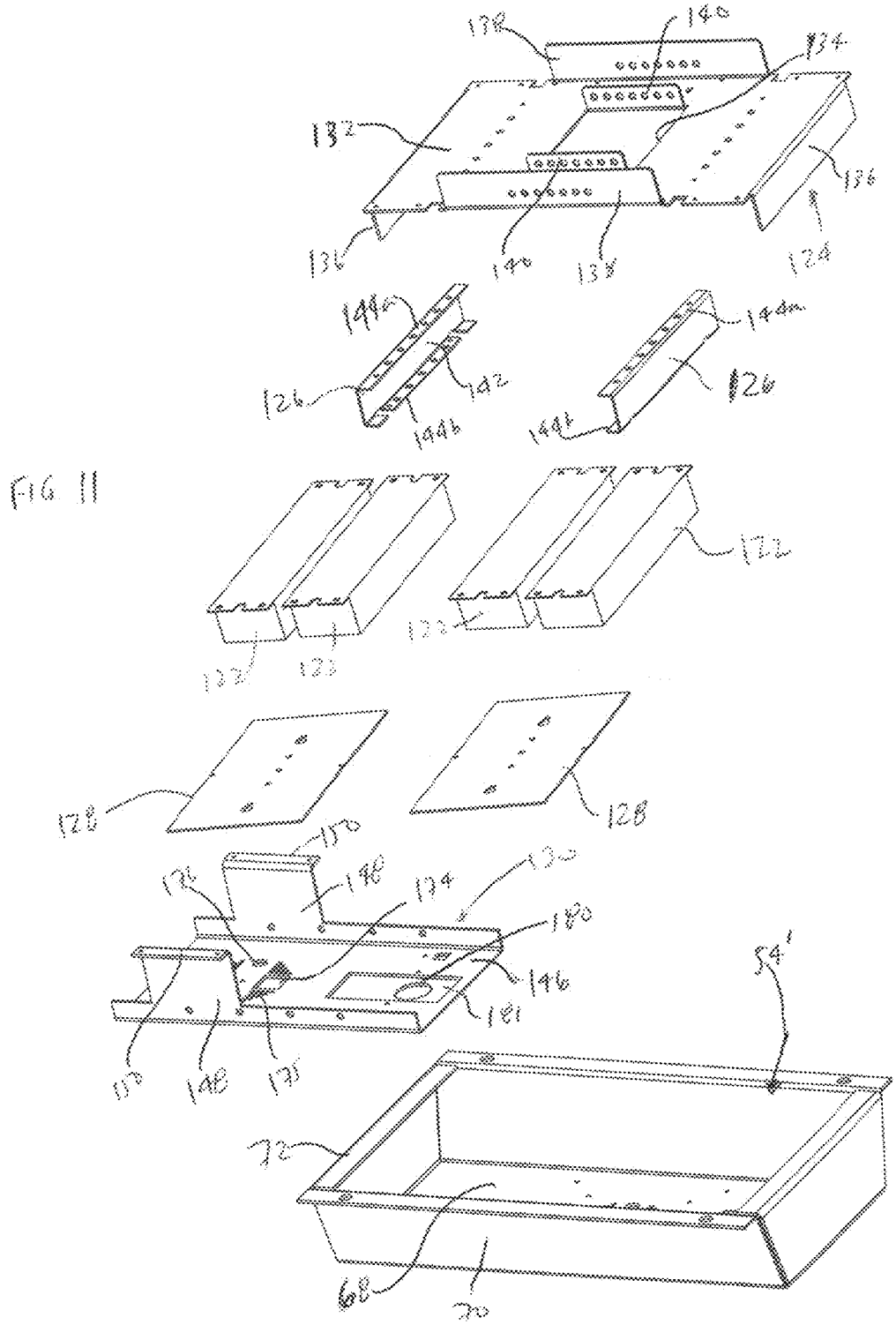
FIG. 11 is an exploded perspective view of the components of FIG. 10.
Figure 12:
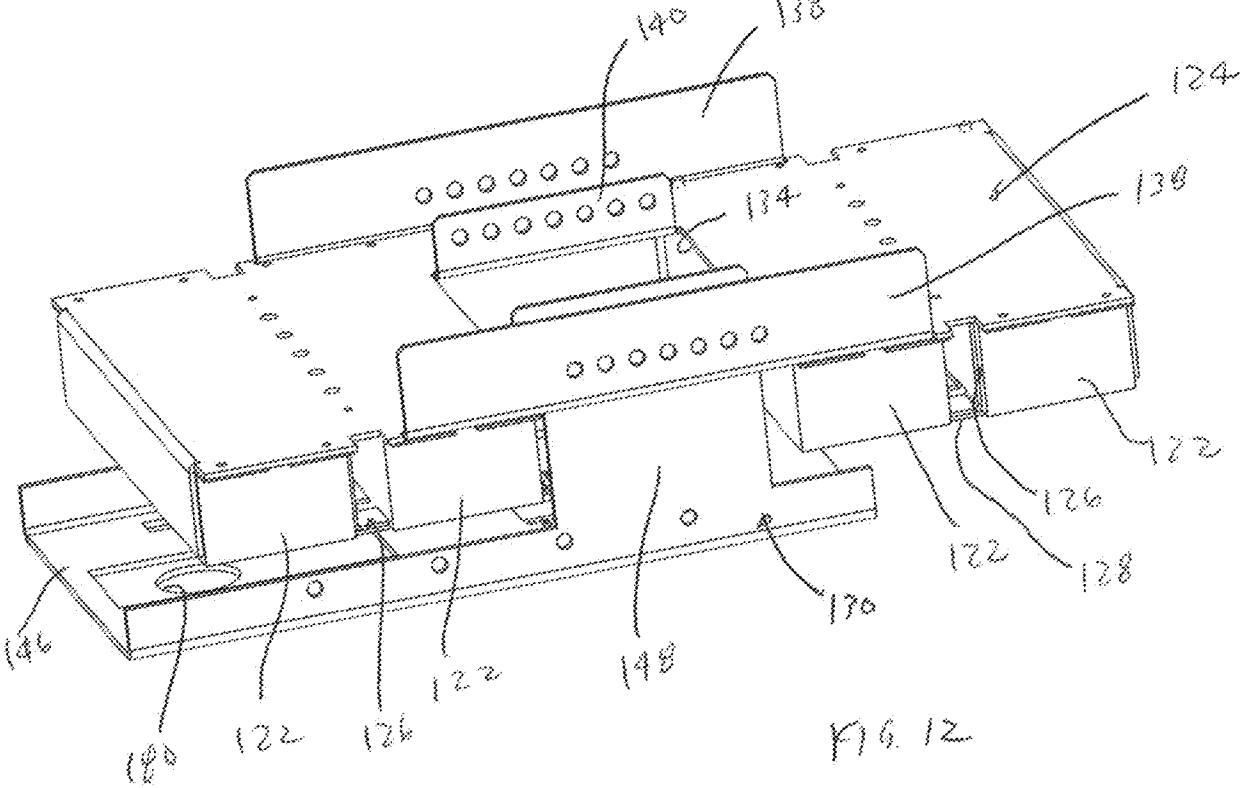
FIG. 12 is a perspective view of the driver housing assembly and drivers.

FIGS. 8 and 9 show an embodiment of the mounting bracket 54' which is similar to the universal mounting bracket 54 shown in FIGS. 2-4. Like elements are denoted with like reference numerals. In this embodiment, a plurality of spaced apart vias 75 are provided proximate to each passageway 74. The vias 75 are formed in an array. Each via 75 has a small diameter and may range in size from 0.040" to 0.187". The vias 75 allow for the passage of air from the pole 24 through the base wall 68 of the bracket 54' and into the cavity of the lighting fixture 22. It is to be understood that the vias 75 can be provided through the base wall 68 of any of the brackets 54, 54*a*, 54*b*, 54*c*.

FIGS. 10-14 show a driver housing assembly 120 which is used to mount drivers 122 in the bracket 54' (or bracket 54, 54*a*, 54*b*, 54*c*), and to thermally separate the drivers 122 from the lighting sources 34 mounted in the pan 32. The drivers 122 include the electronics for activating/deactivating the lighting sources 34. Such drivers 122 are known in the art. The driver housing assembly 120 thermally separates the drivers 122 from the lighting sources 34 in order to provide improved thermal management of the heat generating components, that is the driver 122 and the lighting sources 34, of the lighting fixture 22. The driver housing assembly 120 includes a driver plate 124, a plurality of brackets 126, a plurality of heat sinks 128, and a driver mount 130. The driver plate 124 and the driver mount 130 suspend the heat sinks 128 and drivers 122 within the bracket 54' to form a space 182 between the heat sinks 128/drivers 122 and the bracket 54' as further described herein.

The driver plate 124 is formed of a base plate 132 having an aperture 134 therethrough, a pair of flanges 136 extending downwardly from opposite edges of the base plate 132, a pair of flanges 138 extending upwardly from the base plate 132 along opposite edges of the base plate 132, and a pair of flanges 142 extending upwardly from the base plate 132 along sides of the aperture 134. The flanges 138, 140 are parallel to each other.

As shown, each bracket 126 is generally U-shaped with a base wall 142 and a pair of flanges 144 which extends from upper and lower edges of the base wall 142. The bracket 142 may be a rectangle having a central passageway or may be solid. The upper flange 144*a* of each bracket 126 attaches to an underside of the base plate 132 of the driver plate 124. The brackets 126 are spaced from the aperture 134 of the driver plate 124 such that the brackets 126 do not overlap the aperture 134. As shown, two brackets 126 are provided.

The drivers 122 are attached to the underside of the base plate 132 of the driver plate 124. As shown, four drivers 122 are provided, with a bracket 126 seating between each pair of drivers 122. The brackets 126 separate the drivers 122 in each pair from each other.

A heat sink 128 seats against a lower end of each pair of drivers 122 is attached to the lower flange 144*b* of the bracket 126. The heat sink 128 is contact with the drivers 122 to draw heat from the drivers 122 during operation of the lighting fixture 22. The heat sink 128 may be formed of metal. As shown, each heat sink 128 is formed as a flat plate. The heat sink 128 may take over forms.

The driver mount 130 is formed of a base plate 146, a pair of flanges 148 extending upwardly from the base plate 146 along opposite edges of the base plate 146, and a rim 150 extending outwardly from the upper end of each flange 148. The rims 150 are attached to the underside of the base plate 132 of the driver plate 124 on opposite sides of the aperture 134. The base plate 146 abuts against the upper surface of the lower wall 689 of the pan 32. The base plate 146 has passageway(s) 174, spaced apart vias 175 and aperture(s) 176 that align with the passageway(s) 74, vias 75 and aperture(s) 76 in the base plate 68 of the pan 32. The vias 175 are formed in an array. Each via 175 has a small diameter and may range in size from 0.040" to 0.187" to correspond in size with the vias 75 in the pan 32. Wires can be fed from the pole 24 through the passageways 74, 174 to connect to the lighting sources 34 and other electronics in the lighting fixture 22. The arrays of vias 75, 175 allow air to flow from the pole 24 into the bracket 54'. The aperture 134 in the driver plate 124 allows the air to flow out of the bracket 54' and into the internal cavity of lighting fixture 22 and then out of the vias 41. The base plate 146 also has a hole 180 which aligns with hole 80 in the pan 32. The hole 180 may be the same size as the door 81 or be provided in a door 181 which can be opened or closed to allow access to components within the bracket 54'. The camera or sensor 82 extends through holes 80, 180.

Figure 13:
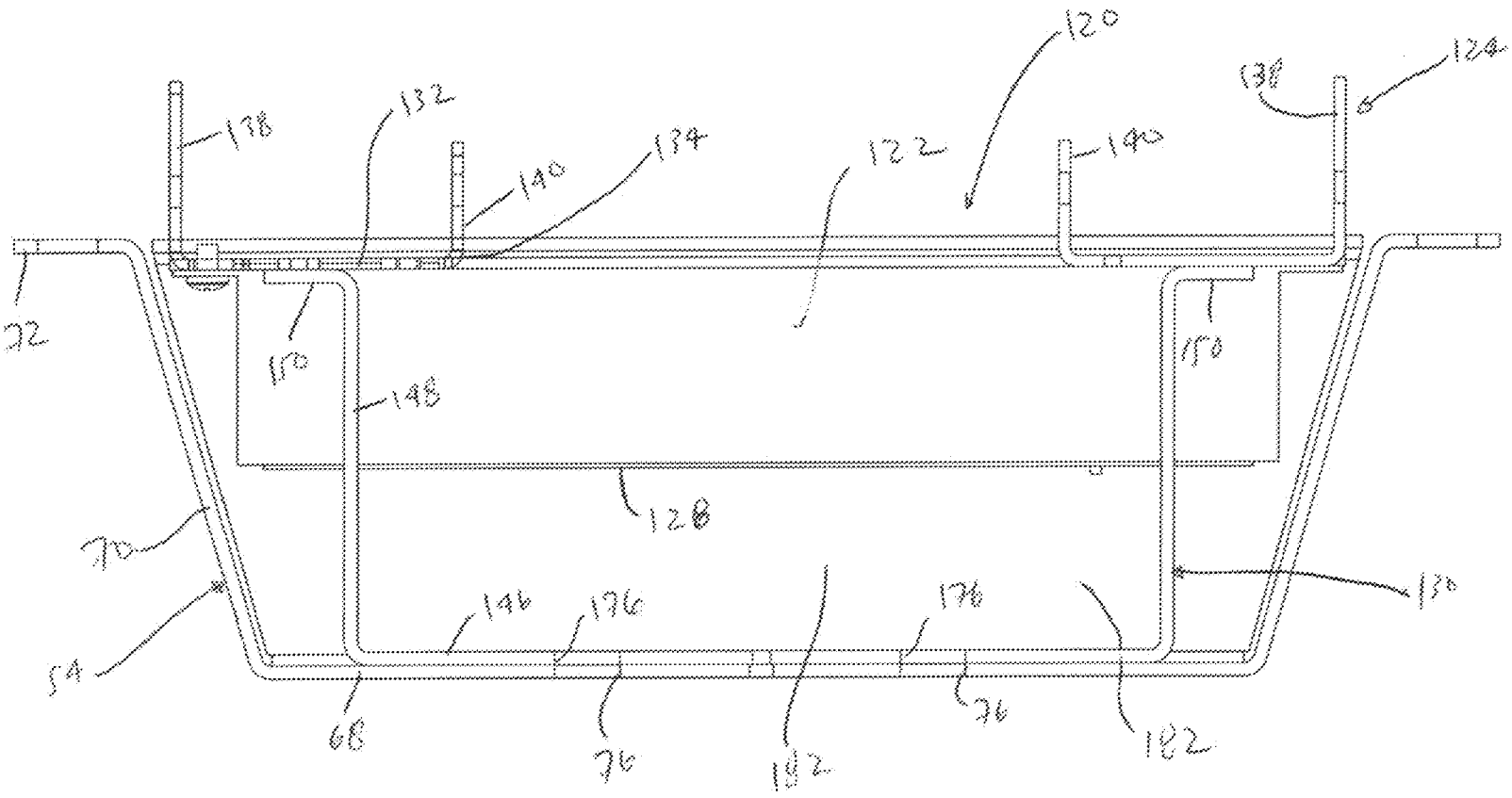
FIG. 13 is a cross-sectional view along line 13-13 of FIG. 10.
Figure 14:
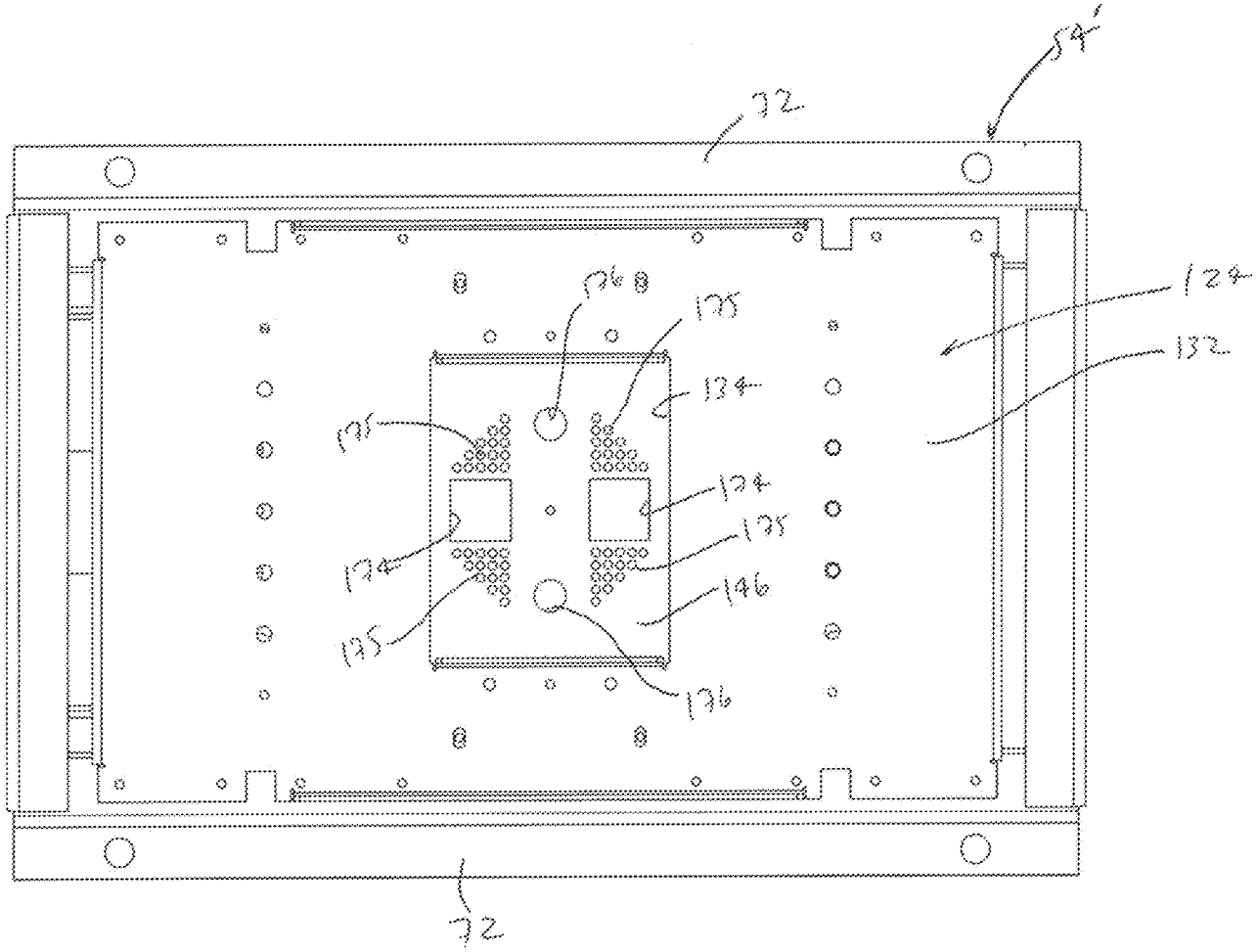
FIG. 14 is a top plan view of the lighting fixture shown in FIG. 10.
Figure 15:
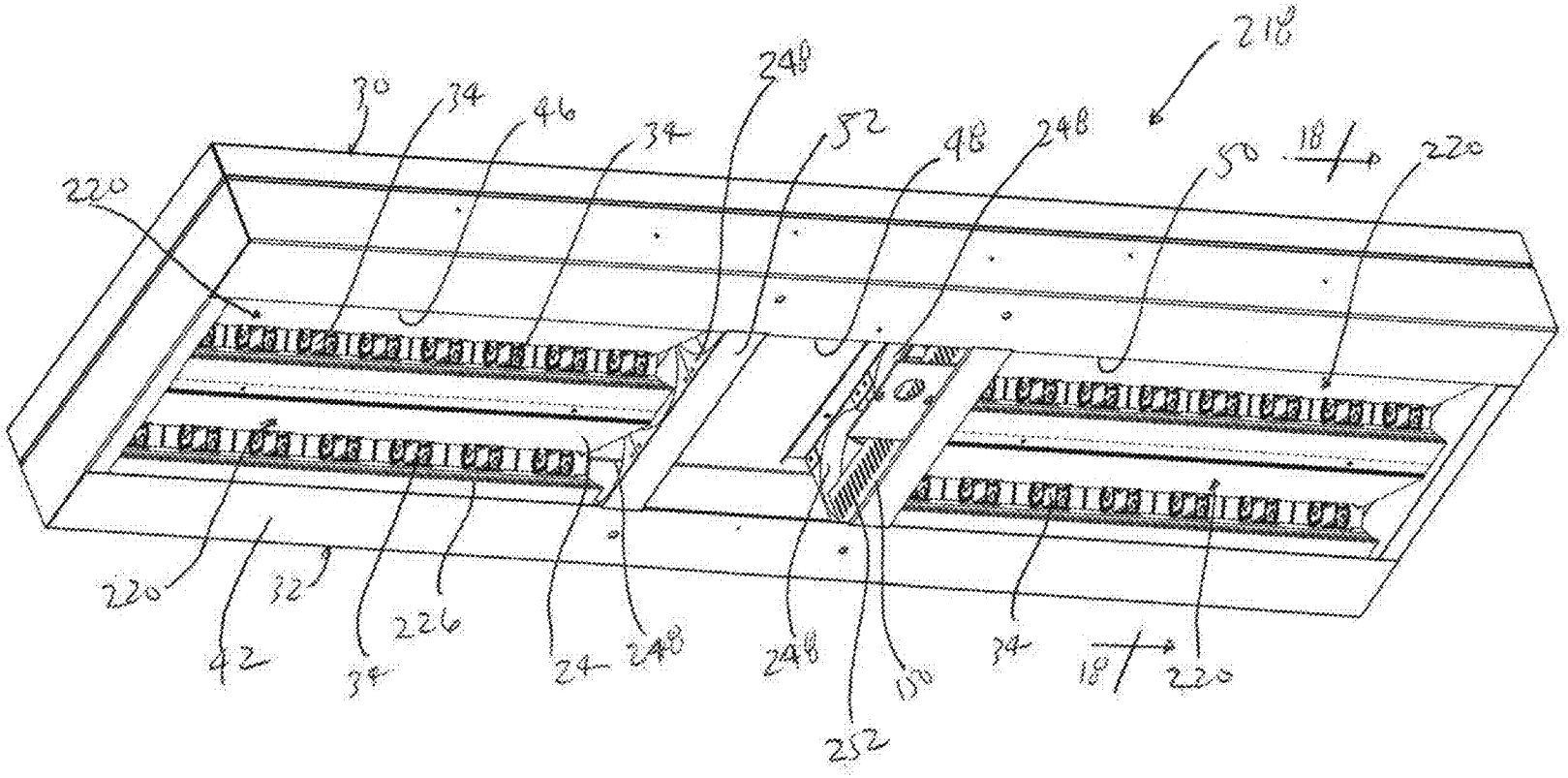
FIG. 15 is a bottom plan view of a lighting fixture which incorporates features of the present disclosure.
Figure 16:
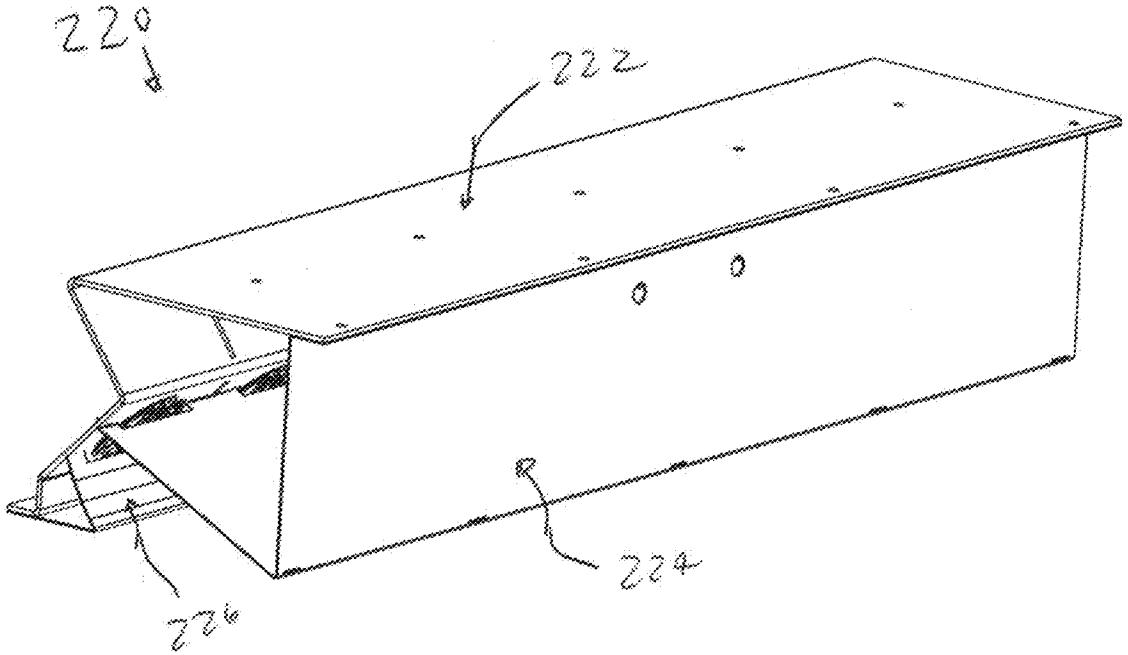
FIG. 16 is a perspective view of a light assembly which may be incorporated into the lighting fixture.
Figure 17:
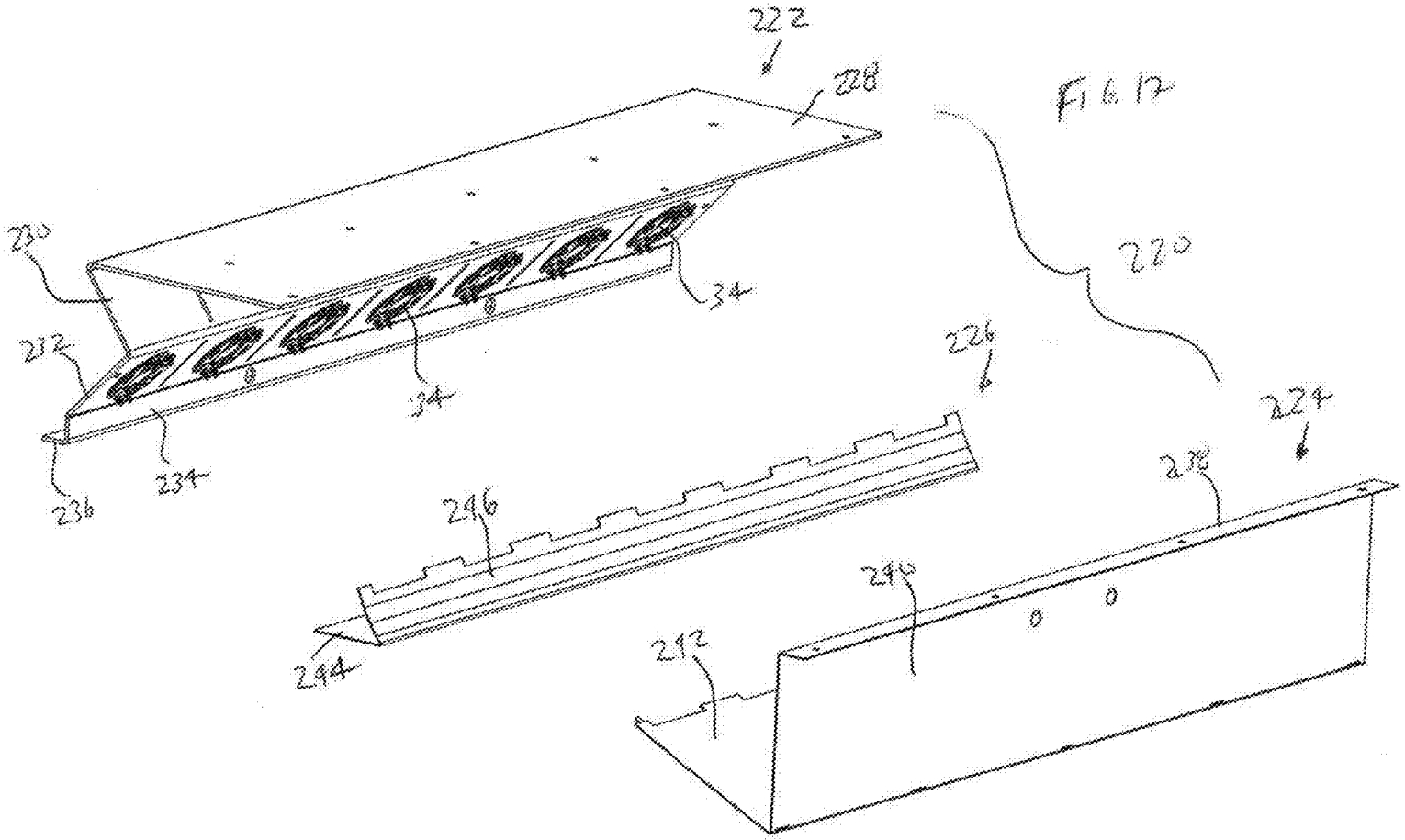
FIG. 17 is an exploded perspective view of the light assembly of FIG. 16.
Figure 18:
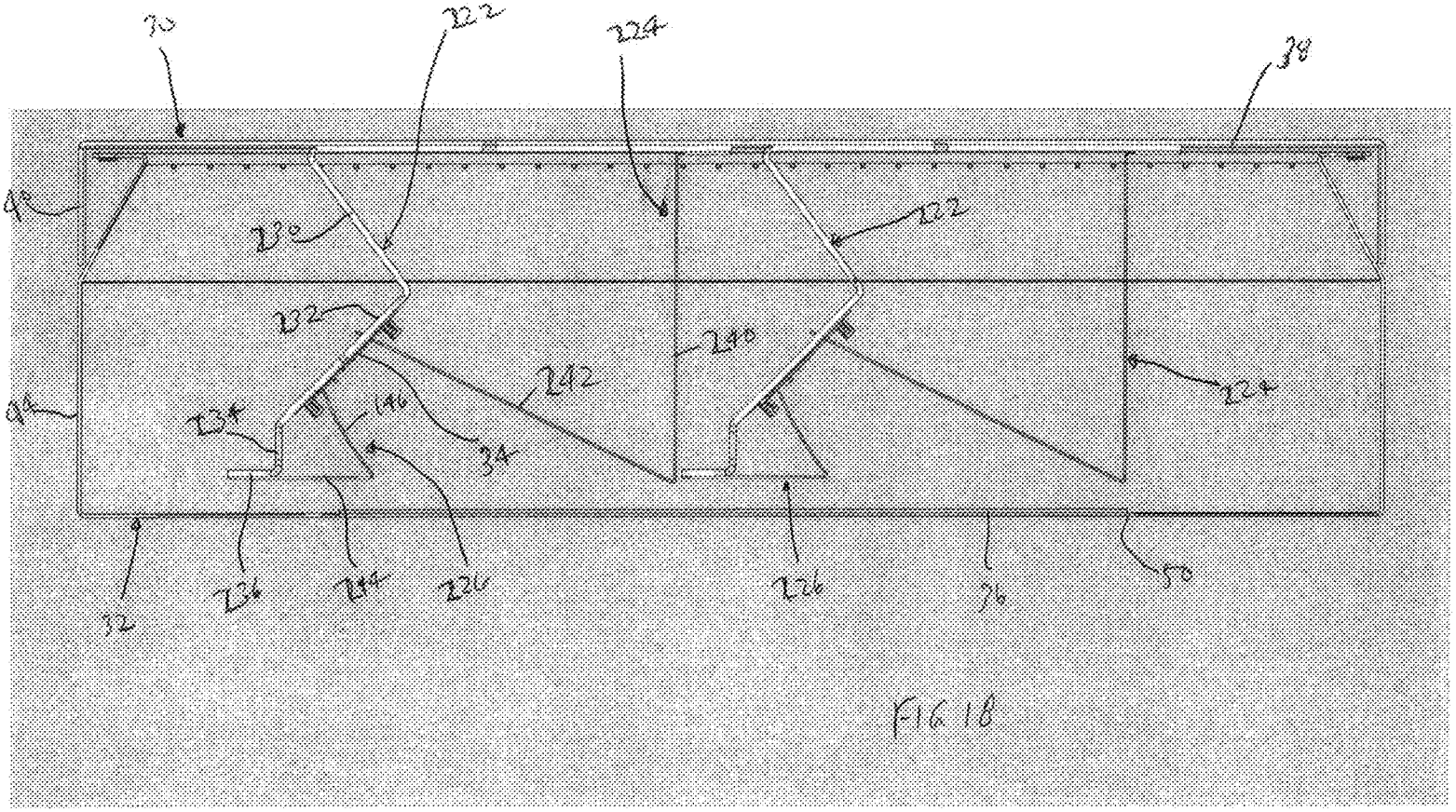
FIG. 18 is a cross-sectional view along line 18-18 of FIG. 15.

As shown in FIG. 13, a space 182 is formed between the heat sinks 128 and the bracket 54' as a result of the driver housing assembly 120 to aid in the dissipation of heat from the heat sinks 128. The drivers 122 are electrically coupled to the lighting sources 34, but are physically separated from the drivers 122.

The driver plate 124, brackets 126, heat sinks 128, and driver mount 130 may be formed of a cured synthetic polymerization composite which includes at least one polymerized resin and at least one additive which is disclosed in U.S. application Ser. No. 14/854,906, filed on Sep. 15, 2015, the disclosure of which is incorporated by reference in its entirety. Alternatively, the components may be formed of a suitable metal, such as steel or aluminum.

The flanges 138 seat within the aperture 48 and the flange(s) 72 are attached to the wall section 52. As such, air can flow through vias 175, through vias 75, through aperture 134 and into the pan 32.

Attention is now invited to FIGS. 15-20 which show an embodiment of a lighting fixture 218. It to be understood that the lighting fixture 218 can be used with any of the universal mounting system 20, 20*a*, 20*b*, 20*c* to mount the lighting fixture 218 to a pole.

The lighting fixture 22 includes the cover 30 and the pan 32 that mates together to form the internal cavity therewithin. The specifics of the cover 30 and the pan 32 are not repeated herein.

As shown, a pair of light assemblies 220 are mounted within each of the apertures 46, 50 and in the housing formed by the cover 30 and the pan 32. Each light assembly 220 includes heat sink 222 attached to the upper wall 38 of the cover 30, an upper reflector 224 attached to the heat sink 222 and spans the length of the heat sink 222, a lower reflector 226 attached to the heat sink 222 and spans the length of the heat sink 222, and a plurality of lighting sources 34, such as LED lights, mounted on the heat sink 222 such that the light from the lighting sources 34 shines between the reflectors 222, 226. As shown, a pair of light assemblies 220 are mounted in each aperture 46, 50, but a single light assembly 220 or more than two light assemblies 220 can be mounted in each aperture 46, 50.

Figures 19, 20, 21:
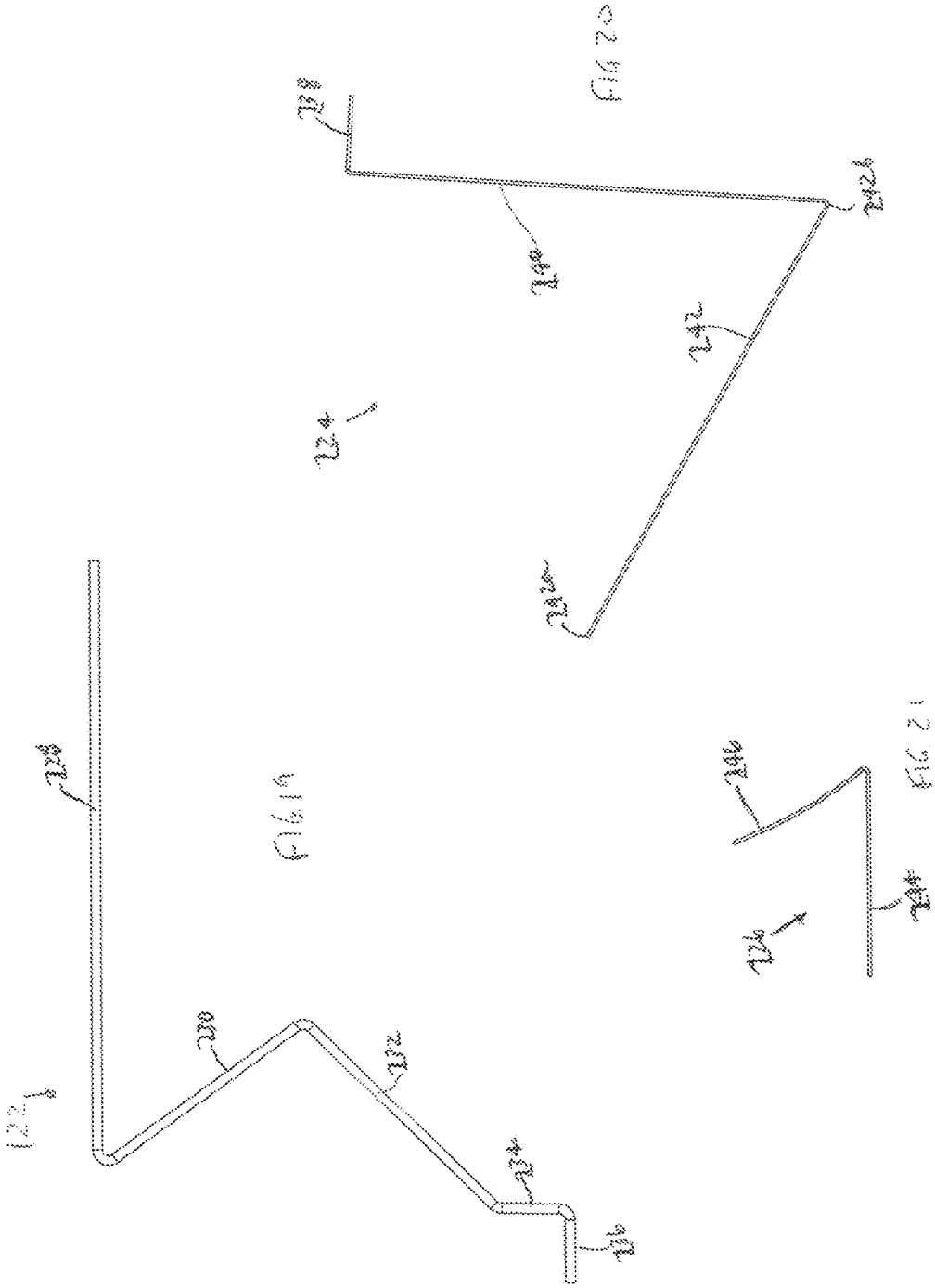
FIGS. 19-21 are end plan views of some of the components of the light assembly of FIG. 16.
Figure 72:
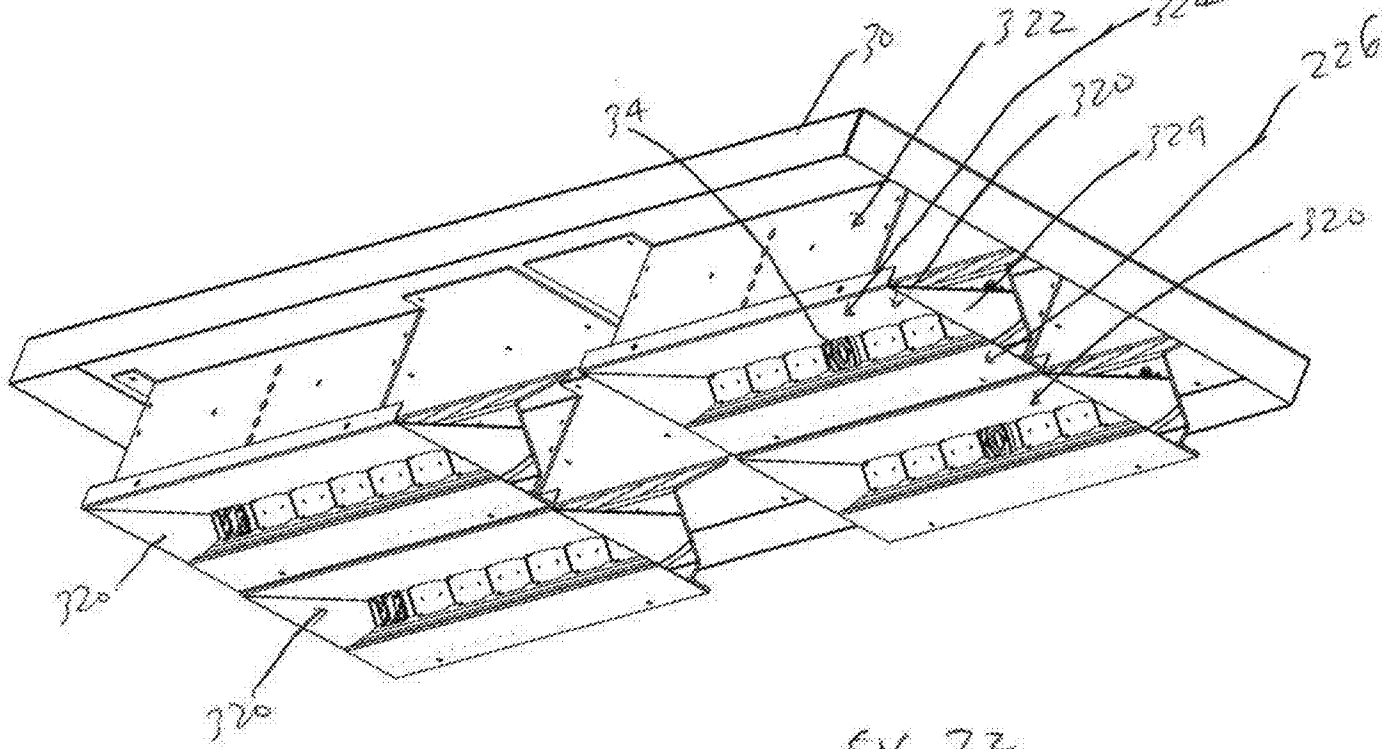
FIG. 72 is a front elevation view of the lighting fixture shown in FIG. 68.
Figure 24:
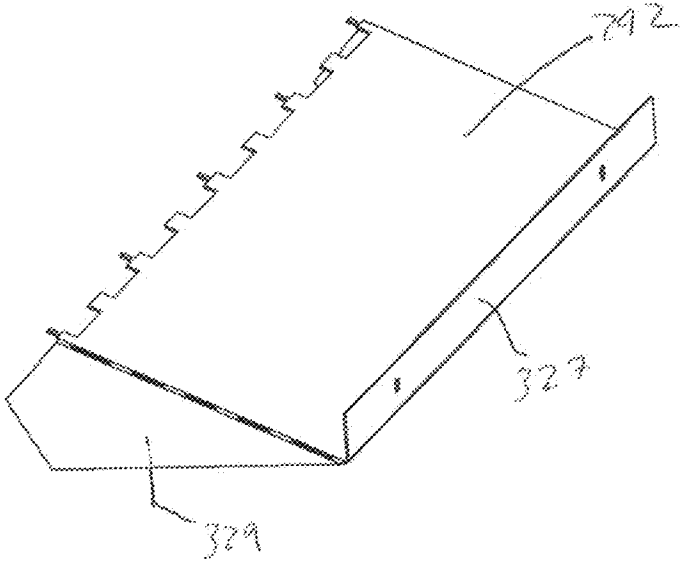
FIG. 24 is a perspective view of an upper reflector of the light assembly of FIG. 22.
Figure 23:
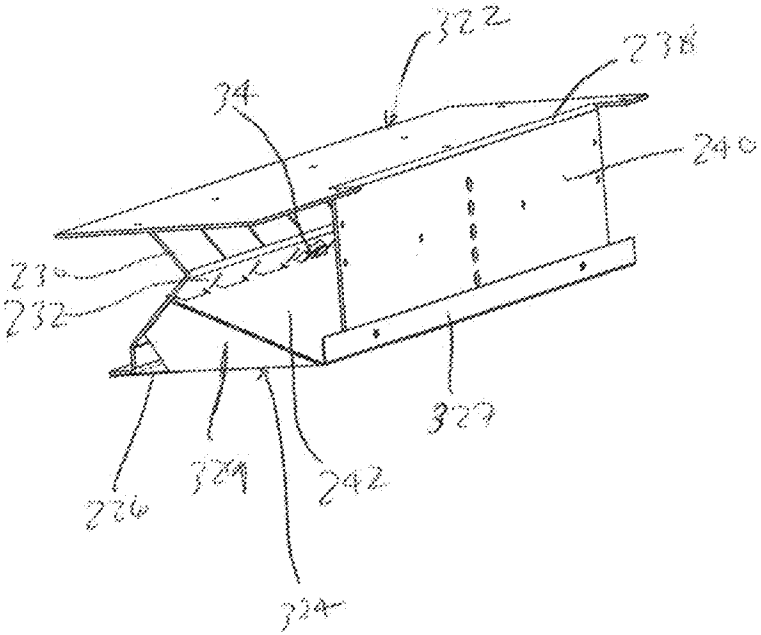
FIG. 23 is an exploded perspective view of the light assembly of FIG. 22.
Figure 25:
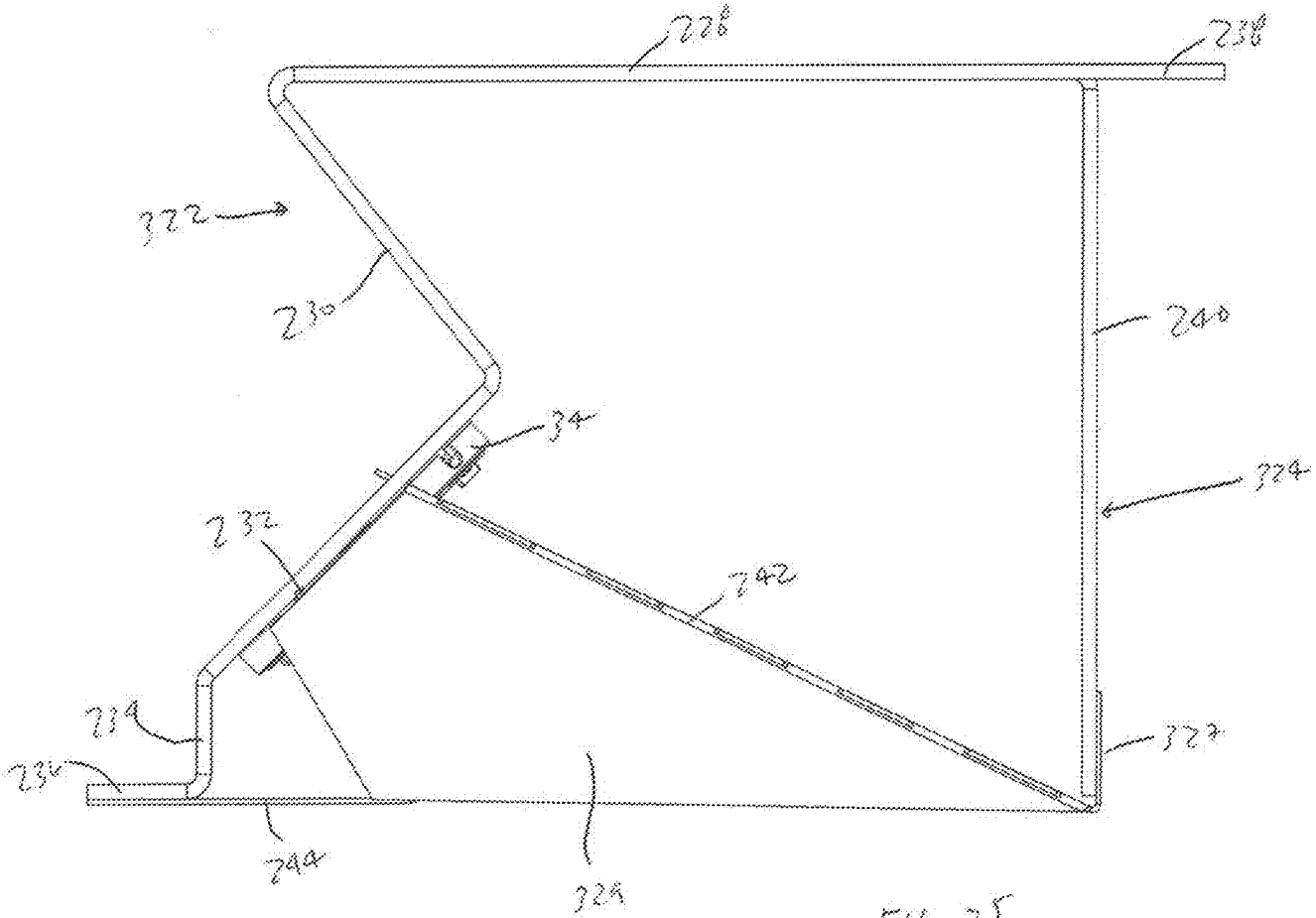
FIG. 25 is a cross-sectional view of the light assembly of FIG. 22.
Figure 26:
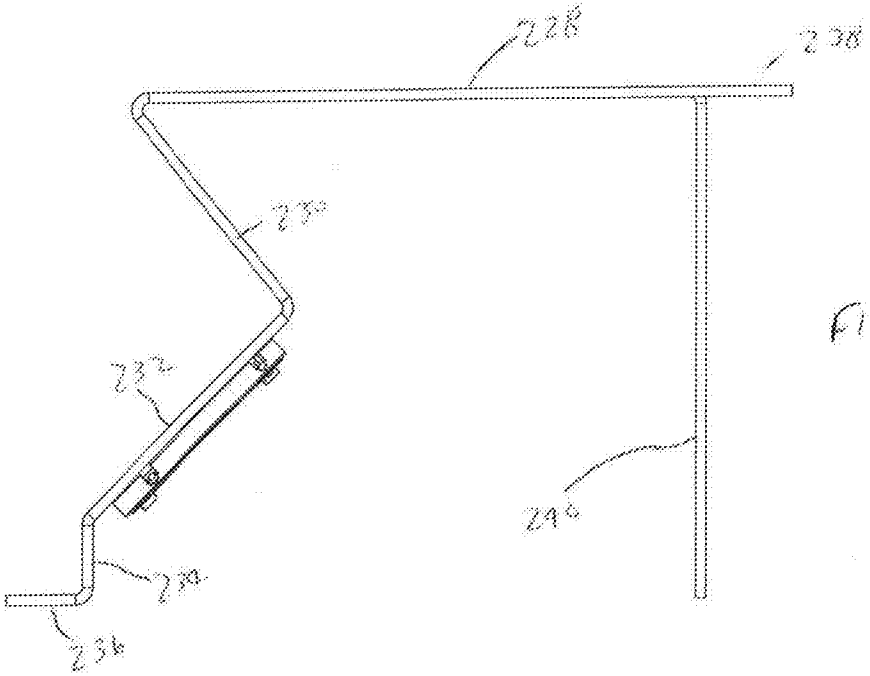
FIGS. 26 and 27 are end plan views of some of the components of the light assembly of FIG. 22.
Figure 27:
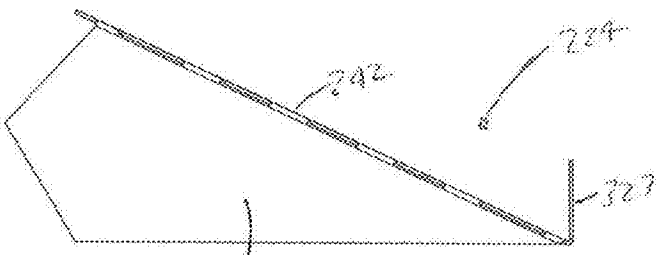
Figure 78:
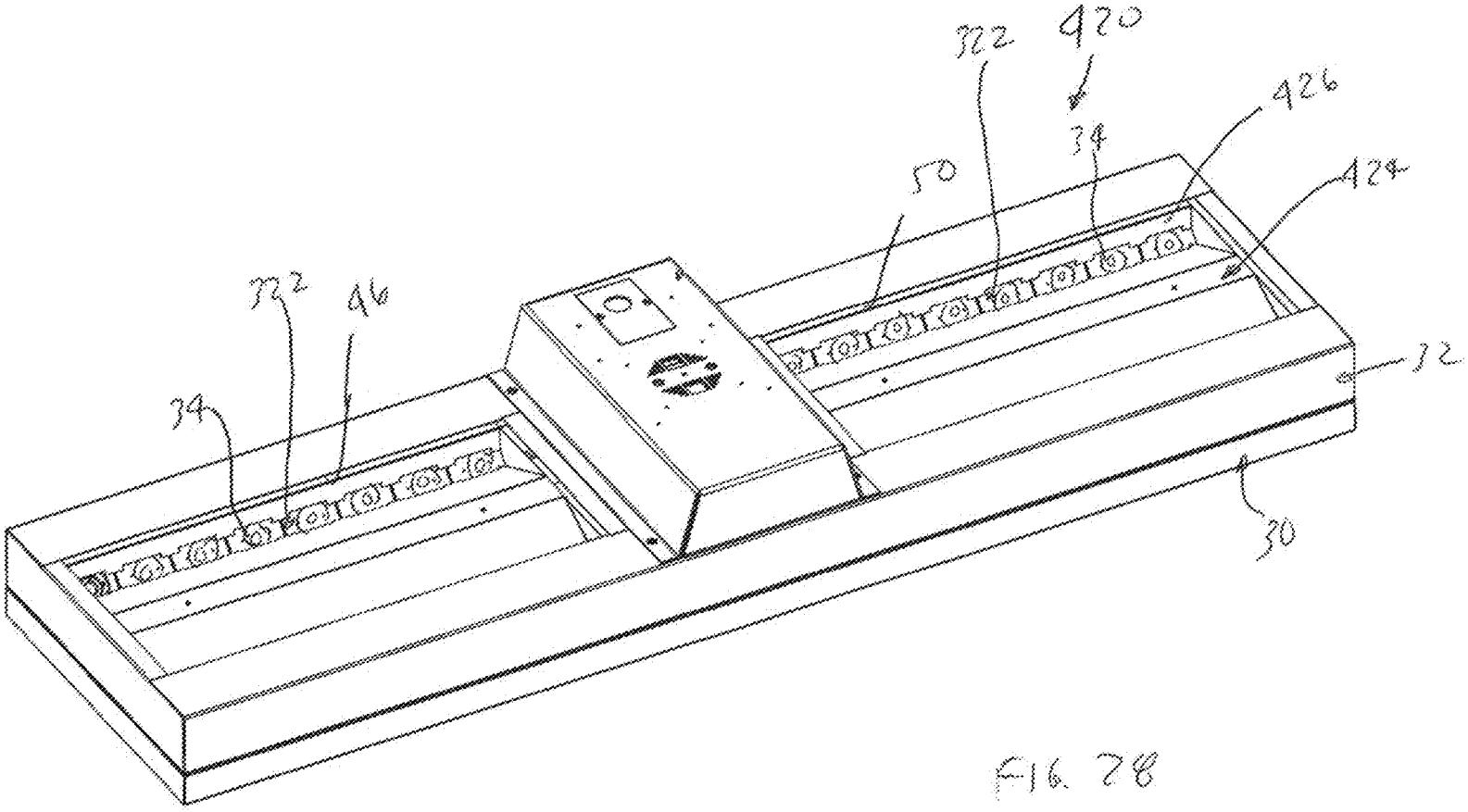
FIG. 78 is a side elevation view of the lighting fixture shown in FIG. 76.

As best shown in FIG. 19, the heat sink 222 is formed of a channel formed by a first wall 228 which is horizontal, a second wall 230 extending from an end of the first wall 228 and at angle relative to the first wall 228, a third wall 232 extending from the lower end of the second wall 230 and at an angle relative to the second wall 230, a fourth wall 234 extending from the lower end of the third wall 232 and which is vertical, and a fifth wall 236 extending from the lower end of the fourth wall 234 and which is horizontal. The second and third walls 230, 232 form a V-shape. The lighting sources 34 are mounted on the third wall 232 such that the lights shine downwardly at an angle relative to the horizontal. The heat sink 222 spans the width of the aperture 46 and end portions of the fifth wall 236 are attached to the lower wall 42 of the pan 32 by suitable means. The first wall 228 is attached by suitable means to the lower surface of the upper wall 38 of the cover 30.

The upper reflector 224 is formed of a first wall 238 which is horizontal, a second wall 240 extending vertically downwardly from an end of the first wall 238, and a third wall 242 extending from the lower end of the second wall 240 and at an angle relative to the second wall 240. The third wall 242 extends upwardly such that the free end 242*a* of the third wall 242 is vertically closer to the first wall 238 than the end 242*b* which is connected to the second wall 240. The first wall 238 and the third wall 242 extend outwardly from the second wall 149 in opposite directions, but could extend in the same direction from the second wall 240. The first wall 238 is attached by suitable means to the lower surface of the upper wall 38 of the cover 30. The free end 242*a* of the third wall 242 abuts against, passes through, or is close proximity to the third wall 232 of the heat sink 222.

The lower reflector 226 is formed of a first wall 244 which is horizontal, and a second wall 246 extending from an end of the first wall 244 and at an angle relative to the first wall 244. The second wall 246 may be formed of a plurality of wall portions which are angled relative to each other. The first wall 244 is attached by suitable means to the lower surface of the fifth wall 236 of the heat sink 222. The free end 246*a* of the second wall 246 abuts against or is close proximity to the third wall 232 of the heat sink 222, but is spaced from the third wall 242 of the upper reflector 224.

The lighting sources 34 are mounted on the third wall 232 of the heat sink 222 such that the lighting sources 34 are between the walls 242, 246 of the reflectors 224, 226. As such, the reflectors 224, 226 direct the light from the lighting sources 34 in a determined direction.

In this embodiment, a plurality of fans 248 are mounted on the wall section 52 to cause air to flow within the cavity formed by the cover 30 and pan 32. A bar 250 having a plurality of slots 252 therethrough may be mounted on the wall section 52 proximate to the fans 248. The fans 248 blow air across the heat sinks 222 and the drivers 122 to aid in dissipating heat generated by the lighting sources 34 and the electronics in the drivers 122. The air travels upwardly through the pole, through the universal mounting system 20, 20*a*, 20*b*, 20*c*, through the slots 252, and the fans 248 blow the air throughout the cavity formed by the cover 30 and pan 32.

The cover and pan 30, 32 surround one or more lighting sources 34 and includes a lens 36 (e.g., a plastic sheet, a glass sheet, etc.) that allows light from the one or more lighting sources 34 to shine downwardly from the lighting fixture 222. Other electronics may be mounted within the internal cavity formed by the cover and pan 30, 32 as discussed herein.

Attention is now invited to FIGS. 22-27 which show another embodiment of a lighting fixture 318. It to be understood that the lighting fixture 318 can be used with any of the universal mounting system 20, 20*a*, 20*b*, 20*c* to mount the lighting fixture 322 to a pole.

The lighting fixture 22 includes the cover 30 and the pan 32 that mates together to form the internal cavity therewithin. The pan 32 is not shown in FIGS. 22-27 for ease in showing the components of the lighting fixture 318. The specifics of the cover 30 and the pan 32 are not repeated herein.

As shown, a pair of light assemblies 320 are mounted within each of the apertures 46, 50. Each light assembly 320 includes a heat sink 322 attached to the upper wall 38 of the cover 30, a first reflector 324 attached to the heat sink 322 and spans the length of the heat sink 322, a second reflector 326 attached to the heat sink 322 and spans the length of the heat sink 322, and a plurality of lighting sources 34, such as LED lights, mounted on the heat sink 322 such that the light from the lighting sources 34 shines between the reflectors 322, 326. As shown, a pair of light assemblies 320 are mounted in each aperture 46, 50, but a single light assembly 320 or more than two light assemblies 320 can be mounted in each aperture 46, 50.

FIGS. 22-27 show an alternate light assembly 320 which is the same as light assembly 220 except for the differences noted herein. In light assembly 320, walls 238 and 240 are formed as part of the heat sink 322 instead of as part of the upper reflector 224. As such, the upper reflector 324 includes wall 327 to connect the upper reflector 324 to the lower end of wall 240. Upper reflector 324 also includes side walls 329 extending downwardly from wall 242. The side walls 329 aid in directing the light from lighting sources 34 in the desired direction. The addition of the side wall 329 allows the fans 248 to be eliminated.

Figure 29:
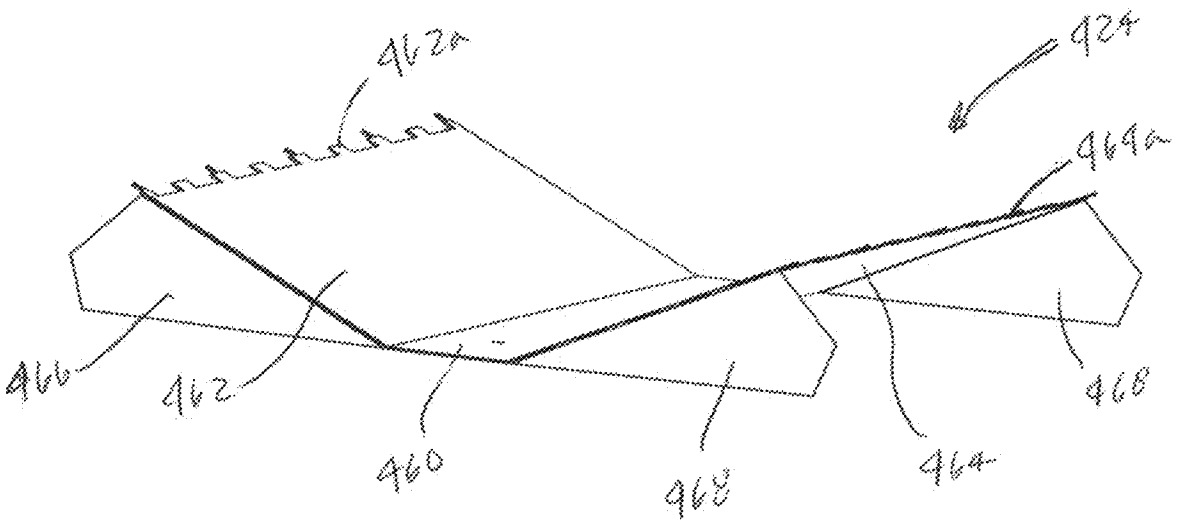
FIG. 29 is a perspective view of an upper reflector of the light assembly of FIG. 28.
Figure 30:
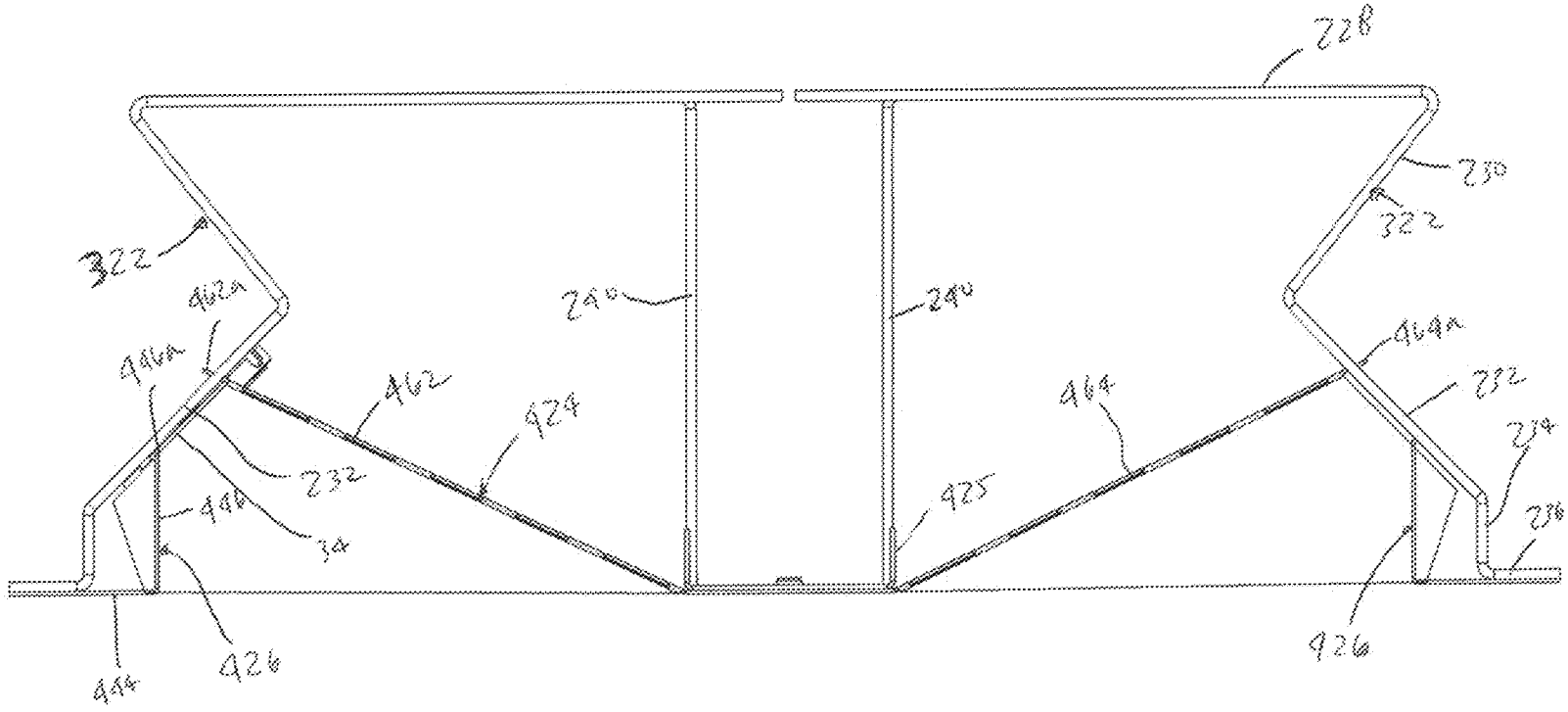
FIG. 30 is a cross-sectional view of the light assembly of FIG. 28.

FIGS. 28-30 show a bi-directional light assembly 420. One light assembly 420 is mounted in aperture 46 and another light assembly 420 is mounted in aperture 50.

Each light assembly 220 includes a pair of heat sinks 322 which are attached to each other by a single upper reflector 424 and a bracket 425, and pair of lower reflectors 426.

The upper reflector 424 is formed of a first wall 460 which is horizontal, a second wall 462 extending outwardly from an end of the first wall 460 and at an angle relative to the first wall 460, a third wall 464 extending outwardly from the opposite end of the first wall 460 and at an angle relative to the first wall 460, side walls 466 extending downwardly from each end of the second wall 462, and side walls 468 extending downwardly from each end of the third wall 464. Each of walls 462, 464 may extend at the same angle from horizontal. The free end 462*a* of the second wall 462 abuts against, passes through, or is close proximity to the third wall 232 of the heat sink 322. The free end 464*a* of the second wall 464 abuts against, passes through, or is close proximity to the third wall 232 of the other heat sink 322.

The lower reflectors 426 differ from lower reflector 226 in that the wall 446 is perpendicular to wall 444. As such, the lower reflectors 426 are formed of a first wall 444 which is horizontal, and a second wall 446 extending perpendicularly from an end of the first wall 444. The first wall 444 is attached by suitable means to the lower surface of the fifth wall 236 of the heat sink 322. The free end 446*a* of the second wall 446 abuts against or is close proximity to the third wall 232 of the heat sink 322, but is spaced from the third wall 442 of the upper reflector 424.

The bracket 425 is generally U-shaped and seats against the first wall 460 of the upper reflector 424 and engages the walls 240 of the heat sinks 322.

The lighting sources 34 seat on the third wall 232 of the heat sink 322 and are positioned between the reflectors 424, 426. The reflectors 424, 426 direct the light from the lighting sources 34 in the desired direction.

In some embodiments, the number of vias 75, 175 may be the same. In some embodiments, more vias 75 are provided in the mounting bracket 54' than the number of vias 175 in the driver mount 130 so as to promote a chimney effect as the air flows through the universal mounting system 20, 20*a*, 20*b*, 20*c*.

Figure 31:
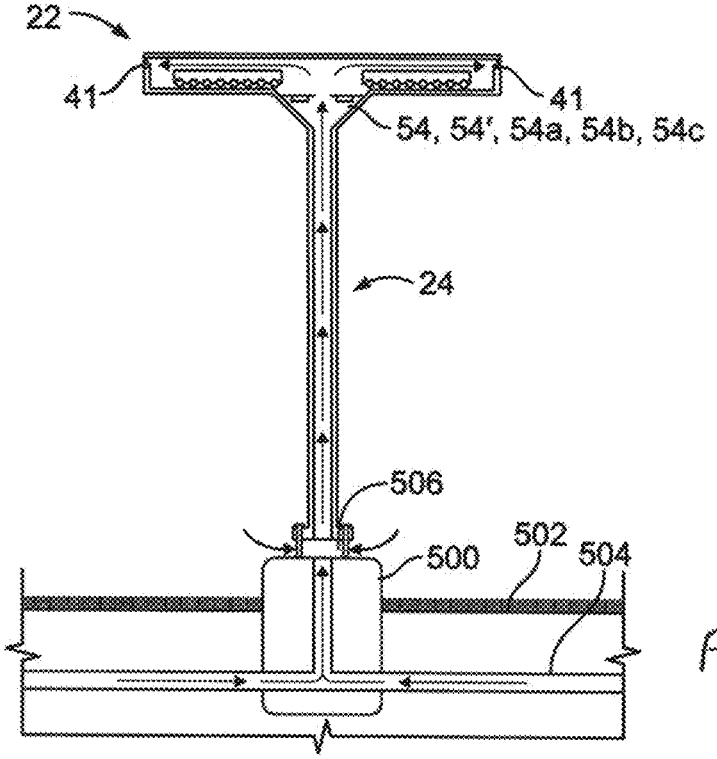
FIG. 31 is a cross-sectional view of the lighting assembly mounted on a pole.

As shown in FIG. 30, poles 24 are mounted on a mount 500 that extends into the ground 502. The pole 24 is hollow and communicates with a conduit 504 mounted under the ground through which wiring for lighting is provided. The bottom 24*a* of the pole 24 is mounted such that there are gaps 506 between the pole 24 (shown exaggerated in FIG. 31), and the mount 500 such that air flows into the hollow pole 24. The air flows through the gaps 506 and through the conduit 504 into the universal mounting system 20, 20*a*, 20*b*, 20*c*. The air can flow through the passageway 74, or through the arrays of vias 75, 175 (as the passageways 74 will be filled with wiring), and into the bracket 54, 54', 54*a*, 54*b*, 54*c*. The air travels through the lighting fixture 22 and across the heat sinks 128, 222, 322 to aid in dissipating heat from the drivers 122, the lighting sources 34 and any other electronics in the lighting fixture 22. The air passes out of the lighting fixture 22 through the vias 41. The vias 41 also provide for pressure relief within the lighting fixture 22 as a result of the air increasing in temperature within the light fixture 22 during operation.

Figure 32:
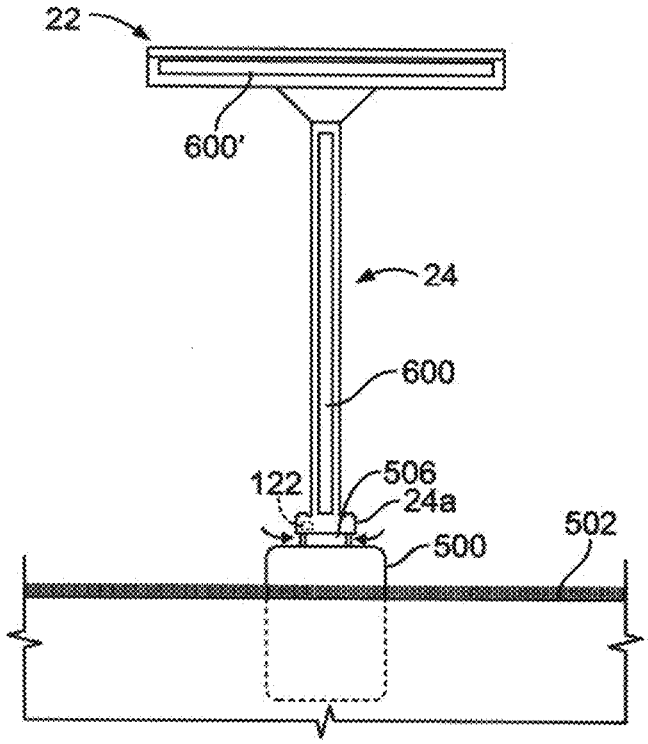
FIG. 32 is a plan view of a pole having a lighting assembly mounted thereon.
Figure 33:
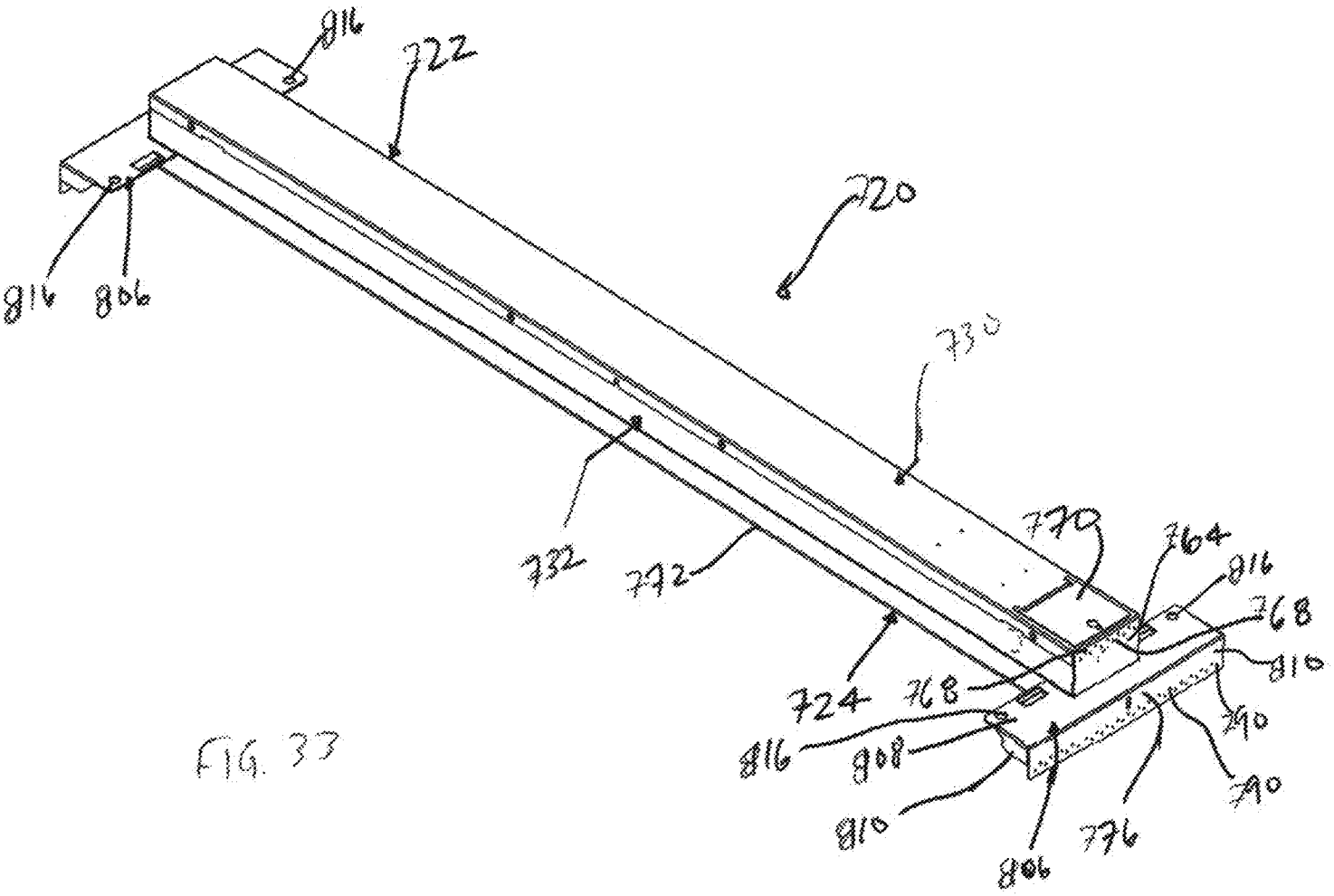
FIG. 33 is a perspective view of a lighting fixture according to an embodiment of the disclosure.
Figure 34:
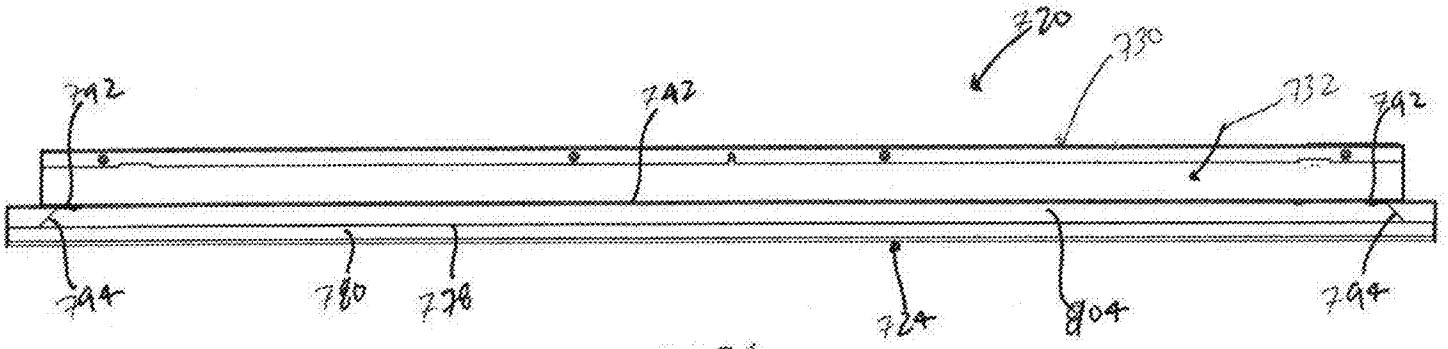
FIG. 34 is a side elevation view of the lighting fixture of FIG. 33.
Figure 35:
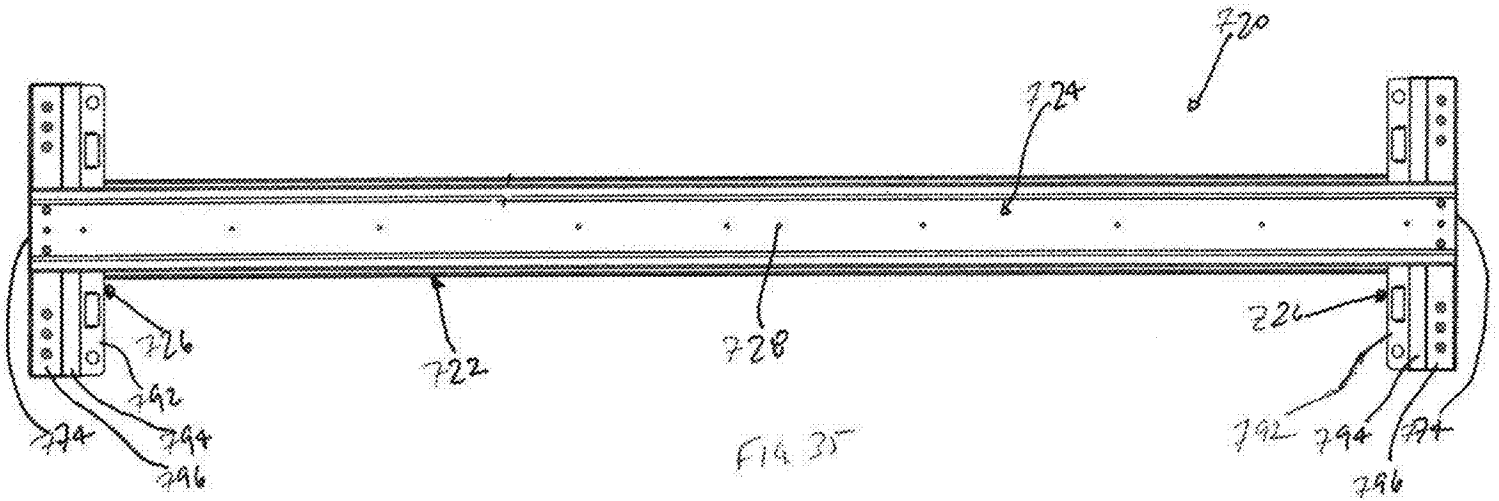
FIG. 35 is a bottom plan view of the high bay/low bay lighting fixture of FIG. 33.
Figure 7B:
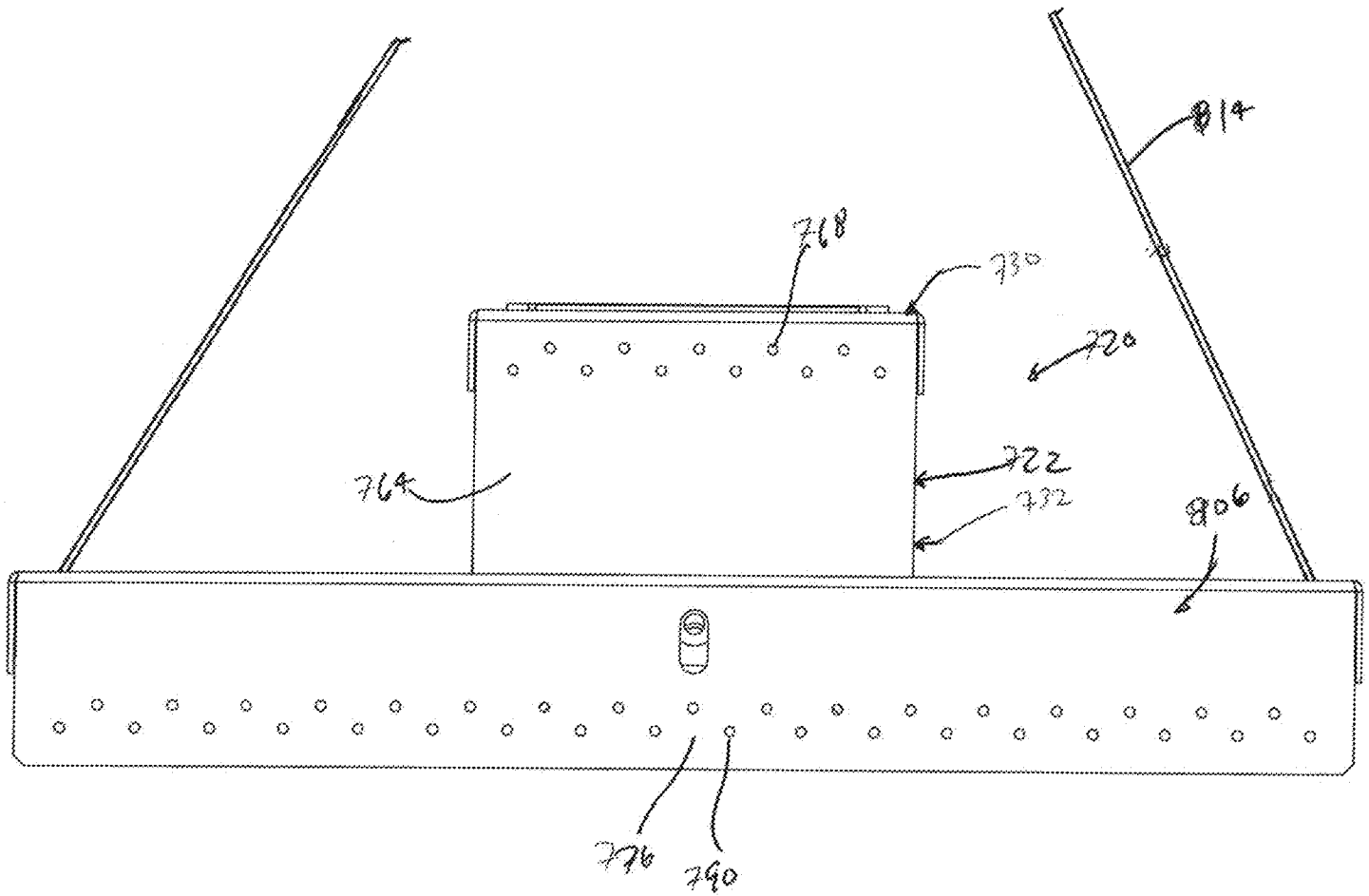
Figure 22:
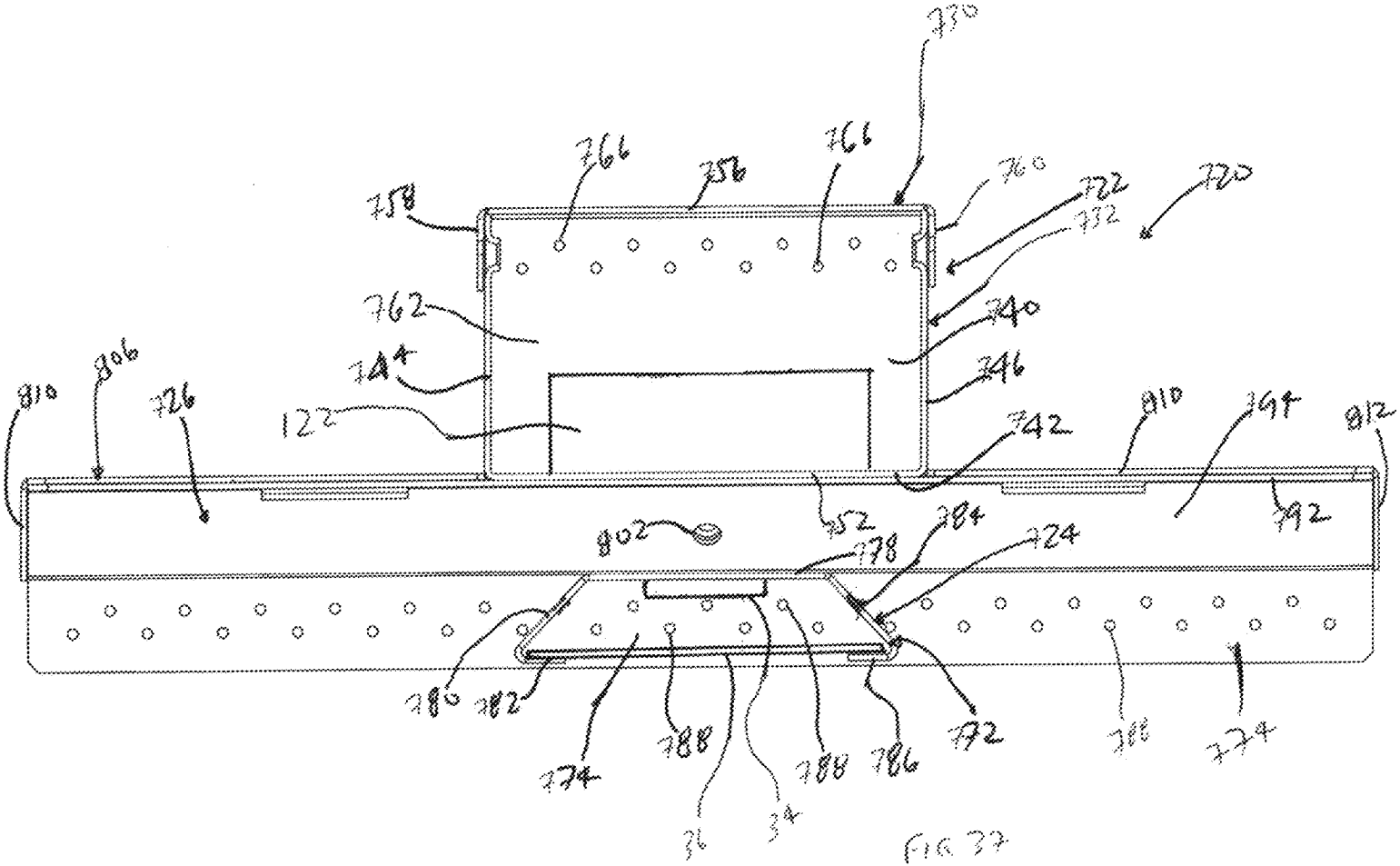
FIG. 22 is a perspective view of a light assembly which may be incorporated into the lighting fixture.

As shown in FIG. 32, the pole 24 may have a light 600 which extends up at least part of the length of the pole 24. Alternatively, or in addition to light 600, the lighting fixture 22 may have a light 600' on the cover 30 and/or the pan 32. The light(s) 600, 600' may change colors. The light 600 may extend the full length of the pole 24, or part of the length of the pole 24. The light 600' may extend the full length of the cover 30 and/or pan 32, or part of the length of the cover 30 and/or pan 32.

As also shown in FIG. 32, the drivers 122 are mounted in the bottom 24*a* of the pole 24. Since the drivers 122 are separated from the lighting sources 34, this further minimizes the amount of heat generated by the lighting fixture 22. Suitable wiring extends from the drivers 122, through the pole, through the bracket 54, 54', 54*a*, 54*b*, 54*c* to the lighting sources 34.

As shown in FIGS. 33-43, a lighting fixture 720 is provided. In an embodiment, the lighting fixture 720 is used in a commercial and industrial settings, such as a warehouse. In another embodiment, the lighting fixture 720 is used in a residential setting. The lighting fixture 720 provides well distributed and uniform light for open areas.

An embodiment of the lighting fixture 720 is shown in FIGS. 33-41. Other embodiments of the lighting fixture (720', 820, 920, 1020) are shown in FIGS. 42 through 83.

Attention is invited to the embodiment of the lighting fixture 720 shown in FIGS. 33-41. The lighting fixture 720 includes a driver housing assembly 722, a heat sink 724 coupled to the driver housing assembly 722 by a mounting bracket 726, one or more lighting sources 34 mounted to the heat sink 724, and a lens 36 attached to the heat sink 724 for covering the one or more lighting sources 34. The driver housing assembly 722 includes a driver 122 for controlling the illumination of the one or more lighting sources 34. Such drivers 122 are known in the art. The drivers 122 include the electronics for activating/deactivating the lighting sources 32. The driver 122 is substantially thermally separated from the one or more lighting sources 34 by the mounting bracket 726 in order to provide improved thermal management of the heat generating components, that is the driver 122 and the lighting sources 34, of the lighting fixture 720. The one or more lighting sources 34 may be LED lights or fluorescent lights or any other suitable lamps.

The driver housing assembly 722 includes a pan 732 which is covered by a cover 730 to form a box-like enclosure having a central cavity 740. The driver 122 is mounted within the cavity 740 and may be mounted on the pan 732. Other electronics and electrical components which may generate heat may be mounted within the internal cavity 740 formed by the driver housing assembly 722. The embodiment described and shown herein is exemplary and the enclosure may take other forms.

The pan 732 is a generally U-shaped and is formed from an elongated, horizontal base wall 742 having opposite first and second side edges and opposite ends extending between the side edges, a first upstanding side wall 744 extending from the first side edge of the base wall 742, and a second upstanding side wall 746 extending from the second side edge of the base wall 742. A centerline 748 of the base wall 742 is provided between the ends. The walls 742, 744, 746 define a channel having an open-ended top. In an embodiment, the first and second upstanding side walls 744, 746 are vertical.

Figure 39:
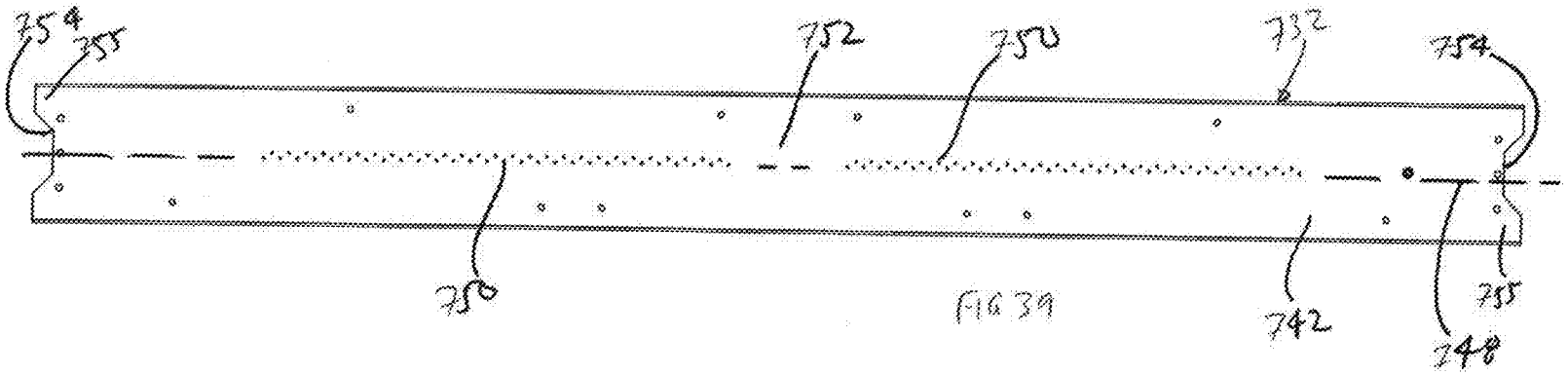
FIG. 39 is a bottom plan view of a lower housing which is a component of the lighting fixture of FIG. 33.
Figure 40:
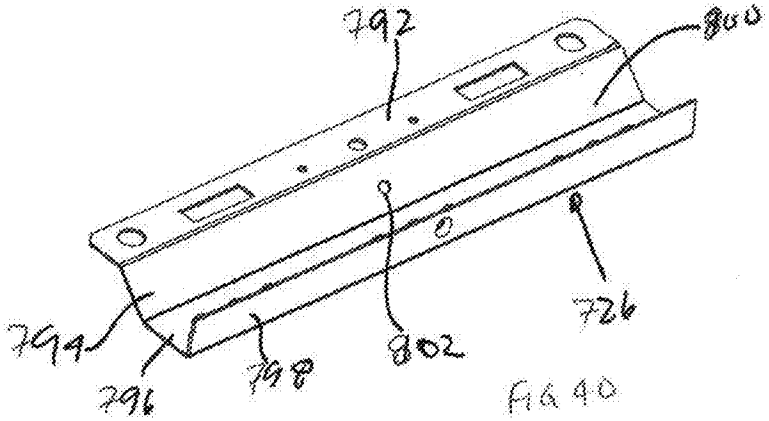
FIG. 40 is a perspective view of a mounting bracket which is a component of the lighting fixture of FIG. 33.
Figure 41:
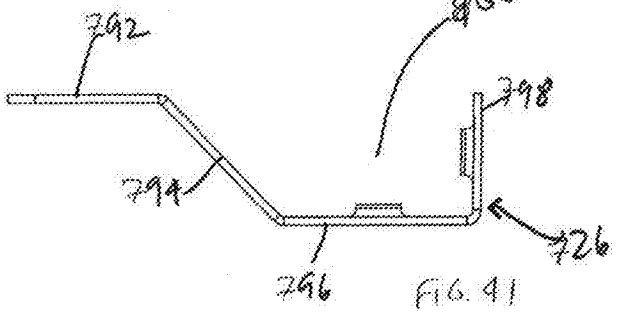
FIG. 41 is a side elevation view of the mounting bracket of FIG. 40.

As shown in FIG. 39, the base wall 742 has a plurality of spaced apart small diameter vias 750 therethrough which extend from a top surface to a bottom surface thereof. The vias 750 are provided in an array. As shown, the vias 750 are provided in two rows, with the vias 750 being staggered from each other. The vias 750 may be provided on the centerline 748, proximate to the centerline 748, or offset from the centerline 748. A continuous portion 752 of the base wall 742 may be provided, that is the base wall 742 is continuous in that it does not have vias 750. The driver 122 may be mounted above the continuous portion 752 of the base wall 742. The base wall 742 further has a cutout 754 provided in an end portion 755 at each end through which wiring (not shown) from the driver 122 extends.

The cover 730 has a base wall 756 having opposite first and second side edges and opposite ends extending between the side edges, a first depending side wall 758 extending from the first side edge of the base wall 756, a second depending side wall 760 extending from the second side edge of the base wall 756, and an end wall 762, 764 extending from the respective ends of the base wall 756. Each end wall 762, 764 may be greater in height than the side walls 758, 760. Each end wall 762, 764 has a plurality of spaced apart small diameter vias 766, 768 extending from an outer surface to an inner surface thereof. The vias 766, 768 are provided in arrays. As shown, the vias 766, 768 are provided in two rows, with the vias 766, 768 being staggered from each other. The vias 766, 768 may be provided proximate to a top end of each side wall 758, 760. The base wall 756 may have a cutout therein into which an access panel 770 is mounted. The access panel 770 is suitably attached to the cover 730.

The driver housing assembly 722 is formed by seating the cover 730 on top of the pan 732 such that the side walls 758, 760 of the cover 730 engage the side walls 744, 746 of the pan 732. The side walls 758, 760 of the cover 730 may overlap the side walls 744, 746 of the pan 732. The end walls 762, 764 of the cover 730 close the open ends of the pan 732. The cover 730 and the pan 732 are suitably joined together, such as by fasteners. The vias 766, 768 allow for the passage of air from an interior of the driver housing assembly 722 to an exterior of the driver housing assembly 722. Alternatively, the pan 732 may have four upstanding side walls and the cover 730 covers the open upper end of the pan 732.

The heat sink 724 is formed from an elongated, generally U-shaped channel 772 having an end cap 774, 776 closing each end of the channel 772. The channel 772 is formed from a horizontal base wall 778 having opposite first and second side edges and opposite ends extending between the side edges, a first depending side wall 780 extending from the first side edge of the base wall 778, a first flange 782 extending inwardly from the lower end of the side wall 780, a second depending side wall 784 depending from the second side edge of the base wall 778, and a second flange 786 extending inwardly from the lower end of the side wall 784. The walls 778, 780, 784 and flanges 782, 786 define a three-sided, open-ended channel. In an embodiment, the first and second side walls 780, 784 are angled outwardly relative to each other. In an embodiment, the heat sink 724 may be formed of a cured synthetic polymerization composite which includes at least one polymerized resin and at least one additive which is disclosed in U.S. application Ser. No. 14/854,906, filed on Sep. 15, 2015, the disclosure of which is incorporated by reference in its entirety. Alternatively, the heat sink 724 may be formed of a suitable metal, such as aluminum. Each end cap 774, 776 has a plurality of spaced apart small diameter vias 788, 790 extending from an outer surface to an inner surface thereof. The vias 788, 790 are provided in arrays. As shown, the vias 788, 790 are provided in two rows, with the vias 788, 790 being staggered from each other. The vias 788, 790 allow for the passage of air from an interior of the heat sink 724 to an exterior of the heat sink 724.

The one or more lighting sources 34 mount within the heat sink channel 772 and shine downwardly. The heat sink 724 dissipates heat generated by the one or more lighting sources 34. The one or more lighting sources 34 are covered by lens 36 (e.g., a plastic sheet, a glass sheet, etc.) attached to the channel 772 and that allows light from the one or more lighting sources 34 to shine downwardly from the lighting fixture 720. The heat sink 724, end caps 774, 776 and lens 36 form a housing for the lighting sources 34.

The mounting brackets 726 connects the heat sink 724 to the driver housing assembly 722. As shown, each mounting bracket 726 is formed of a horizontal mounting flange 792, a first wall 794 extending from an outer end of the mounting flange 792 and which angles downwardly and outwardly relative to the mounting flange 792, a second horizontal wall 796 which extends from the lower end of the first wall 794 and is parallel to the mounting flange 792, and a third wall 798 which extends upwardly from the outer end of the second wall 796. The third wall 798 may extend perpendicularly from the second wall 796. The first, second and third walls 794, 796, 798 form a generally U-shaped recess 800. The first wall 794 has an aperture 802 therethrough through which wiring extends.

At each end of the pan 732, the upper surface of the mounting flange 792 of the mounting bracket 726 abuts against and is attached to the lower surface of the base wall 742 of the pan 732 by suitable means, such as fasteners. The end portion 755 where the cutout 754 is provided overhangs the recess 800 formed by the mounting bracket 726. This allows wiring to pass through the cutout 754 and into the recess 800 and to allow for the passage of air between the driver housing assembly 722 and the mounting bracket 726. At each end of the heat sink 724, the lower surface of the second wall 796 of the mounting bracket 726 is attached to the upper surface of the base wall 778 of the heat sink 724 by suitable means, such as fasteners. As a result of this construction, the majority of any heat sink 724 which is mounted directly below the driver housing assembly 722 is separated from the driver housing assembly 722 by a gap 804, see FIG. 34, formed by the height of the first wall 794 of the mounting bracket 726. This gap 804 aids in minimizing heat transfer between the driver 122 and any other electrical components mounted in the cavity 740 and the one or more lighting sources 34 mounted on the heat sink 724.

The end caps 774, 776 may be formed as part of a cover 806 which closes the recess 800 of the respective mounting bracket 726. As shown, each cover 806 is formed of an upper horizontal wall 808, a lower vertical wall 810 which depends from an outer end of the upper wall 808, and side walls 810, 812 which extend downwardly at the side edges of the upper and lower walls 808, 810. A lower surface of the upper wall 808 of the cover 806 abuts an upper surface of the mounting flange 792 of the mounting bracket 726. The side walls 810, 812 of the cover 806 engage the side edges of the first, second and third walls 794, 796, 798 of the mounting bracket 726. A portion of the lower wall 810 of the cover 806 forms the end caps 774, 776. Therefore, as shown, the end caps 774, 776 of the heat sink 724 may be integrally formed as part of the covers 806. Alternatively, the end caps 774, 776 may be formed separately from the covers 806 and attached to the heat sink 724. The upper wall has a cutout into which the end of the driver housing assembly 722 seats. Respective covers 806 and mounting brackets 726 are suitably joined together, such as by fasteners or by tabs on one of the cover 806 and mounting bracket 726 extending in openings in the other of the cover 806 and the mounting bracket 726.

The vias 750, 766, 768, 788, 790 may have a diameter of which range in size from 0.040" to 0.187", may be approximately 0.07", and more particularly a diameter of 0.068". The vias 750, 766, 768, 788, 790 are small to prevent the intrusion of dust and other contaminants into the driver housing assembly 722 and into the heat sink 724, while allowing for air flow into the driver housing assembly 722 and into the heat sink 724. The passage of air allows for convective heat transfer. The vias 750, 788, 790 through the end caps 774, 776 and through the base wall 742 of the driver housing assembly 722 allow cool air to enter into the heat sink 724 and into the driver housing assembly 722. The vias 766, 768 through the end walls 762, 764 of the driver housing assembly 722 allows warm air to vent out of the lighting fixture 720.

In the embodiments as shown in FIGS. 42-83 at least two heat sinks are attached to the mounting bracket 726 and to the driver housing assembly 722 to form the lighting fixtures 720' (five heat sinks), 820 (two heat sinks), 920 (three heat sinks), and 1020 (four heat sinks).

Figure 42:
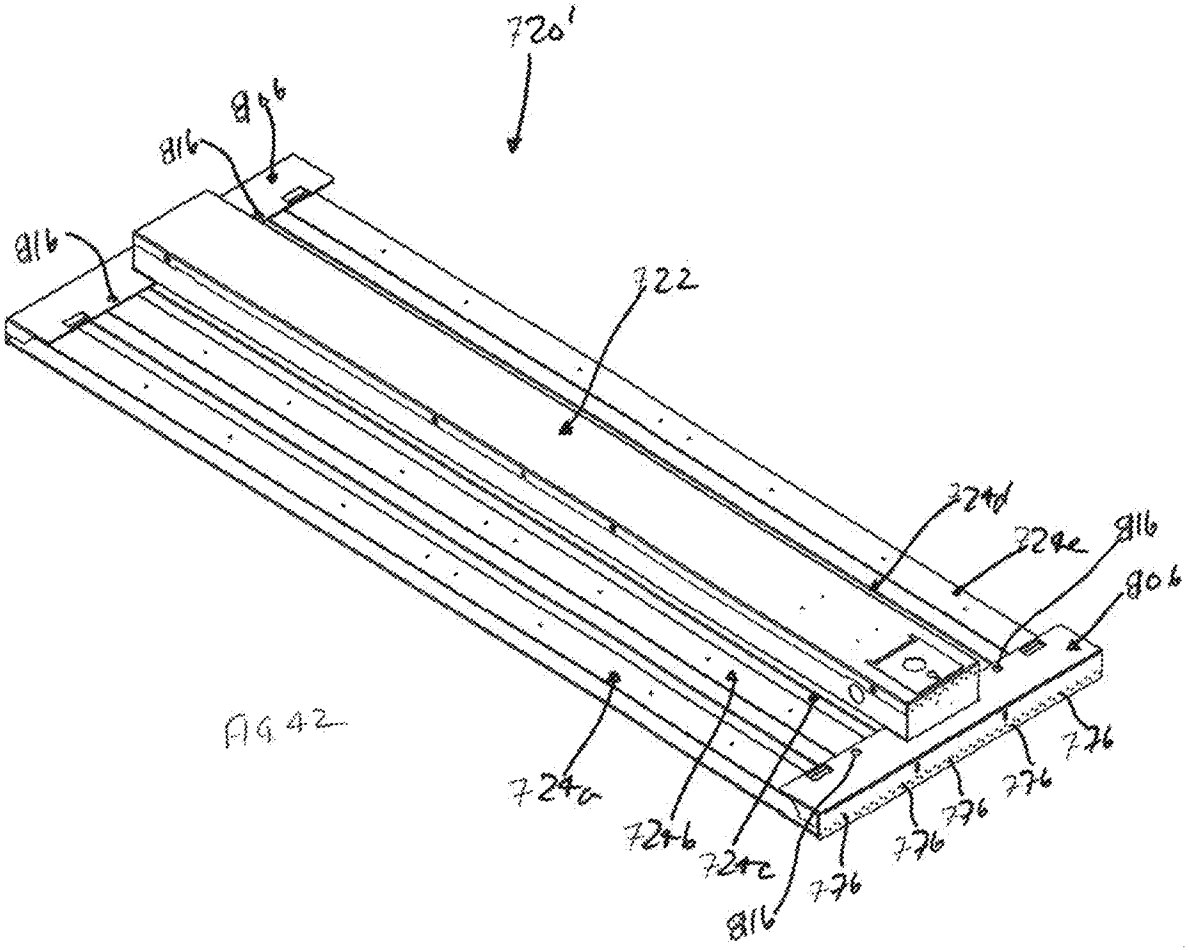
FIG. 42 is a perspective view of a lighting fixture according to another embodiment of the disclosure.
Figure 47:
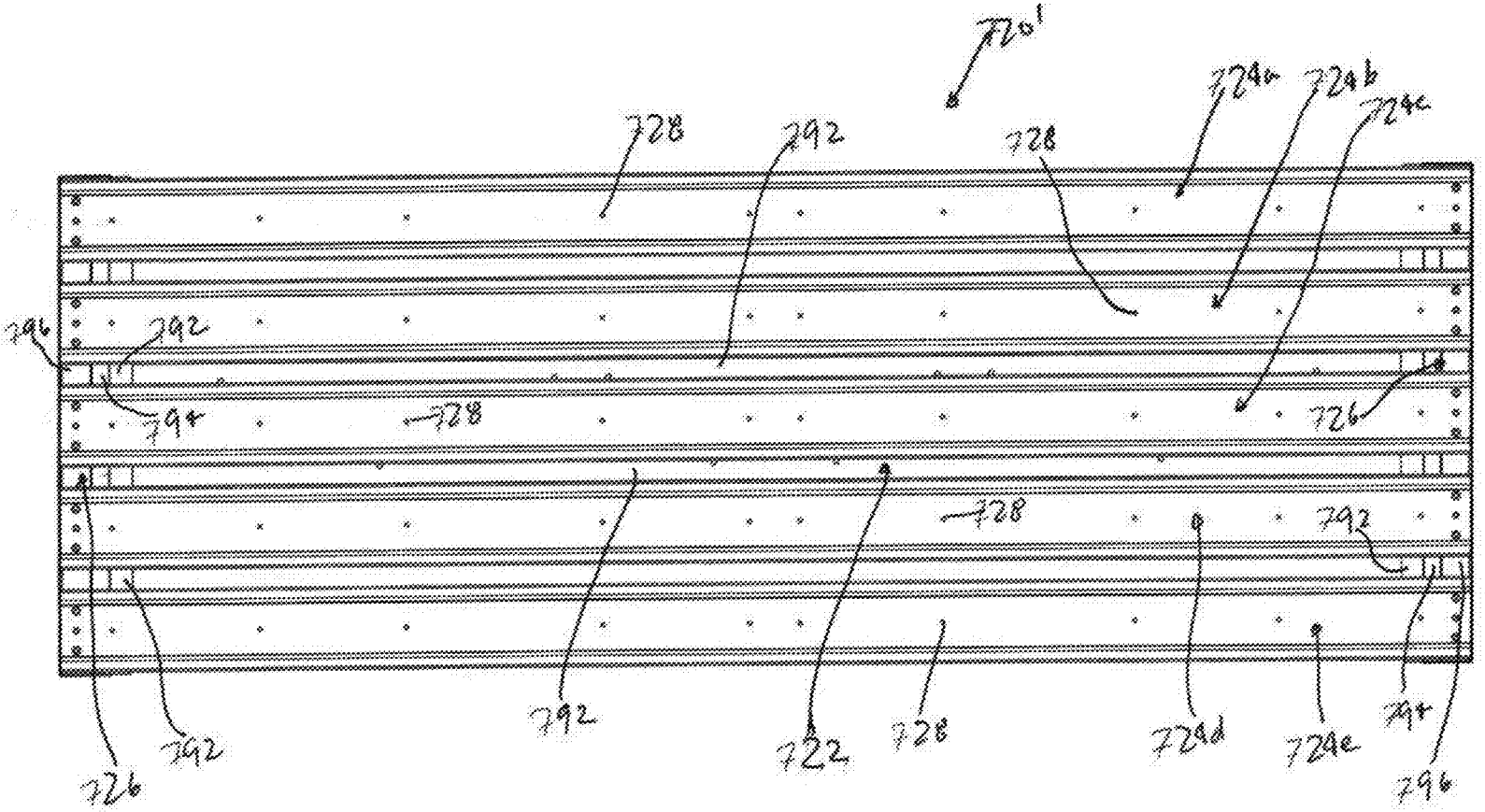
FIG. 47 is a side elevation view of the lighting fixture shown in FIG. 44.
Figure 44:
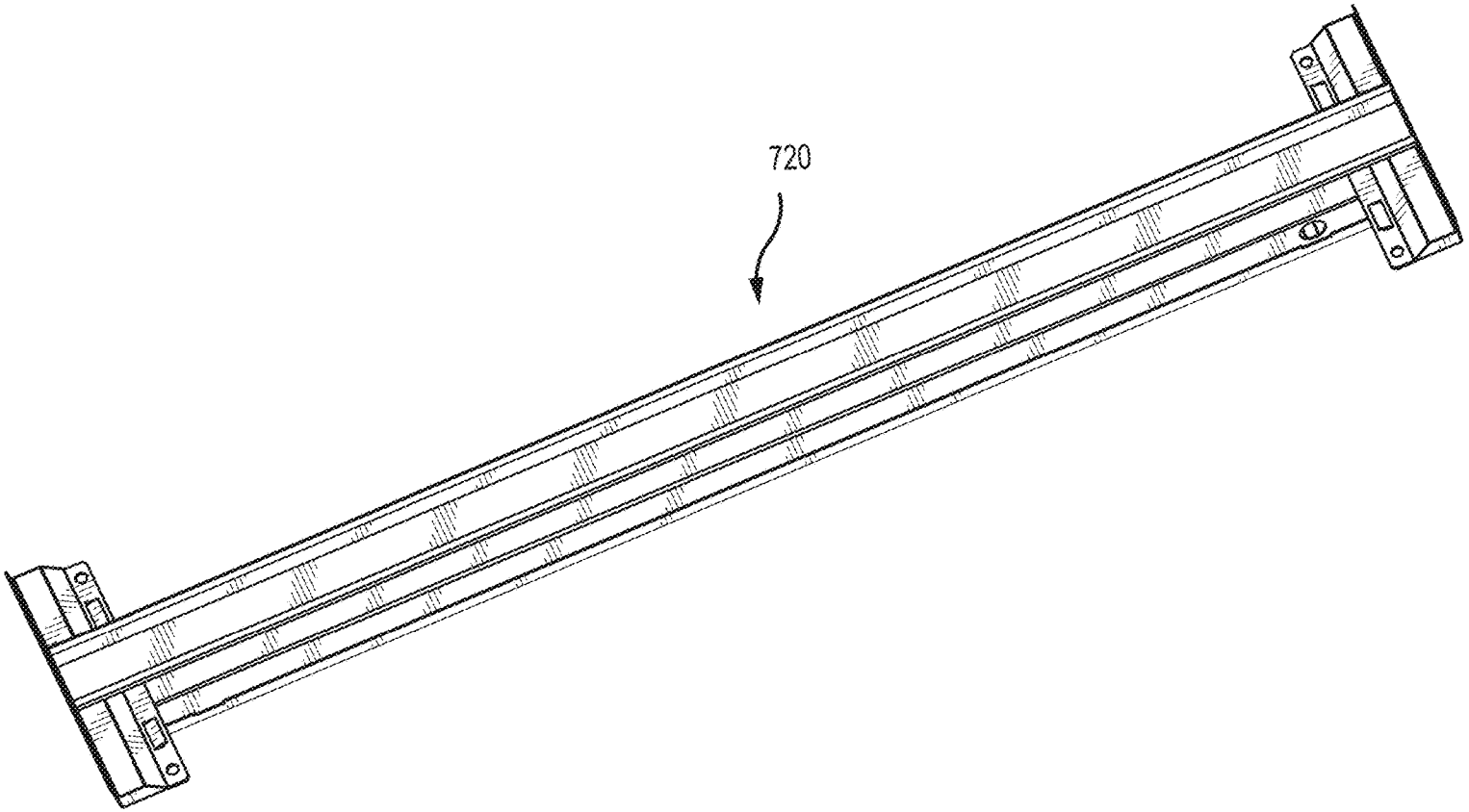
FIG. 44 is another perspective view of the lighting fixture shown in FIG. 33.
Figure 45:
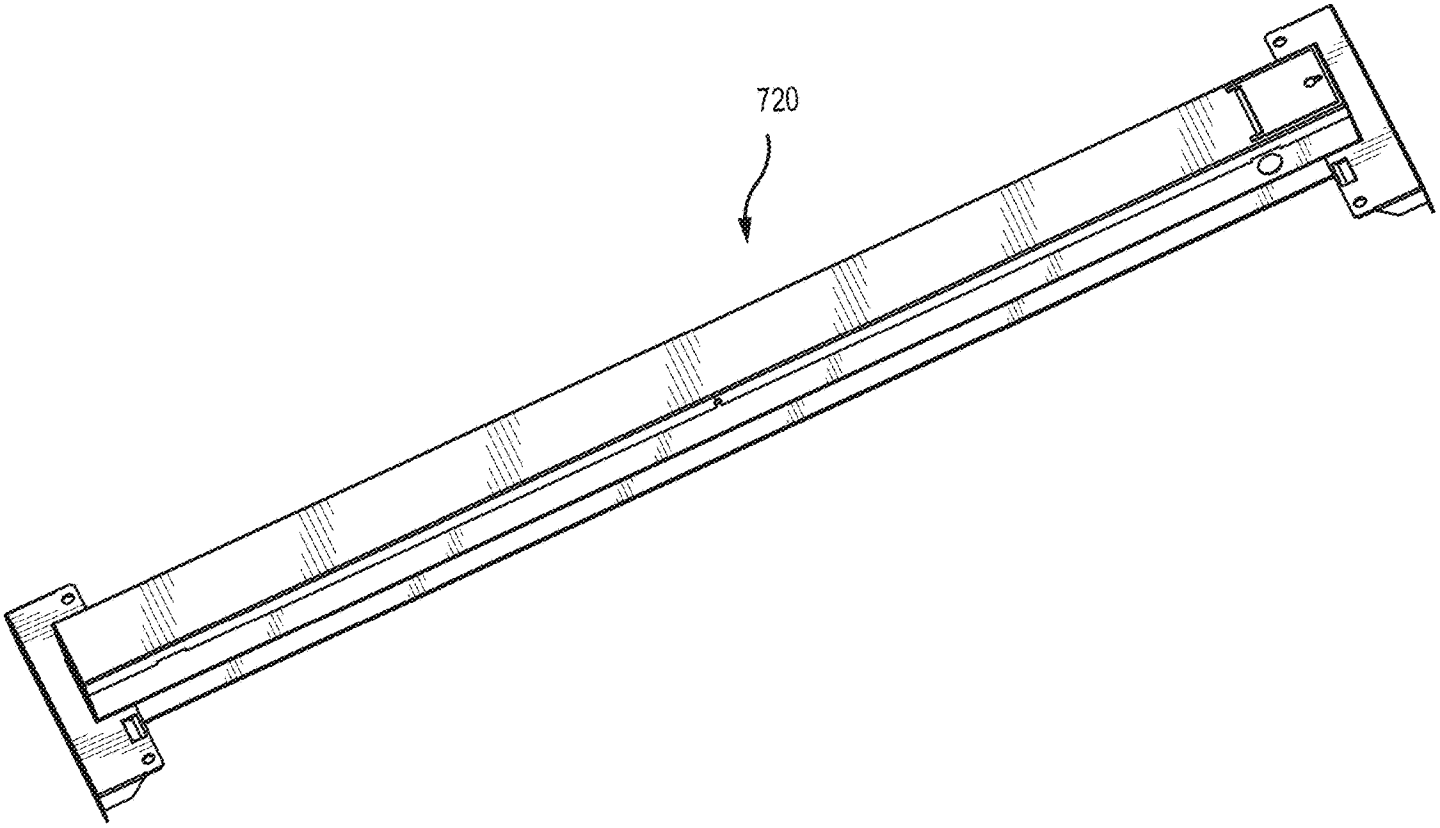
FIG. 45 is another perspective view of the lighting fixture shown in FIG. 44.
Figure 46:
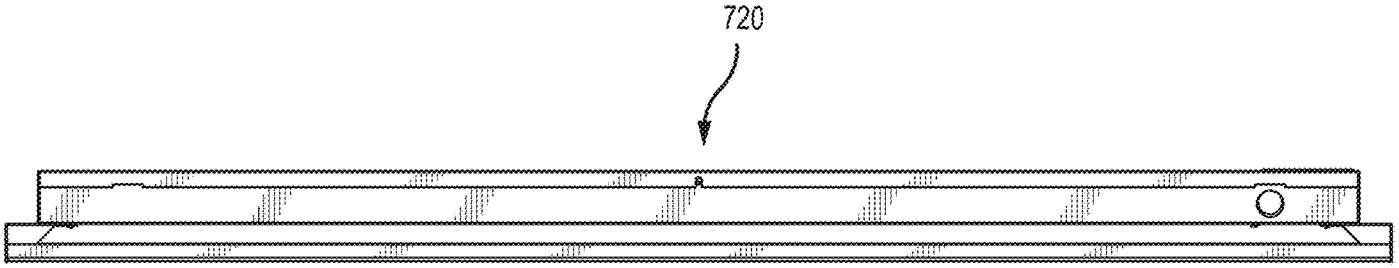
FIG. 46 is a side elevation view of the lighting fixture shown in FIG. 44.
Figure 47:
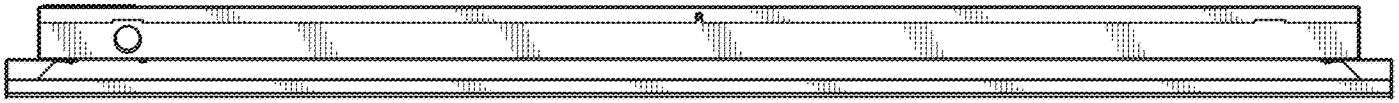
Figure 49:
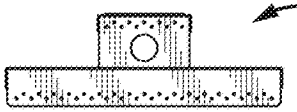
FIG. 49 is a rear elevation view of the lighting fixture shown in FIG. 44.
Figure 48:
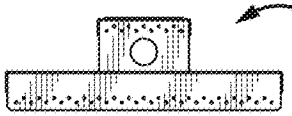
FIG. 48 is a front elevation view of the lighting fixture shown in FIG. 44.
Figure 50:
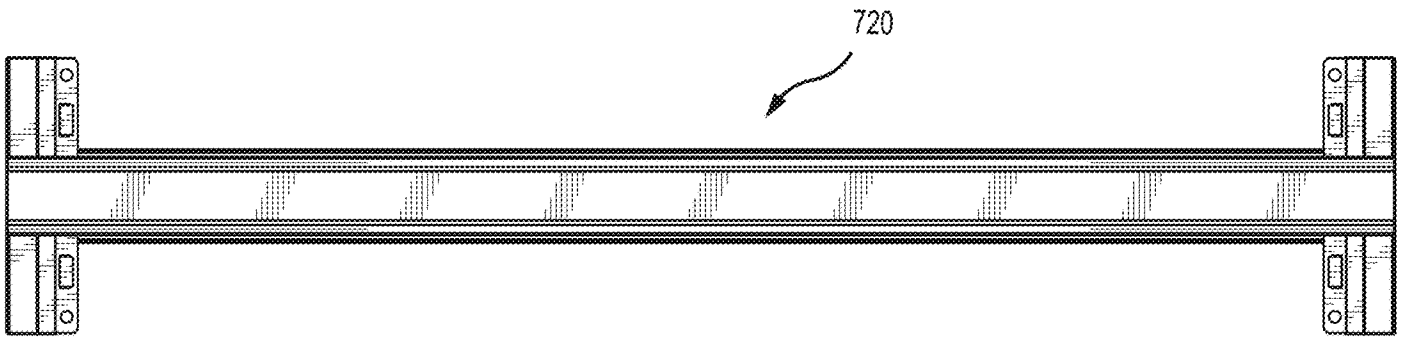
FIG. 50 is a bottom plan view of the lighting fixture shown in FIG. 44.
Figure 51:
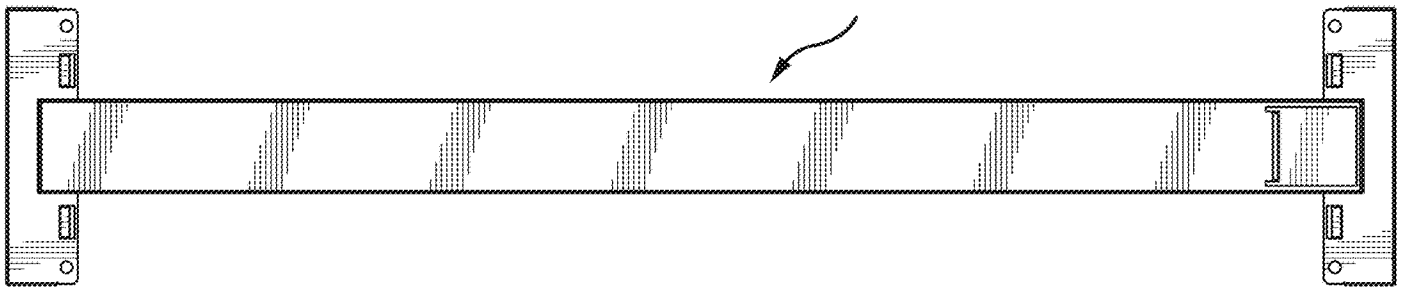
FIG. 51 is a top plan of the lighting fixture shown in FIG. 44.
Figure 52:
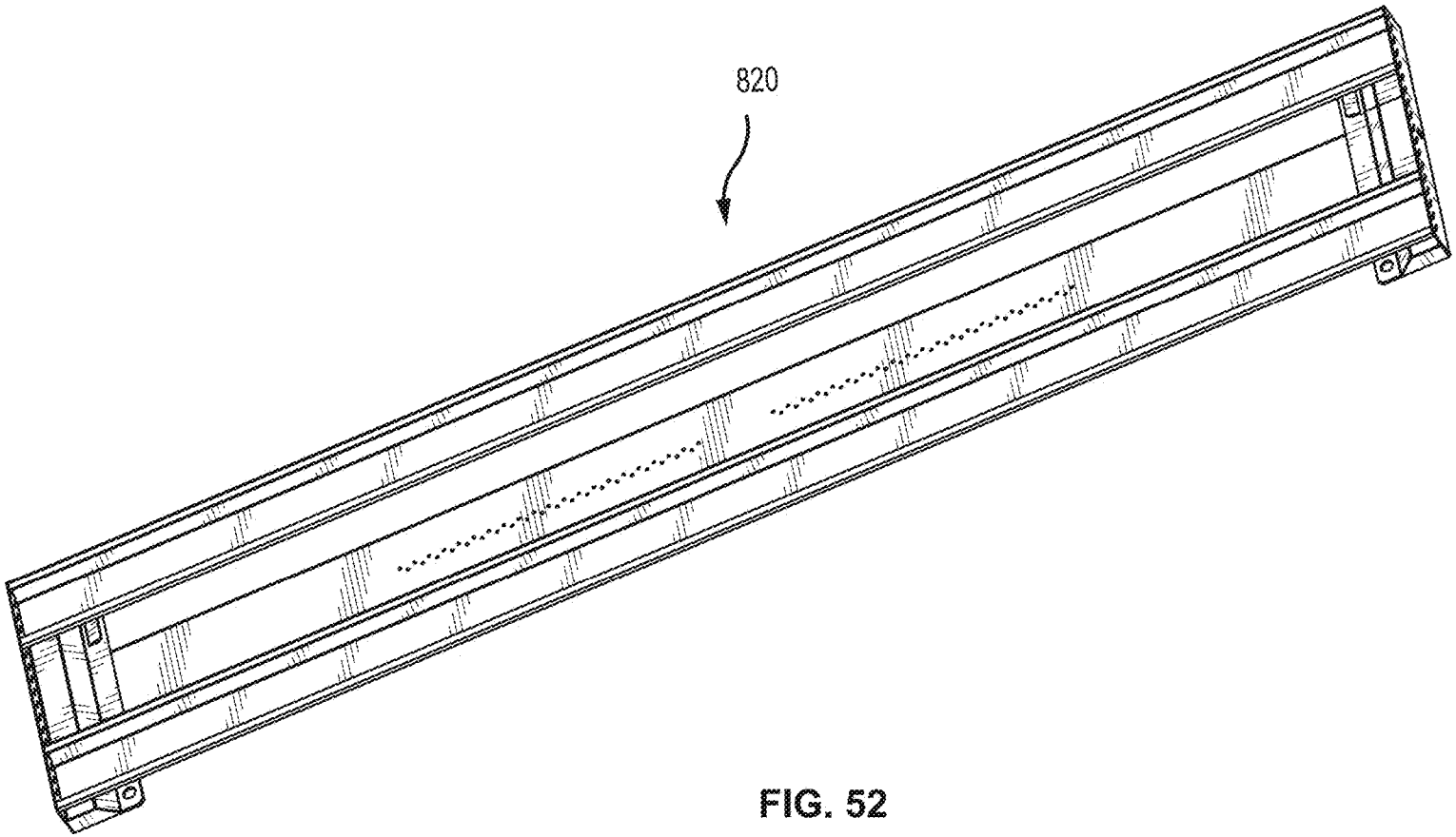
FIG. 52 is a perspective view of another embodiment of the lighting fixture according to the invention.
Figure 53:
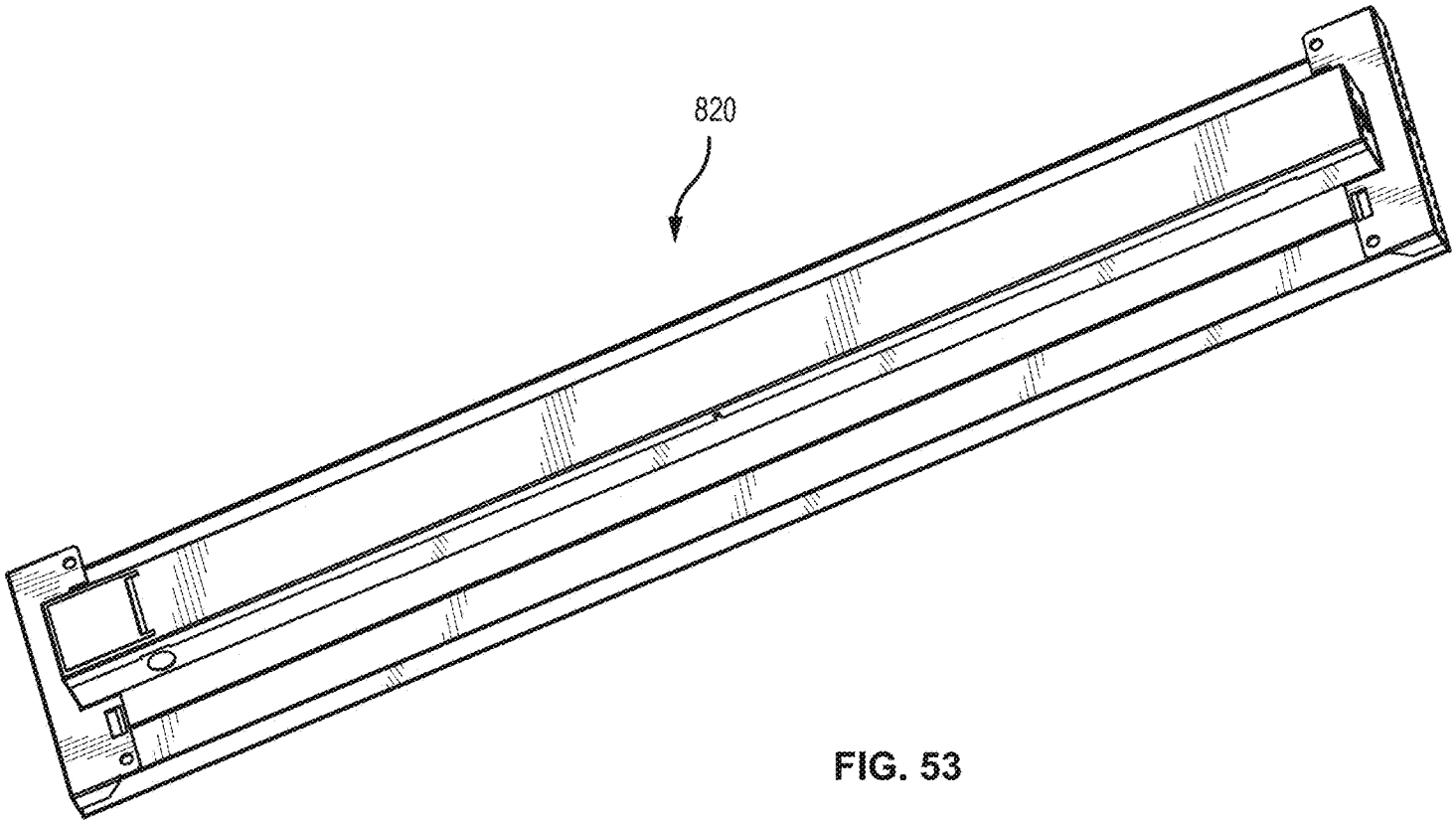
FIG. 53 is another perspective view of the lighting fixture shown in FIG. 52.
Figure 54:
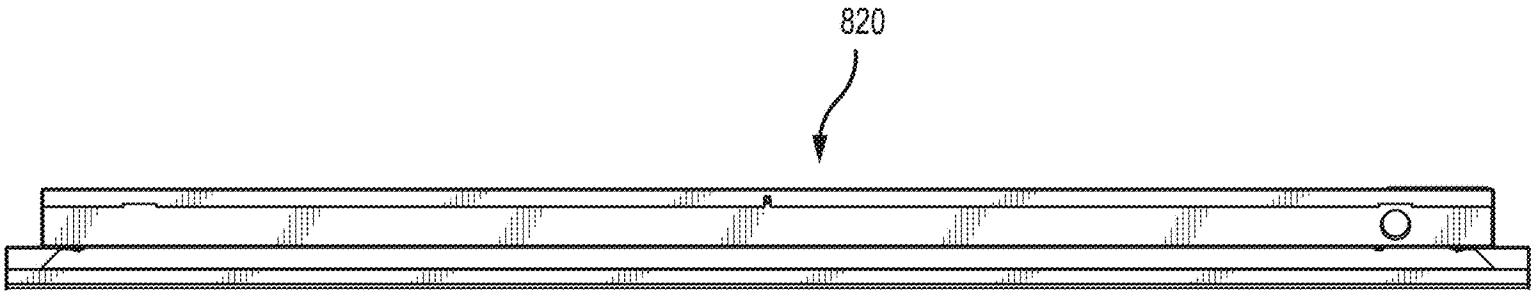
FIG. 54 is a side elevation view of the lighting fixture shown in FIG. 52.
Figure 55:
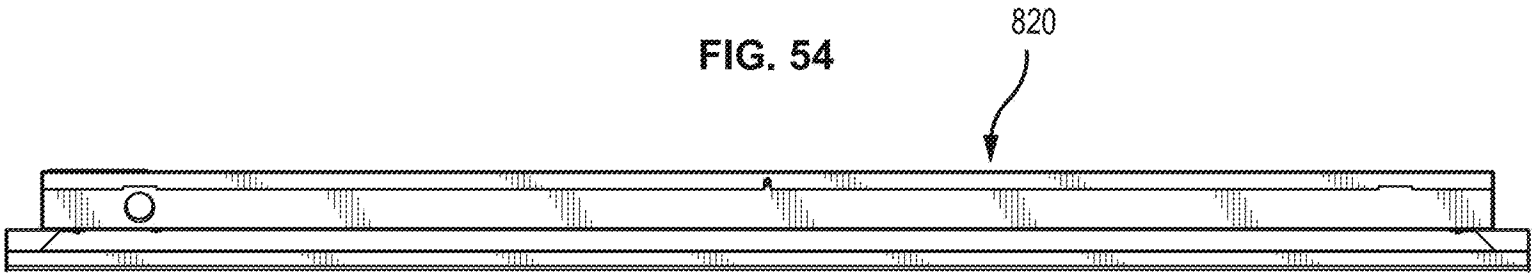
FIG. 55 is a side elevation view of the lighting fixture shown in FIG. 52.
Figure 57:
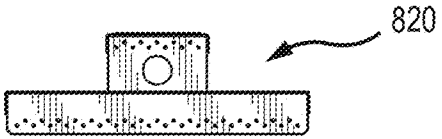
FIG. 57 is a rear elevation view of the lighting fixture shown in FIG. 52.
Figure 56:
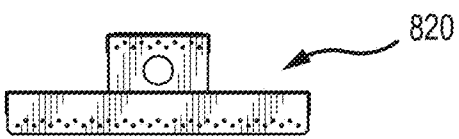
FIG. 56 is a front elevation view of the lighting fixture shown in FIG. 52.
Figure 58:
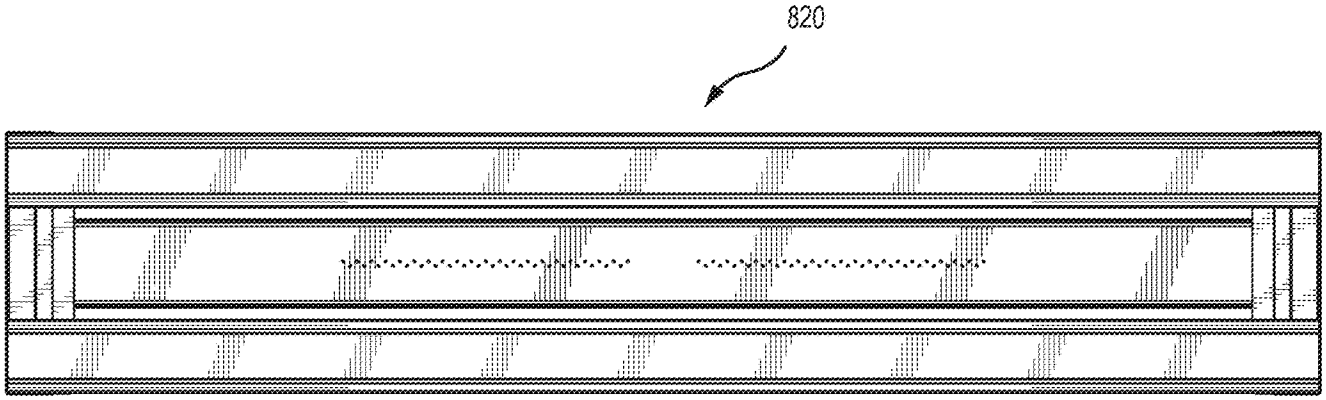
FIG. 58 is a bottom plan view of the lighting fixture shown in FIG. 52.
Figure 59:
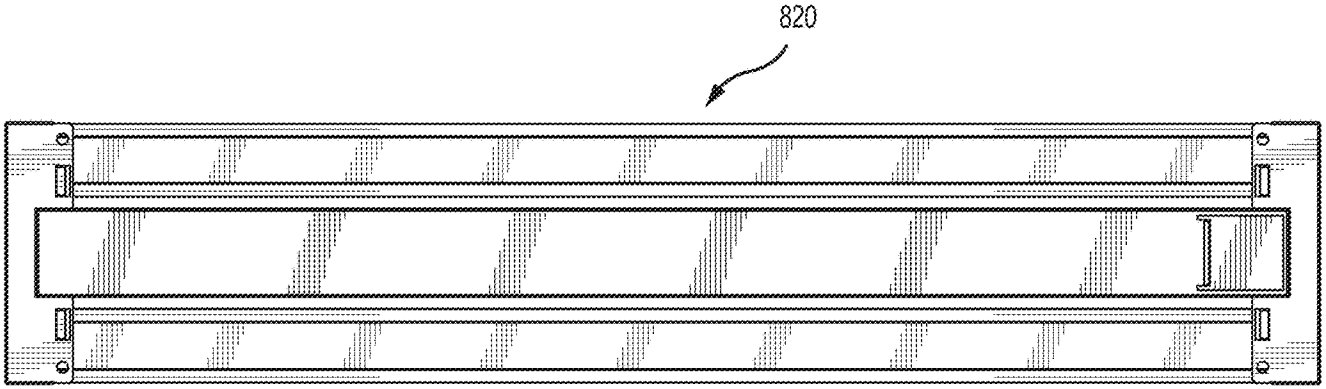
FIG. 59 is a top plan of the lighting fixture shown in FIG. 52.
Figure 60:
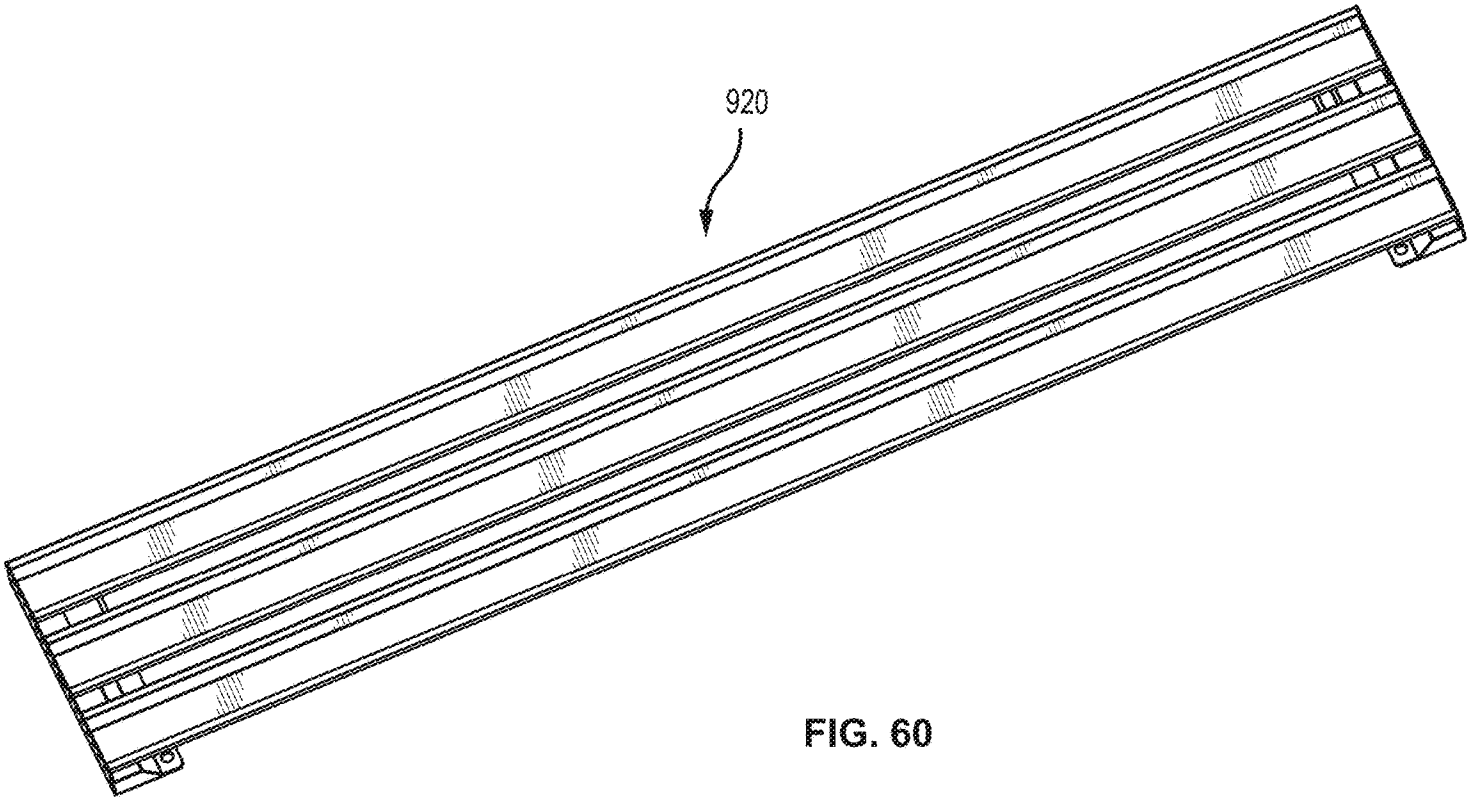
FIG. 60 is a perspective view of another embodiment of the lighting fixture according to the invention.
Figure 61:
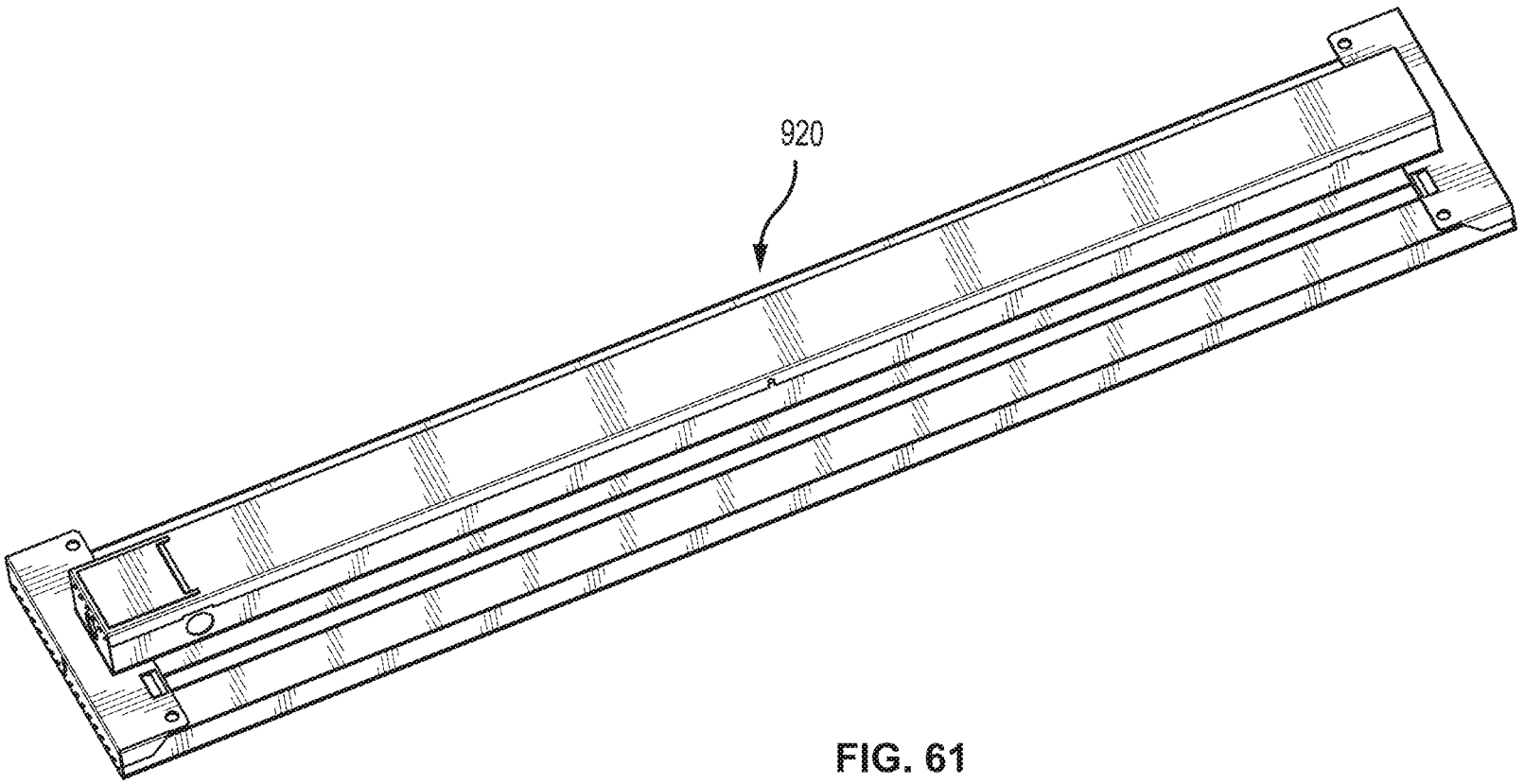
FIG. 61 is another perspective view of the lighting fixture shown in FIG. 60.
Figure 62:
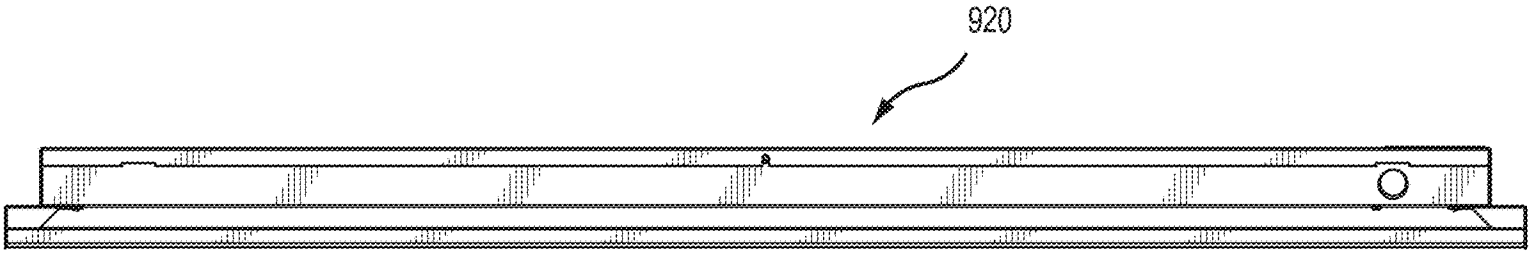
FIG. 62 is a side elevation view of the lighting fixture shown in FIG. 60.
Figure 63:
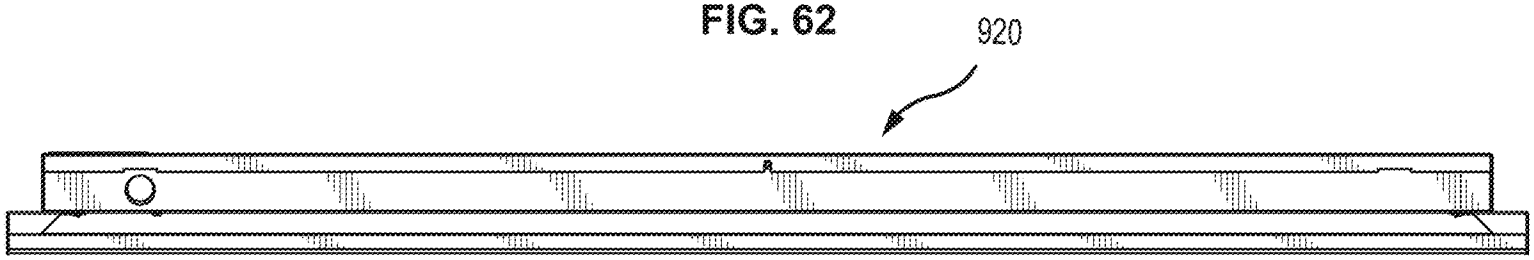
FIG. 63 is a side elevation view of the lighting fixture shown in FIG. 60.
Figure 65:
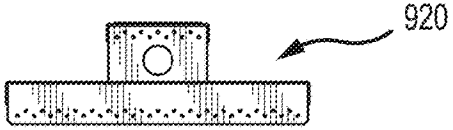
FIG. 65 is a rear elevation view of the lighting fixture shown in FIG. 60.
Figure 64:
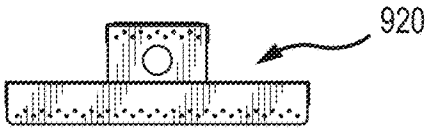
FIG. 64 is a front elevation view of the lighting fixture shown in FIG. 60.
Figure 66:
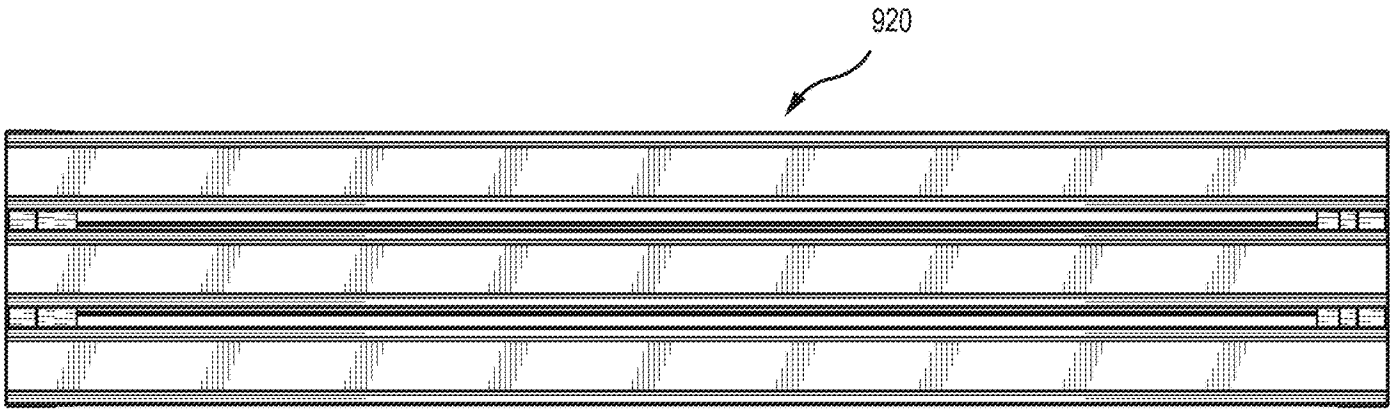
FIG. 66 is a bottom plan view of the lighting fixture shown in FIG. 60.
Figure 67:
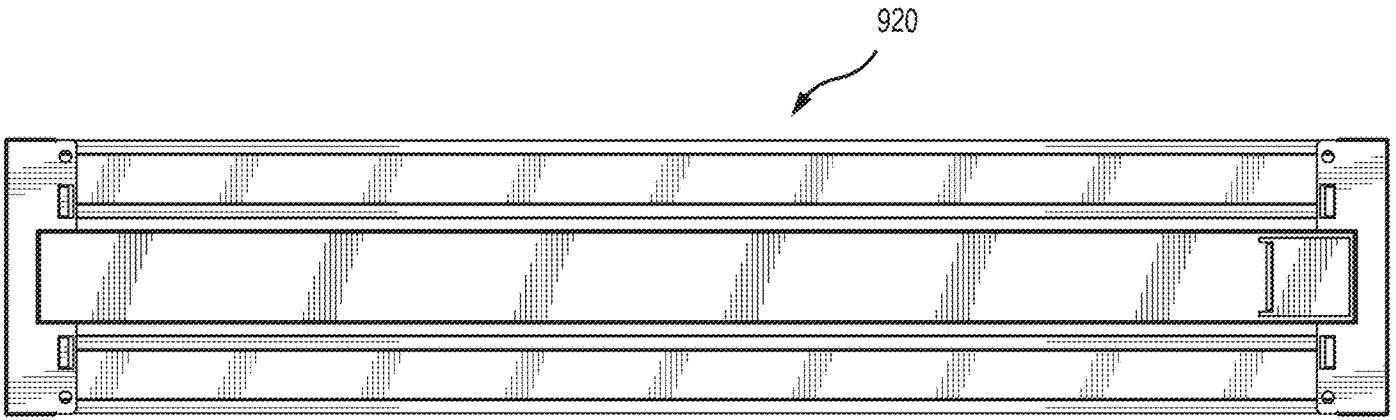
FIG. 67 is a top plan of the lighting fixture shown in FIG. 60.
Figure 68:
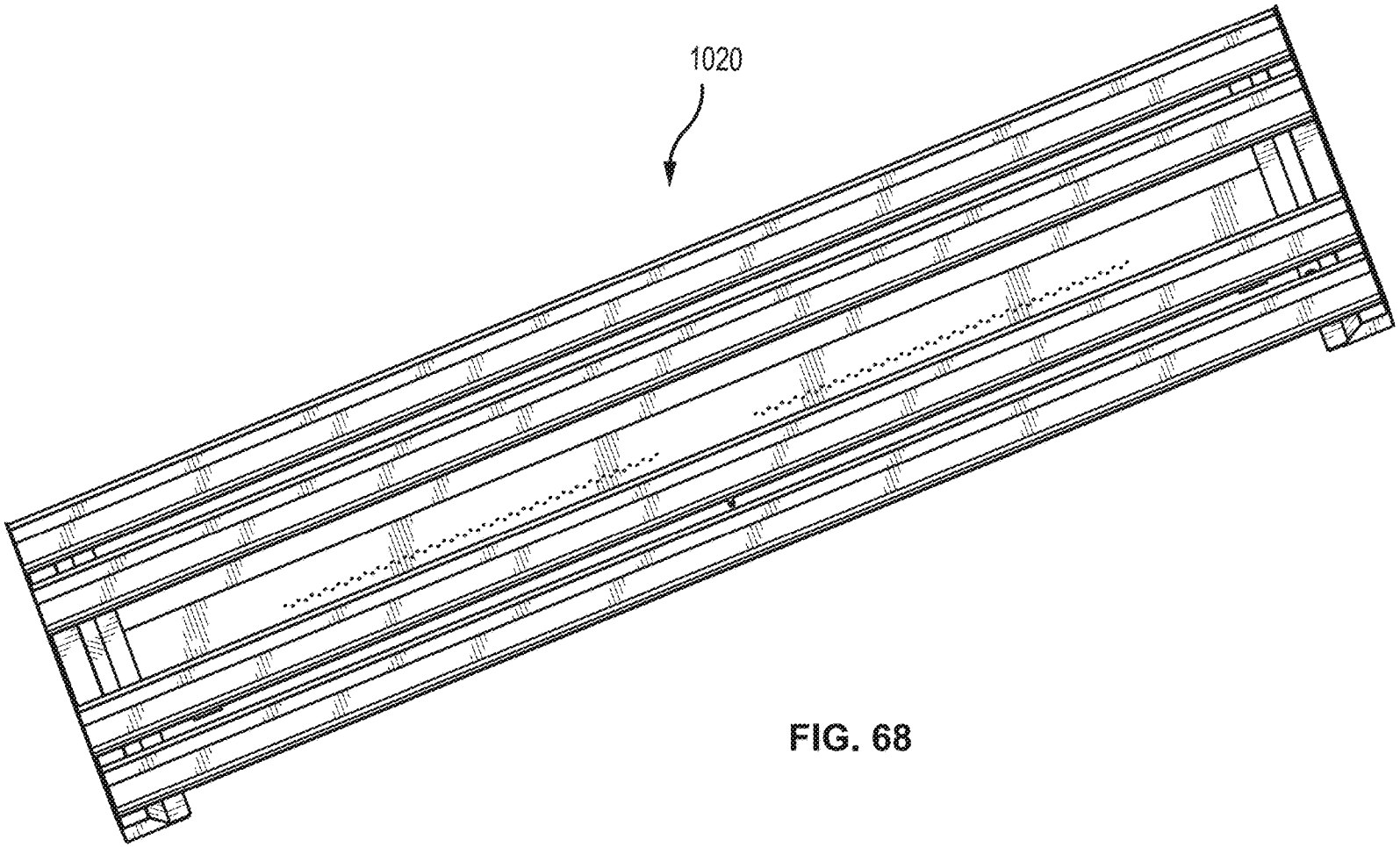
FIG. 68 is a perspective view of another embodiment of the lighting fixture according to the invention.
Figure 69:
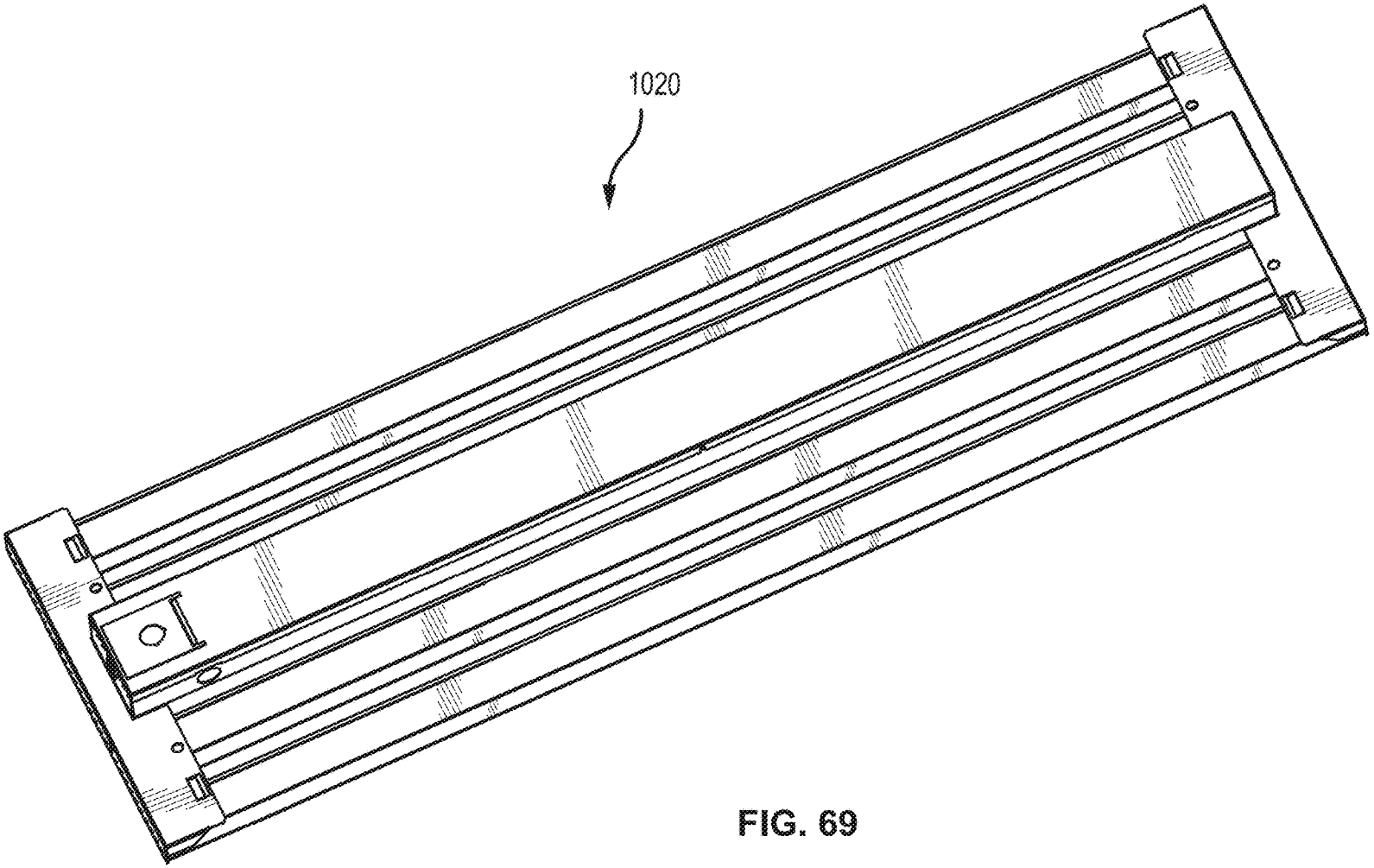
FIG. 69 is another perspective view of the lighting fixture shown in FIG. 68.
Figure 70:
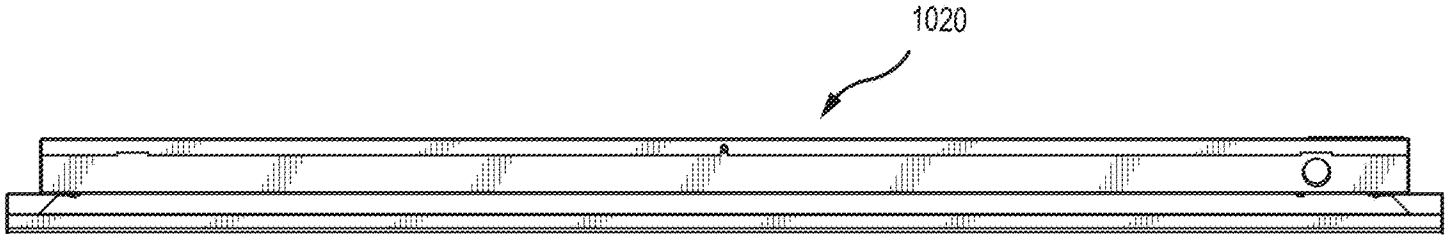
FIG. 70 is a side elevation view of the lighting fixture shown in FIG. 68.
Figure 71:
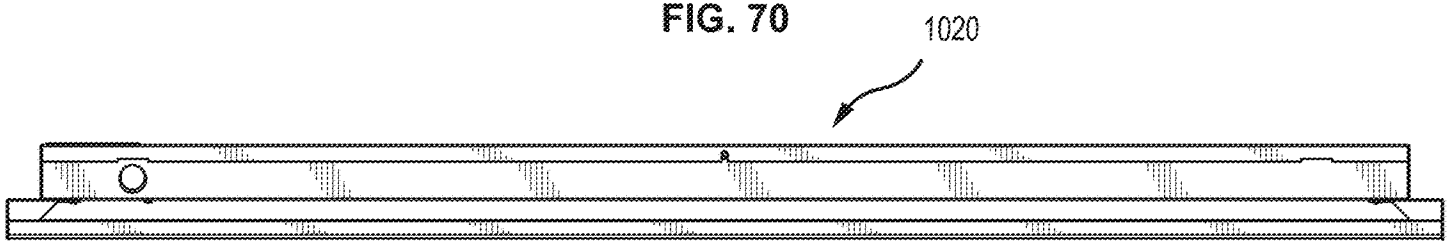
FIG. 71 is a side elevation view of the lighting fixture shown in FIG. 68.
Figure 73:
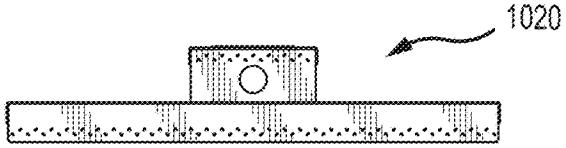
FIG. 73 is a rear elevation view of the lighting fixture shown in FIG. 68.
Figure 72:
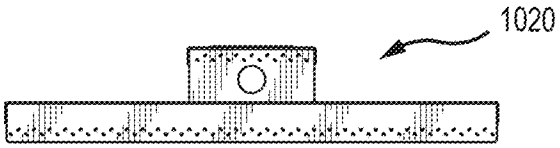
Figure 74:
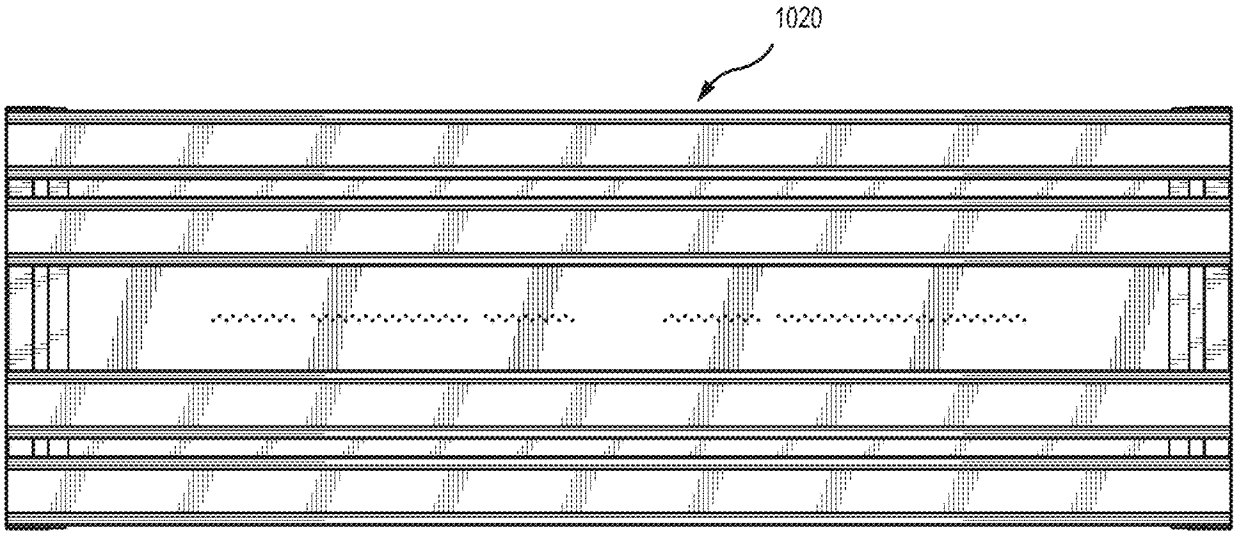
FIG. 74 is a bottom plan view of the lighting fixture shown in FIG. 68.
Figure 75:
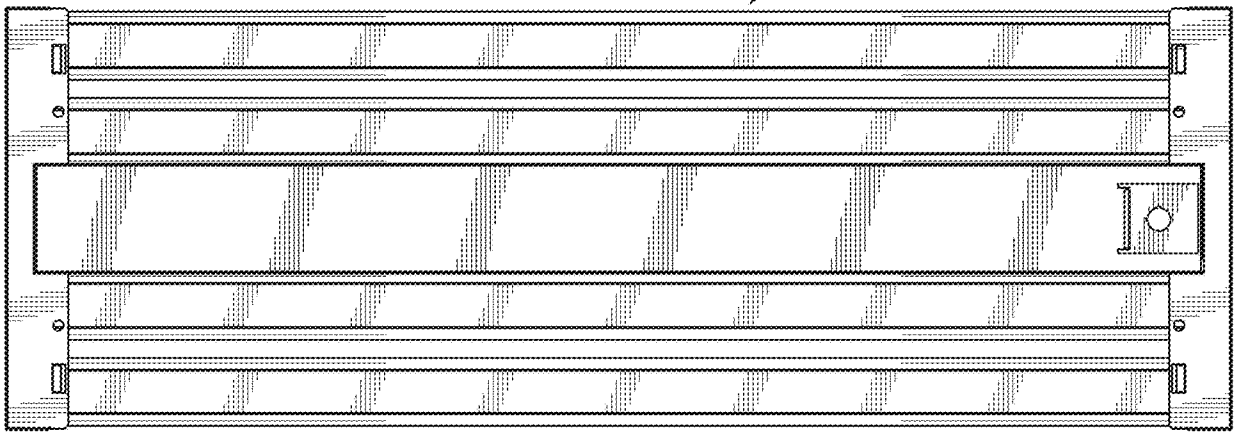
FIG. 75 is a top plan of the lighting fixture shown in FIG. 68.
Figure 76:
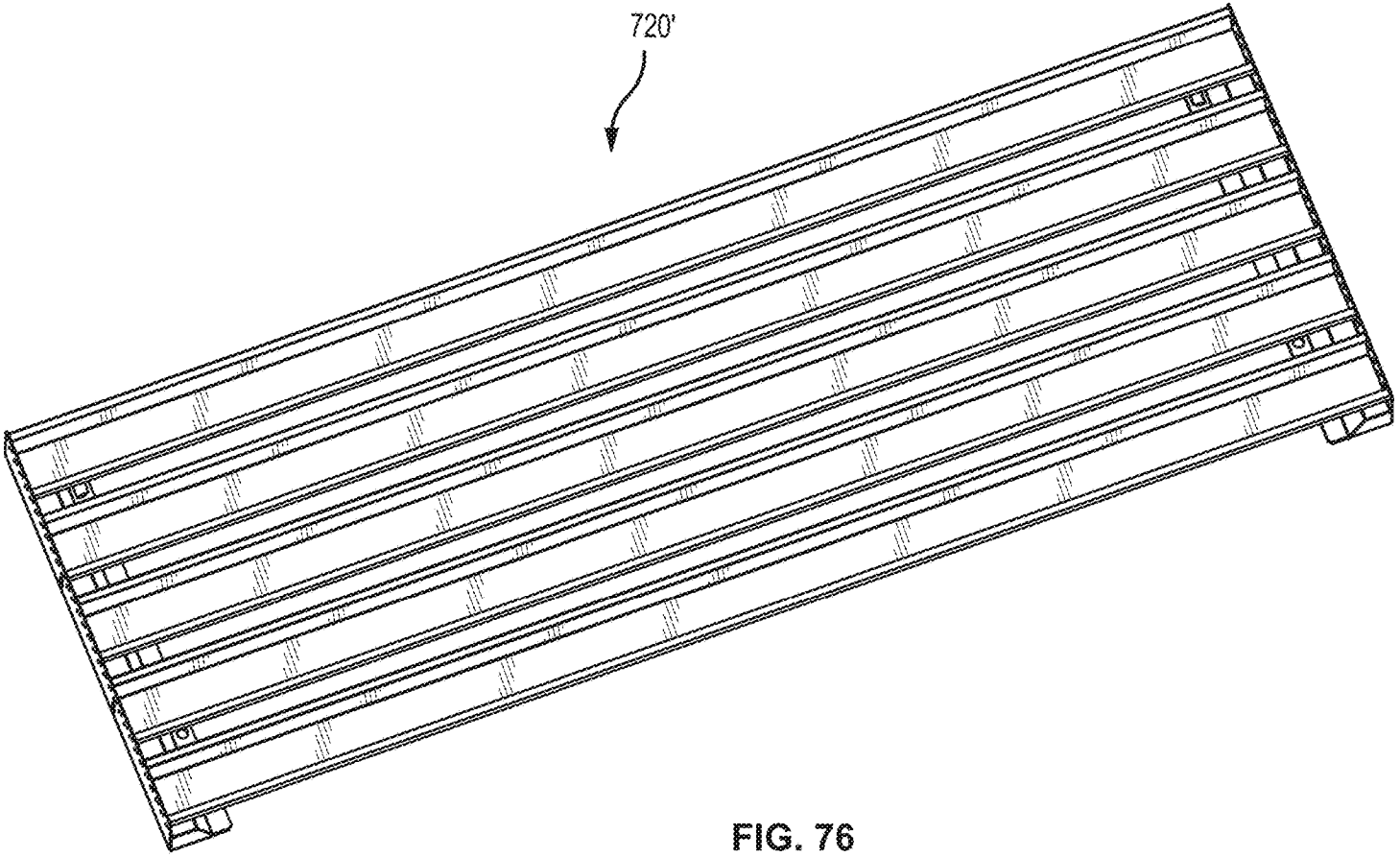
FIG. 76 is another perspective view of the lighting fixture shown in FIG. 42.
Figure 77:
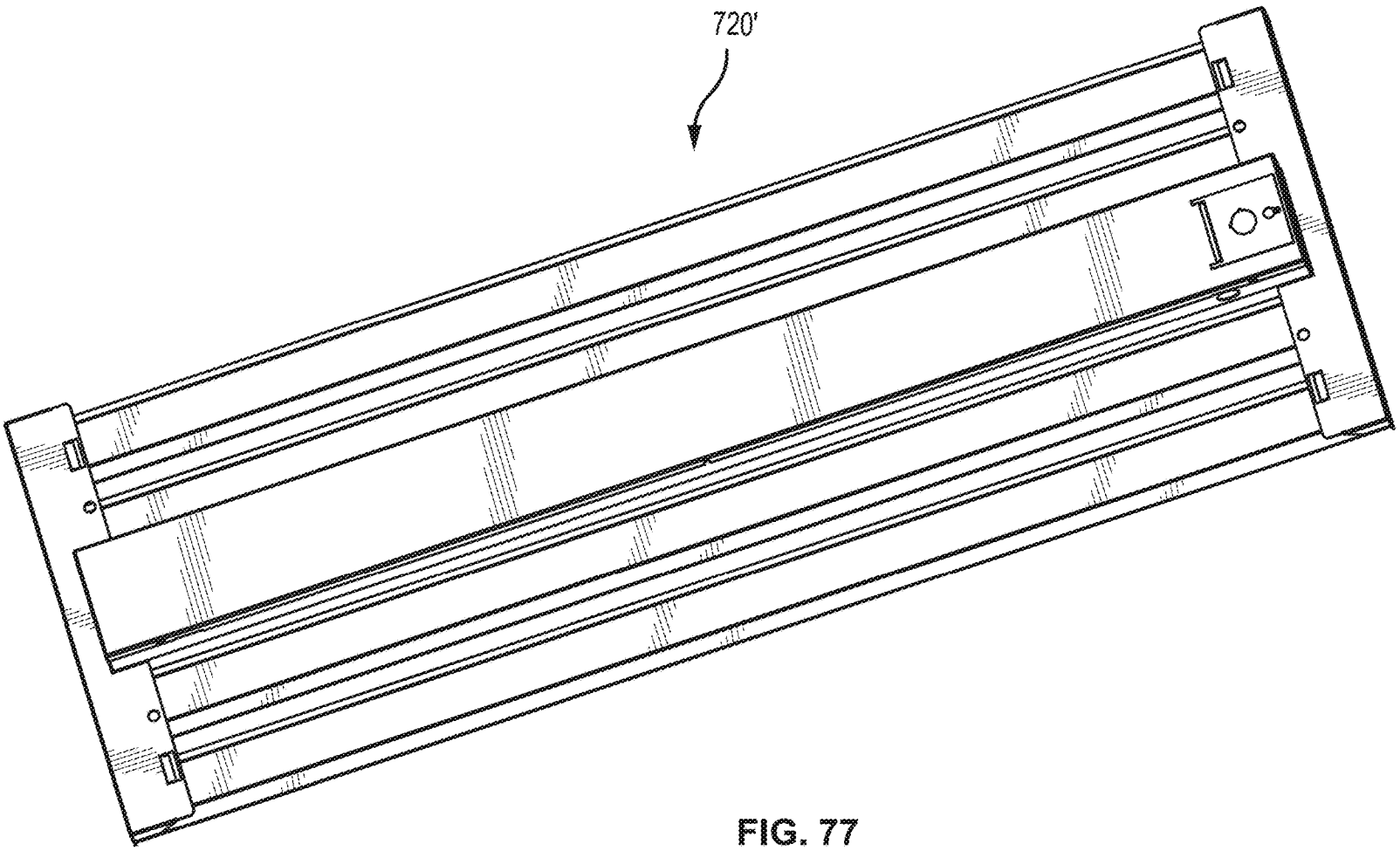
FIG. 77 is another perspective view of the lighting fixture shown in FIG. 76.
Figure 78:
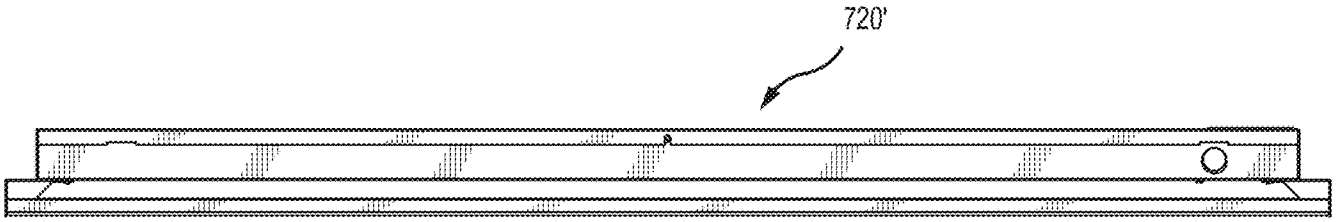
Figure 79:
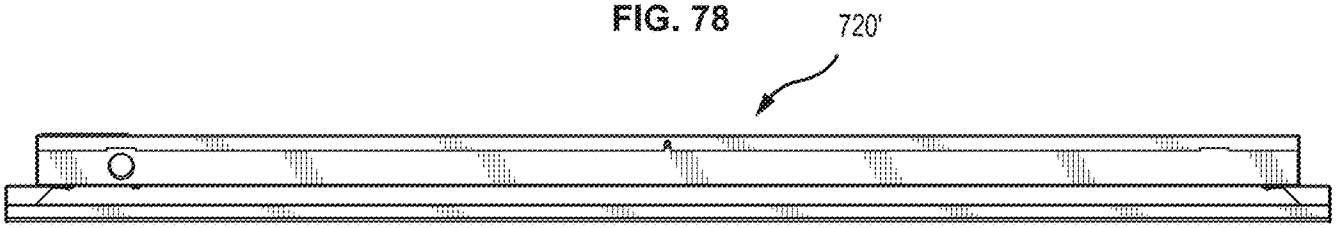
FIG. 79 is a side elevation view of the lighting fixture shown in FIG. 76.
Figure 81:
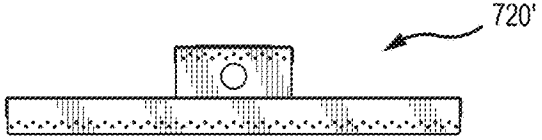
FIG. 81 is a rear elevation view of the lighting fixture shown in FIG. 76.
Figure 80:
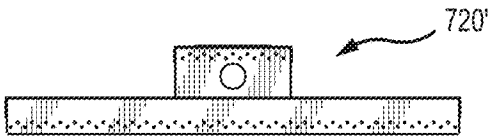
FIG. 80 is a front elevation view of the lighting fixture shown in FIG. 76.
Figure 82:
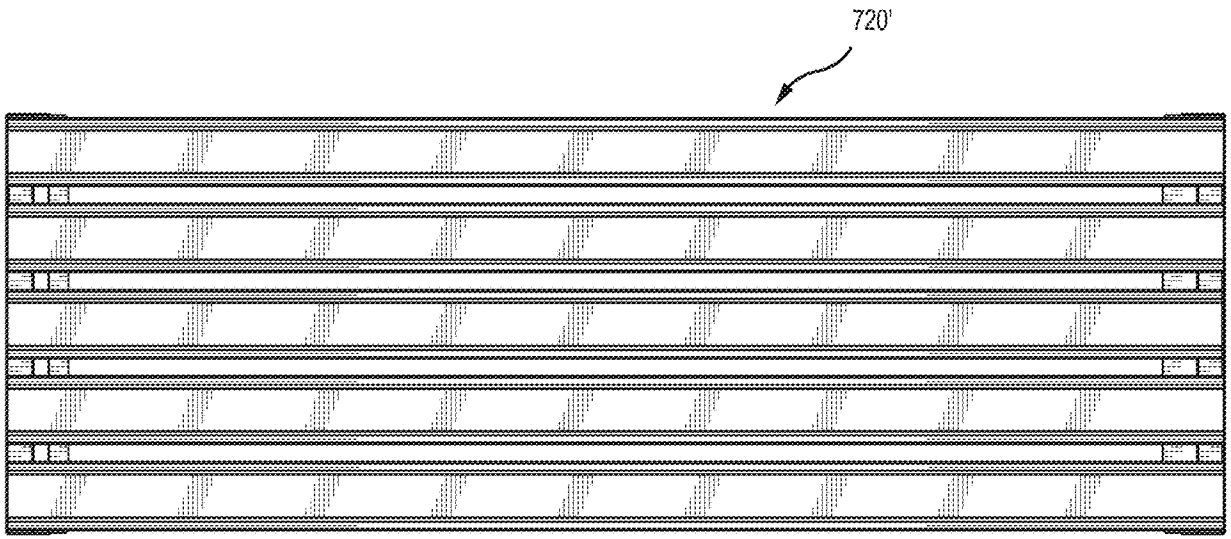
FIG. 82 is a bottom plan view of the lighting fixture shown in FIG. 76.
Figure 83:
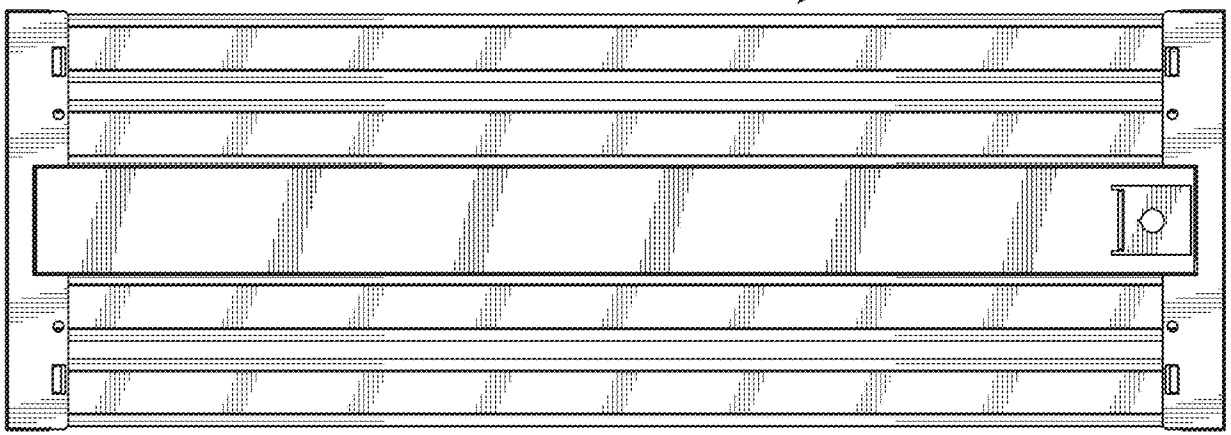
FIG. 83 is a top plan of the lighting fixture shown in FIG. 76.

FIGS. 42 and 43 shows five heat sinks 724*a*, 724*b*, 724*c*, 724*d*, 724*e* attached to the mounting bracket 726. Each heat sink 724*a*, 724*b*, 724*c*, 724*d*, 724*e* is identically formed to heat sink 724 and the specifics are not repeated herein. Each heat sink 724*a*, 724*b*, 724*c*, 724*d*, 724*e* is attached to the mounting bracket 726 in the same manner as described with respect to the first embodiment and the specifics are not repeated herein. Each heat sink 724*a*, 724*b*, 724*c*, 724*d*, 724*e* is attached to the end caps 774, 776 in the same manner as described with respect to the first embodiment and the specifics are not repeated herein. As shown in FIG. 42, the end caps 774, 776 are shown as part of the covers 806, however, it is to be understood that individual end caps 774, 776 may be provided. The lighting fixture 720' exemplifies an embodiment of the light fixture with more than one heat sink and the disclosure applies to the other embodiments with more than one heat sink, respectively.

If one or more heat sinks are provided, the heat sinks are spaced apart from each other along the length of the mounting bracket 726. If multiple heat sinks are provided, a single aperture 802 or multiple apertures may be provided in the mounting bracket 726 to allow wiring to be run from the driver 122 in the driver housing assembly 722 to the lighting sources 34 mounted on each of the heat sinks. The number of heat sinks with associated lighting sources 34 are only limited by the length of the mounting bracket 726. Therefore, the lighting fixture 720 is modular in that a desired number of heat sinks and associated lighting sources 34 can be provided. The heat sinks and associated lighting sources 34 may be evenly spaced along the mounting bracket 726, or may be randomly spaced along the mounting bracket 726.

The lighting fixture 720, 720' is suspended from a ceiling or other structure such that the lighting sources 34 shine downwardly into the space to be illuminated. A mount 814, see FIG. 36, is provided to attach the lighting fixture 720, 720' to the ceiling or other structure. The mount 814 may attach to mounting holes 816 on the cover 806. The mounting holes 816 may be provided through the mounting flange 792 of the mounting bracket 726.

The driver housing assembly 722, the mounting brackets 726, the end caps 774, 776 and covers 806 may be formed of metal. The driver housing assembly 722, the mounting brackets 726, the end caps 774, 776 and covers 806 may be powder coated or otherwise treated for durability of the metal. The lighting fixture 720 is extremely robust.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

The invention claimed is:

1. A lighting fixture comprising:

a driver housing assembly housing a driver;

a heat sink having a first end and a second end and a lighting source attached thereto;

a first mounting bracket; and a second mounting bracket;

whereby the first end of the heat sink is coupled to the driver housing assembly through the first mounting bracket and the second end of the heat sink is coupled to the driver housing through the second mounting bracket.

2. The lighting fixture of claim 1, whereby the lighting source is a light emitting diode.

3. The lighting fixture of claim 1, wherein the driver housing assembly comprises a pan and a driver housing cover.

4. The lighting fixture of claim 3, wherein the driver housing cover comprises an access panel.

5. The lighting fixture of claim 3, wherein the driver housing cover has a first end wall and a second end wall, and a plurality of vias are provided in each of the first and second end walls.

6. The lighting fixture of claim 1, whereby the first and second mounting brackets each comprise a second wall offset from a mounting flange by a first wall, whereby the mounting flange and second wall are parallel; and whereby the driver housing assembly is attached to the mounting flanges of the first and second mounting brackets, the first end of the heat sink is attached to the second wall of the first mounting bracket, and the second end of the heat sink is attached to the second wall of the second mounting bracket.

7. The lighting fixture of claim 1 further comprising a first mounting bracket cover to cover the first mounting bracket and a second mounting bracket cover to cover the second mounting bracket.

8. The lighting fixture of claim 7, wherein the first mounting bracket cover covers the first end of the heat sink and the second mounting bracket cover covers the second end of the heat sink.

9. The lighting fixture of claim 8, wherein the first and second mounting bracket covers have a plurality of vias.

10. The lighting fixture of claim 7, wherein the first and second mounting bracket covers comprise mounting holes configured to receive a fixture mounting device.

11. The lighting fixture of claim 1, whereby the heat sink comprises a base wall, a first depending side wall extending from a first side edge of the base wall having a first flange, and a second depending side wall extending from a second side edge of the base wall having a second flange.

12. The lighting fixture of claim 11 further comprising a lens which is positioned on the first and second flanges.

13. The lighting fixture of claim 1 comprising two heat sinks, each comprising at least one lighting source.

14. The lighting fixture of claim 1 comprising three heat sinks, each comprising at least one lighting source.

15. The lighting fixture of claim 14, whereby the three heat sinks are equally spaced along the first and second mounting brackets.

16. The lighting fixture of claim 1 comprising four heat sinks, each comprising at least one lighting source.

17. The lighting fixture of claim 16, whereby the four heat sinks are equally spaced along the first and second mounting brackets.

18. The lighting fixture of claim 1 comprising five heat sinks, each comprising at least one lighting source.

19. The lighting fixture of claim 18, whereby the five heat sinks are equally spaced along the first and second mounting brackets.

* * * * *